United States Patent [19]

Shirai et al.

[11] Patent Number: 4,786,574

[45] Date of Patent: Nov. 22, 1988

[54] LAYERED AMORPHOUS SILICON CONTAINING PHOTOCONDUCTIVE ELEMENT HAVING SURFACE LAYER WITH SPECIFIED OPTICAL BAND GAP

[75] Inventors: Shigeru Shirai, Ueno; Keishi Saitoh, Nagahama; Takayoshi Arai, Ueno; Minoru Kato, Ueno; Yasushi Fujioka, Ueno, all of Japan

[73] Assignee: Canon Kabushiki Kaisha, Tokyo, Japan

[21] Appl. No.: 11,507

[22] Filed: Feb. 5, 1987

[30] Foreign Application Priority Data

| | | | |
|---|---|---|---|
| Feb. 5, 1986 | [JP] | Japan | 61-24605 |
| Feb. 6, 1986 | [JP] | Japan | 61-24652 |
| Feb. 7, 1986 | [JP] | Japan | 61-26464 |
| Feb. 7, 1986 | [JP] | Japan | 61-26465 |
| Feb. 12, 1986 | [JP] | Japan | 61-28149 |
| Feb. 13, 1986 | [JP] | Japan | 61-29792 |

[51] Int. Cl.[4] ..... G03G 5/082

[52] U.S. Cl. ..... 430/66; 430/67; 430/57; 430/945; 430/95; 430/65; 430/60

[58] Field of Search ..... 430/56, 57, 66, 67

[56] References Cited

U.S. PATENT DOCUMENTS

| | | | |
|---|---|---|---|
| 4,600,670 | 7/1986 | Yamazaki | 430/57 |
| 4,673,629 | 6/1987 | Yamazaki | 430/57 |

*Primary Examiner*—J. David Welsh

*Attorney, Agent, or Firm*—Fitzpatrick, Cella, Harper & Scinto

[57] ABSTRACT

A light-receiving member for electrophotography comprises a substrate and a light-receiving layer provided on the substrate comprising a photoconductive layer exhibiting photoconductivity comprising an amorphous material containing at least one of hydrogen atoms and halogen atoms as the constituent in a matrix of silicon atoms and a surface layer comprising an amorphous material containing silicon atoms, carbon atoms and hydrogen atoms and the constituents, said surface layer being changed in the distribution concentration in the layer thickness direction of the constituent elements such that matching optical gap is obtained at the interface with said photoconductive layer, and the maximum distribution concentration of the hydrogen atoms within said surface layer being 41 to 70 atomic percent.

47 Claims, 16 Drawing Sheets

LAYERED AMORPHOUS SILICON CONTAINING PHOTOCONDUCTIVE ELEMENT HAVING SURFACE LAYER WITH SPECIFIED OPTICAL BAND GAP

BACKGROUND OF THE INVENTION

1. Field of the Invention

This invention relates to a light-receiving member for electrophotography having sensitivity to electromagnetic waves such as light [herein used in a broad sense, including ultraviolet rays, visible light, infrared rays, X-rays, and γ-rays].

2. Related Background Art

In the field of image formation, photoconductive materials which form light-receiving layers in light-receiving members for electrophotography are required to have a high sensitivity, a high SN ratio [Photocurrent (Ip)/Dark current (Id)], absorption spectral characteristics matching to those of electromagnetic waves to be irradiated, a rapid response to light, a desired dark resistance value as well as safety to human bodies during usage. Particularly, in the case of a light-receiving member for electrophotography to be assembled in an electrophotographic device to be used in an office as office apparatus, the aforesaid safety characteristic is very important.

From the standpoint as mentioned above, amorphous silicon [hereinafter represented as A-Si]has recently attracted attention as a photoconductive material. For example, German OLS Nos. 2746967 and 2855718 disclose applications of A-Si for use in light-receiving members for electrophotography.

Under the present situation, although the light-receiving members for electrophotography having light-receiving layers constituted of A-Si of the prior art have been attempted to be improved respectively and individually with respect to electrical, optical, photoconductive characteristics such as dark resistance value, photosensitivity, response to light and environmental characteristics in use and further with respect to stability with lapse of time and durability, there still remains room to be further improved in overall characteristics.

For instance, when improvements to higher photosensitivity and higher dark resistance were scheduled to be effected at the same time in light-receiving members, residual potential was frequently observed to remain during use thereof. When such a light-receiving member was repeatedly used for a long time, various inconveniences were caused such as accumulation of fatigue by repeated uses or the so called ghost phenomenon wherein residual images were formed.

Also, when constituting the light-receiving layer of A-Si material, the photoconductive member may contain as constituent atoms hydrogen atoms or halogen atoms such as fluorine atoms, chlorine atoms, etc., for improving their electrical, photoconductive characteristics, boron atoms, phosphorus atoms, etc., for controlling the electroconduction type as well as other atoms for improving other characteristics. Depending on the manner in which these constituent atoms are contained, there may sometimes be caused problems with respect to electrical, photoconductive characteristics or dielectric strength and further stability of the characteristics with lapse of time of the layer formed.

That is, the following inconveniences have frequently occurred. For example, the life of the photocarriers generated by light irradiation in the photoconductive layer constituting the light-receiving layer is not very long, or the image defect which is generally called "blank area" and may be considered to be due to the local discharging breaking phenomenon or the image defect which is generally called "white line" and may be considered to be formed by friction with a cleaning blade are occurred in the image transferred onto a transfer paper. Also, when the light-receiving layer has, for example, a surface layer with a certain film thickness as constituent layer on the surface thereof and the surface layer is substantially transparent to the light used, changes will occur on the reflected spectrum of the surface layer by abrasion with friction for a long time, whereby undesirable changes occurred with lapse of time in many cases particularly with respect to sensitivity, etc. Further, when used in a highly humid atmosphere or used immediately after being left to stand in a highly humid atmosphere for a long time, the so-called faint image was frequently formed.

Thus, it is required in designing of a light-receiving member to make elaborations about layer constitutions, chemical compositions of the respective layers, preparation methods, etc., so as to solve all of the problems as mentioned above along with the improvement of A-Si materials per se.

SUMMARY OF THE INVENTION

An object of the present invention is to solve the various problems in the light-receiving member for electrophotography having a light-receiving layer of the prior art constituted of A-Si as described above.

Another object of the present invention is to provide a light-receiving member for electrophotography having a light-receiving layer having a photoconductive layer constituted of A-Si as one of constituent layers having electrical, optical and photoconductive characteristics which are substantially constantly stable almost without dependence on the use environment, having excellent light fatigue resistance as well as excellent durability and humidity resistance without causing any deterioration phenomenon after repeated uses and being free entirely or substantially from residual potential observed.

Still another object of the present invention is to provide a light-receiving member for electrophotography having a light-receiving layer having a photoconductive layer constituted of A-Si as one of constituent layers having excellent adhesion between the substrate and the layer provided on the substrate or between the respective layers laminated, which is dense and stable in structural arrangement and also high in layer quality.

Yet another object of the present invention is to provide a light-receiving member for electrophotography exhibiting excellent electrophotographic characteristics, which is sufficiently capable of retaining charges at the time of charging treatment for formation of an electrostatic image to the extent such that conventional electrophotographic methods can be very effectively applied when it is provided for use as a light-receiving member for electrophotography.

Again, another object of the present invention is to provide a light-receiving member for electrophotography capale of providing easily a high quality image which is high in density, clear in half tone and high in resolution, without any image defect or faint image during prolonged use.

Yet still another object of the present invention is to provide a light-receiving member for electrophotography having high photosensitivity, high SN ratio characteristic and high dielectric strength, and which can be maintained under constant state throughout the whole period during prolonged use.

According to the present invention, there is provided a light-receiving member for electrophotography comprising a substrate and a light-receiving layer on the substrate comprising photoconductive layer exhibiting photoconductivity comprising an amorphous material containing at least one of hydrogen atoms and halogen atoms as the constituent in a matrix of silicon atoms (hereinafter abbreviated as "A-Si(H,X)") and a surface layer comprising an amorphous material containing silicon atoms, carbon atoms and hydrogen atoms as the constituents, said surface layer being changed in the distribution concentration in the layer thickness direction of the carbon atoms such that matching in optical band gap is obtained at the interface with said photoconductive layer, and the maximum distribution concentration of the hydrogen atoms within said surface layer being 41 to 70 atomic percent.

DESCRIPTION OF THE PREFERRED EMBODIMENTS

Figure 1A:
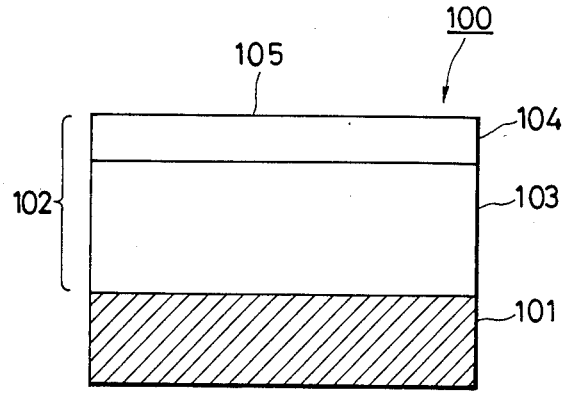
FIGS. 1A to lH and 28 to 32 are schematic illustrations of the layer constitutions of the preferred embodiments of the light-receiving member for electrophotography of the present invention.

In the following, the light-receiving member of the present invention is described in detail referring to the drawings.

FIG. 1A illustrates schematically the layer constitution of a first preferred embodiment of the light-receiving member for electrophotography of the present invention.

The light-receiving member 100 for electrophotography shown in FIG. 1A has a light-receiving layer 102 provided on a substrate 101 for light-receiving member, the light-receiving layer 102 having a layer constitution comprising a photoconductive layer 103 consisting of A-Si(H,X) and having photoconductivity and a surface layer 104 constituted of an amorphous material containing silicon atoms, carbon atoms, and hydrogen atoms as the constitutent elements, with the distribution concentrations of the constituent elements being determined such that matching in optical band gap can be obtained at the interface with the photoconductive layer, and the maximum distribution concentration of hydrogen atoms within the surface layer being 41 to 70 atomic %.

The light-receiving member for electrophotography of the present invention is designed to have the layer constitution as specified above can solve all of the various problems as mentioned above and exhibits extremely excellent electrical, optical, photoconductive characteristics, dielectric strength and use environmental characteristic.

Particularly, there is no influence of the residual potential on image formation at all, with its electrical characteristic being stable and having high sensitivity and high SN ratio, as well as excellent light fatigue resistance, repeated use characteristic, humidity resistance, dielectric strength, whereby the density is high, the half tone appears clearly, and an image of high resolving power and high quality can be obtained stably throughout the whole period during use of over a long term.

Substrate

The substrate to be used in the present invention may be either electroconductive or insulating. As the electroconductive substrate, there may be mentioned metals such as NiCr, stainless steel, Al, Cr, Mo, Au, Nb, Ta, V, Ti, Pt, Pd, etc. or alloys thereof.

As insulating substrates, there may conventionally be used films or sheets of synthetic resins, including polyester, polyethylene, polycarbonate, cellulose acetate, polypropylene, polyvinyl chloride, polyvinylidene chloride, polystyrene, polyamide, etc., glasses, ceramics, papers and so on. These insulating substrates should preferably have at least one surface subjected to electroconductive treatment, and it is desirable to provide other layers on the side at which said electroconductive treatment has been applied.

For example, electroconductive treatment of a glass can be effected by providing a thin film of NiCr, Al, Cr, Mo, Au, Ir, Nb, Ta, V, Ti, Pt, Pd, $In_2O_3$, $SnO_2$, ITO ($In_2O_3+SnO_2$) thereon. Alternatively, a synthetic resin film such as polyester film can be subjected to the electroconductive treatment on its surface by vacuum vapor deposition, electron-beam deposition or sputtering of a metal such as NiCr, Al, Ag, Pb, Zn, Ni, Au, Cr, Mo, Ir, Nb, Ta, V, Ti, Pt, etc. or by laminating treatment with the metal, thereby imparting electroconductivity to the surface. The substrate may be shaped in any form such as cylinders, belts, plates or others, and its form may be determined as desired. For example, it may desirably be formed into an endless belt or a cylinder for use in continuous high speed copying. The substrate may have a thickness, which is conveniently determined so that a light-receiving member as desired may be formed. When the light-receiving member is required to have a flexibility, the substrate is made as thin as possible, so far as the function of a support can be exhibited. However, in such a case, the thickness is generally 10 μor more from the points of fabrication and handling of the substrate as well as its mechanical strength.

Particularly, in the case of performing image recording by use of coherent light such as laser beam, unevenness may be provided on the substrate surface in order to cancel the image badness by the so-called interference fringe pattern which appears in the visible image.

The unevenness to be provided on the substrate surface can be formed by fixing a bit having a V-shaped cutting blade at a predetermined position on a cutting working machine such as milling machine, lathe, etc., and cut working accurately the substrate surface by, for example, moving regularly in a certain direction while rotating a cylindrical substrate according to a program previously designed as desired, thereby forming to a desired uneveness shape, pitch and depth. The inverse V-shaped linear projection produced by the unevenness formed by such a cutting working has a spiral structure with a center axis of the cylindrical substrate as its center. The spiral structure of the inverse V-shaped projection may be made into a multiple spiral structure such as double or triple structure or a crossed spiral structure.

Alternatively, a parallel line structure along the center axis may also be introduced in addition to the spiral structure.

Figure 2A:
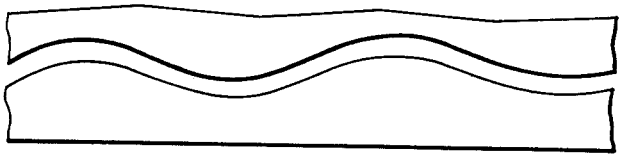
FIGS. 2A to 2C and 3 to 5 are schematic illustrations of unevenness shapes of the substrate surface and the method for preparing the uneveness shapes.
Figure 2B:
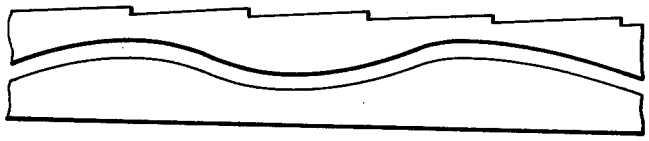
Figure 2C:
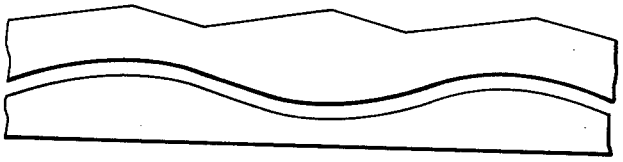

The longitudinal sectional shape of the convexity of the unevenness provided on the substrate surface is made an inverse V-shape for a managed nonuniformization of the layer thickness within minute columns of each layer formed and ensuring the good adhesion and desired electrical contact between the substrate and the layer directly provided on the substrate, but it should desirably be made substantially isosceles triangle, right triangle or scalene triangle, as shown in FIG. 2. Among these shapes, isosceles triangle and right triangle are preferred.

In the present invention, the respective dimensions of unevenness provided on the substrate surface under managed state should be set so as to accomplish consequently the objects of the present invention in view of the points as described below.

That is, in the first place, the A-Si(H,X) layer constituting the light receiving layer is sensitive to the state of the surface of the layer formed, and the layer quality will vary greatly depending on the surface state.

Therefore, it is necessary to set the dimensions of unevenness provided on the substrate surface so that lowering in layer quality of the A-Si(H,X) layer may not be brought about.

Secondly, if there is an extreme unevenness on the free surface of the light-receiving layer, it becomes impossible to perform completely cleaning in the cleaning operation after image formation. Also, when blade cleaning is practiced, there is the problem that the blade will be damaged sooner.

As the result of investigations of the problems in layer deposition as described above, problems in process of electrophotography and the conditions for prevention of interference fringe pattern, it has been found that the pitch at the concavity on the substrate surface should preferably be 500 μm to 0.3 μm, more preferably 200 μm to 1 μm, optimally 50 μm to 5 μm.

It is also desirable that the maximum depth of the concavity should preferably be made 0.1 μm to 5 μm, more preferably 0.3 μm to 3 μm, optimally 0.6 μm to 2 μm. When the pitch and the maximum depth of the concavity of the substrate surface are within the ranges as specified above, the gradient of the slanted plane of the concavity (or the linearly projected portion) may preferably be 1° to 20°, more preferably 3° to 15°, most preferably 4° to 10°.

On the other hand, the maximum difference in layer thickness based on the nonuniformness in layer thickness of the respective layers deposited on such a substrate should preferably be made 0.1 μm to 2 μm within the same pitch, more preferably 0.1 μm to 1.5 μm, optimally 0.2 μm to 1 μm.

Also, as an alternative method for cancelling image badness by interference fringe pattern in the case of using coherent light such as laser beam, unevenness shape with a plural number of spherical mark recesses may be also provided on the substrate surface.

That is, the surface of the substrate has more minute unevenness than resolving power required for the light-receiving member for electrophotography, and yet the unevenness is formed of a plural number of spherical mark recesses.

Figure 4:
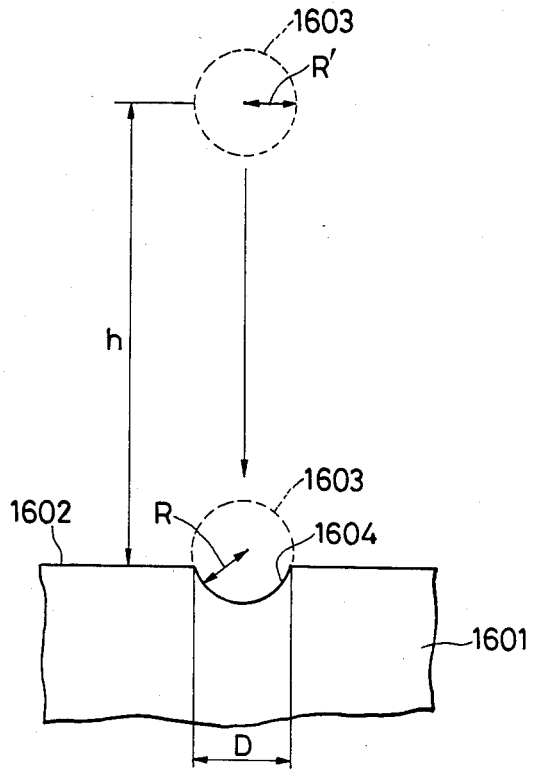
Figure 5:
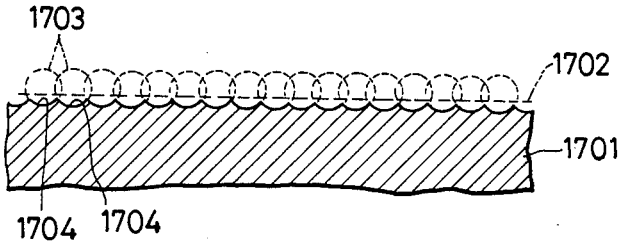

Referring now to FIG. 4 and FIG. 5, the shape of the surface of the substrate in the light-receiving member for electrophotography and a preferable preparation example thereof are explained below, but the shape of the substrate in the light-receiving member of the present invention and its preparation method are not limited by these.

FIG. 4 illustrates schematically a partially enlarged view of a part of the unevenness shape according to a typical example of the shape of the surface of the substrate in the light-receiving member for electrophotography of the present invention.

In FIG. 4, 1601 represents a substrate, 1602 the surface of substrate, 1603 a rigid body true sphere and 1604 a spherical mark recess.

Further, FIG. 4 also shows an example of preferable preparation method for obtaining the surface shape of the substrate. More specifically, by permitting a rigid body true sphere 1603 to fall naturally from a position at a predetermined height from the substrate surface 1602 and be collided against the substrate surface 1602, whereby a spherical recess 1604 can be formed. And, by use of a plural number of rigid body true spheres 1603 with substantially the same radius R', and permitting them to fall simultaneously or successively from the same height h, a plural number of spherical mark recesses 1604 having the same radius of curvature R and the width D can be formed on the substrate surface 1602.

A typical example of the substrate having unevenness shape with a plural number of spherical mark recesses formed on the surface as described above is shown in FIG. 5. In FIG. 5, 1701 represents a substrate, 1702 the convexity of the unevenness, 1703 a rigid body true sphere and 1704 the concavity of the unevenness.

In this connection, the radius of curvature R and the width D of the unevenness shape with the spherical mark recesses on the substrate surface of the light receiving member for electrophotography of the present invention are important factors for accomplishing efficiently the effect of preventing generation of interference fringe in the light-receiving member of the present invention. The present inventors have made various experiments and consequently found the following facts. That is, when the radius of curvature R and the width D satisfy the following formula:

$$D/R \leqq 0.035,$$

0.5 or more Newton ring by shearing interference exists within each mark recess. Further, when they satisfy the following formula:

$$D/R \leqq 0.055,$$

one or more Newton ring by shearing interference exists within each mark recess.

From these facts, in order to disperse the interference fringe generated as a whole in the light-receiving member, within the respective mark recesses thereby preventing generation of interference fringe in the light-receiving member, it is desirable that the above D/R should be made 0.035 or more, preferably 0.055 or more.

Also, the width D of the unevenness with mark recess should be at most about 500 μm, preferably 200 μm or less, more preferably 100 μm or less.

Figure 3:
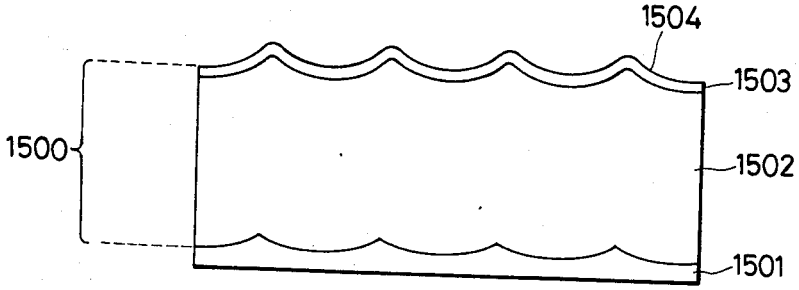

FIG. 3 shows an example of the case having a light-receiving layer 1500 comprising a photoconductive layer 1502 and a surface layer 1503 formed on the substrate 1501 prepared according to the above method. The surface layer 1503 has a free surface 1504.

In the present invention, in order to achieve its objects effectively, the photoconductive layer 103, 1502 constituting a part of the light-receiving layer 102, 1500 formed on the substrate 101, 1501 is constituted of A-Si(H,X) exhibiting photoconductivity to the irradiated light having the semiconductor characteristics as shown below.

(1) p-type A-Si(H,X) . . . containing only acceptor; or containing both donor and acceptor with relatively higher concentration of acceptor (Na);

(2) p-type A-Si(H,X) . . . in the type of (1), that containing acceptor with lower acceptor concentration (Na) than (1), when containing only acceptor, or containing acceptor with relatively lower concentration as compared with (1), when containing both acceptor and donor;

(3) n-type A-Si(H,X) . . . containing only donor; or containing both donor and acceptor with relatively higher concentration of donor (nd);

(4) n-type A-Si(H,X) . . . in the type of (3), that containing donor at lower donor concentration (Nd) than (3), when containing only donor, or containing donor with relatively lower concentration as compared with (3), when containing both acceptor and donor;

(5) i-type A-Si(H,X) . . . $Na \simeq Nb \simeq O$ or $Na \simeq Nd$

In the present invention, typical examples of halogen atoms (X) to be incorporated in the photoconductive layer 103, 1502 are F, Cl, Br and I, especially preferably F and Cl.

In the present invention, formation of a photoconductive layer 103, 1502 constituted of A-Si(H,X) may be conducted according to the vacuum deposition method utilizing discharging phenomenon, such as glow discharge method, microwave discharge method, sputtering method or ion-plating method. For example, for formation of a photoconductive layer 103, 1502 constituted of A-Si(H,X) according to the glow discharge method, the basic process comprises introducing a starting gas for introduction of hydrogen atoms (H) and/or a starting gas for introduction of halogen atoms (X) together with a starting gas for supplying silicon atoms (Si) into the deposition chamber which can be internally brought to reduced pressure, wherein glow discharge is generated thereby to form a layer of A-Si(H,X) on the surface of a substrate placed at a predetermined position in the chamber. When it is to be formed according to the sputtering method, a starting gas for introduction of hydrogen atoms (H) and/or a gas for introduction of halogen atoms (X) may be introduced into the chamber for sputtering, when effecting sputtering upon the target formed of Si in a atmosphere of an inert gas such as Ar, He or a gas mixture based on these gases.

The starting gas for supplying Si to be used in the present invention may include gaseous or gasifiable hydrogenated silicons (silanes) such as $SiH_4$, $Si_2H_6$, $Si_3H_8$, $Si_4H_{10}$ and others as effective materials. In particular, $SiH_4$ and $Si_2H_6$ are preferred with respect to easy handling during layer formation and efficiency of supplying Si.

As the effective starting gas for incorporation of halogen atoms to be used in the present invention, there may be mentioned a number of halogen compounds such as halogen gases, halides, interhalogen compounds and silane derivatives substituted with halogens which are gaseous or gasifiable.

Alternatively, it is also effective in the present invention to use a gaseous or gasifiable silicon compound containing halogen atoms which is constituted of both silicon atoms and halogen atoms.

Typical examples of halogen compounds preferably used in the present invention may include halogen gases such as of fluorine, chlorine, bromine or iodine and interhalogen compounds such as BrF, ClF, $ClF_3$, $BrF_5$, $BrF_3$, $IF_3$, $IF_7$, ICl, IBr, etc.

As the silicon compound containing halogen atom, silicon halides such as $SiF_4$, $Si_2F_6$, $SiCl_4$, $SiBr_4$, or the like are preferred.

When the specific light-receiving member of this invention is formed according to the glow discharge method by use of such a silicon compound containing halogen atoms, it is possible to form a layer constituted of A-Si:H containing halogen atoms (X) as constituent element on a given substrate without use of a hydrogenated silicon gas as the starting gas capable of supplying Si.

In forming the layer containing halogen atoms according to the glow discharge method, the basic procedure comprises feeding a starting gas for supplying Si, namely a gas of silicon halide and a gas such as Ar, $H_2$, He, etc. at a predetermined ratio in a suitable amount into the deposition chamber for formation of a photoconductive layer, followed by excitation of glow discharge to form a plasma atmosphere of these gases, thereby forming a photoconductive layer on a substrate. It is also possible to form a layer by mixing a gas of a silicon compound containing hydrogen atoms at a suitable ratio with these gases in order to incorporate hydrogen atoms therein.

Each of the gases for introduction of respective atoms may be either a single species or a mixture of plural species at a predetermined ratio.

For formation of a layer of A-Si(H,X) by the reactive sputtering method or the ion-plating method, for example, a target of Si is used and sputtering is effected thereon in a suitable gas plasma atmosphere in the case of the sputtering method. Alternatively, in the case of ion-plating method, a polycrystalline or single crystalline silicon is placed as vaporization source in a vapor deposition boat, and the silicon vaporization source is vaporized by heating by resistance heating method or electron beam method (EB method) thereby to permit vaporized flying substances to pass through a suitable gas plasma atmosphere.

During this procedure, in either of the sputtering method or the ion-plating method, for introduction of halogen atoms into the layer formed, a gas of a halogen compound as mentioned above or a silicon compound containing halogen as mentioned above may be introduced into the deposition chamber to form a plasma atmosphere of the gas therein.

When hydrogen atoms are to be introduced, a starting gas for introduction of hydrogen atoms such as $H_2$ or a gas such as silanes as mentioned above may be introduced into the deposition chamber for sputtering, followed by formation of a plasma atmosphere of the gas.

In the present invention, as the starting gas for introduction of halogen atoms, the halogen compounds or silicon compounds containing halogens as mentioned above can effectively be used. In addition, it is also possible to use a gaseous or gasifiable halide containing hydrogen as one of the constituents such as hydrogen halide, including FP, HCl, HBr, HI and the like or halo-substituted hydrogenated silicon, including $SiH_2F_2$, $SiH_2I_2$, $SiH_2Cl_2$, $SiHCl_3$, $SiH_2Br_2$, $SiHBr_3$ and the like as an effective starting material for formation of a photoconductive layer.

These halides containing hydrogen atom, which can introduce hydrogen atoms very effectively for controlling electrical or photoelectric characteristics into the layer during formation of the photoconductive layer simultaneously with introduction of halogen atoms, can preferably be used as the starting material for introduction of halogen atoms.

For incorporation of hydrogen atoms structurally into the layer, $H_2$ or a gas of hydrogenated silicon, including $SiH_4$, $Si_2H_6$, $Si_3H_8$, $Si_4H_{10}$ and so on may be permitted to be co-present with a silicon compound for supplying Si in a deposition chamber, wherein discharging is excited.

For example, in the case of the reactive sputtering method, an Si target is used and a gas for introduction of halogen atoms and $H_2$ gas are introduced together with, if necessary, as inert gas such as He, Ar, etc. into a deposition chamber, wherein a plasma atmosphere is formed to effect sputtering of the Si target, thereby forming a layer of A-Si(H,X) on the substrate.

Further, there may also be introduced a gas such as of $B_2H_6$ or others in order to effect doping with impurities.

The amount of hydrogen atoms (H) or halogen atoms (X) incorporated in the photoconductive layer in the light-receiving member for electrophotography according to the present invention, or total amount of both of these atoms, may be preferably 1 to 40 atomic %, more preferably 5 to 30 atomic %.

The amount of hydrogen atoms (H) and/or halogen atoms (X) in the photoconductive layer can be controlled by controlling the substrate temperature, the amounts of the starting materials for incorporation of hydrogen atoms (H) and/or halogen atoms (X) to be introduced into the deposition device system, the discharging power, etc.

In the present invention, as the diluting gas to be used during formation of the photoconductive layer 103, 1502 according to the glow discharge method or the sputtering method, there may be employed the so-called rare gases such as He, Ne, Ar, etc., as preferable ones.

In order to make the semiconductor characteristic of the photoconductive layer 103, 1502 a desired one of (1) - (5), n-type impurity, p-type impurity or both impurities can be incorporated into the layer in a controlled amount during formation of the layer. As such impurities, p-type impurities may include atoms belonging to the group III of the periodic table such as B, Al, Ga, In, Tl, etc., as preferable ones, while n-type impurities may include atoms belonging to the group V of the periodic table such as N, P, As, Sb, Bi, etc., as preferable ones, particularly preferably B, Ga, P, Sb, etc.

In the present invention, when the impurity typified by the atoms belonging to the group II or V of the periodic table are contained throughout the whole layer region of the photoconductive layer 103, 1502, the effect of controlling conduction type and/or conductivity is primarily exhibited.

The content of the impurity in this case is relatively smaller, preferably $1\times10^{-3}$ to $3\times10^{2}$ atomic ppm, more preferably $5\times10^{-3}$ to $10^{2}$ atomic ppm, optimally $1\times10^{-2}$ to 50 atomic ppm.

Furthermore, at least one of oxygen atoms and nitrogen atoms may be contained throughout the whole layer region of the photoconductive layer in amounts which do not impair the characteristics desired for the photoconductive layer.

When oxygen atoms are contained in the whole layer region of the photoconductive layer 103, 1502 in the present invention, primarily the effects of higher dark resistance and improvement of adhesion between the substrate and the photoconductive layer and between the photoconductive layer and the surface layer, etc. are brought about. However, it is desirable that the content of oxygen atoms should be made relatively smaller in order to avoid deterioration of the photoconductive characteristics of the photoconductive layer 103, 1502.

In the case of nitrogen atoms, in addition to the above points, for example, improvement of photosensitivity can be effected in the co-presence of the group II atoms, especially B (boron). The content of oxygen atoms, nitrogen atoms or the sum of both may be preferably $5\times10^{-4}$ to 30 atomic %, more preferably $1\times10^{-3}$ to 20 atomic %, optimally $2\times10^{-3}$ to 15 atomic %.

For doping of the impurity into the photoconductive layer 103 or 1502, the starting material for introduction of the impurity may be introduced together with the main starting materials for formation of the photoconductive layer 103 or 1502 under gaseous state during layer formation. Such starting material for introduction of the impurity should be desirably selected which is gaseous under normal temperature and normal pressure or readily gasifiable at least under the layer forming conditions.

Specific examples of such starting materials for introduction of the impurities may include $PH_3$, $P_2H_4$, $PF_3$, $PF_5$, $PCl_3$, $AsH_3$, $AsF_3$ $AsF_5$, $AsCl_3$, $SbH_3$, $SbF_3$, $SbF_5$, $BiH_3$, $BF_3$, $BCl_3$, $BBr_3$, $B_2H_6$, $B_4H_{10}$, $B_5H_9$, $B_5H_{11}$, $B_6H_{10}$, $B_6H_{12}$, $B_6H_{14}$, $AlCl_3$, $GaCl_3$, $InCl_3$, $TlCl_3$, and the like.

For incorporating at least one kind of atoms selected from oxygen atoms and nitrogen atoms, for example, in the case of formation according to the glow discharge method, a compound containing at least one element of oxygen atoms and nitrogen atoms may be introduced together with the starting gas for formation of a photoconductive layer 103 or 1502 into a deposition chamber which can be internally brought to reduced pressure, wherein glow discharge is excited to form a photoconductive layer 103 or 1502.

Examples of the oxygen atom containing compound as the starting material for introduction of oxygen atoms may include oxygen ($O_2$), carbon monoxide (CO), carbon dioxide ($CO_2$), nitrogen monoxide, nitrogen dioxide, etc.

As the nitrogen atom containing compounds for the starting material for introduction of nitrogen atoms, there may be employed, for example, nitrogen ($N_2$), nitrogen monoxide, nitrogen dioxide, ammonia, etc.

On the other hand, for example, when the photoconductive layer 103 or 1502 is formed according to the sputtering method, a target for sputtering molded by mixing the components comprising, for example, ($Si+Si_3N_4$) or ($Si+SiO_2$) at a desired mixing ratio may be used or two sheets of Si wafer and $Si_3N_4$ wafer or two sheets of Si wafer and $SiO_2$ wafer may be used as the target for sputtering. Alternatively, a gas of a nitrogen containing compound or a gas of an oxygen containing compound may be introduced together with the gas for sputtering such as Ar gas, etc., into a deposition chamber, where sputtering may be effected with the use of Si as the target to form a photoconductive layer 103 or 1502.

During formation of the photoconductive layer 103 or 1502, the substrate temperature during layer formation is an important factor which influences the structure and the characteristic of the layer to be formed, and in the present invention, the substrate temperature during layer formation should desirably be controlled strictly so that the photoconductive layer 103 or 1502 having tee intended characteristic may be prepared as desired.

The substrate temperature during formation of the photoconductive layer 103 or 1502 for the purpose of accomplishing effectively the objects of the present invention should be selected within the optimum range corresponding to the method for formation of the photoconductive layer 103 or 1502 to practice formation of the photoconductive layer 103 or 1502, but it may be generally 50° C. to 350° C., preferably 100° C. to 300° C. For formation of the photoconductive layer 103 or 1502, it is advantageous to employ the glow discharge method or the sputtering method for the reasons such as relatively easier severe control of the composition ratio of the atoms constituting the layer or control of the layer thickness, and in the case of forming a photoconductive layer 103 or 1502 according to these layer forming methods, discharging power or gas pressure during layer formation is also one of important factors influencing the characteristic of the photoconductive layer 103 or 1502 to be prepared similarly as the above substrate temperature.

The discharging power condition for preparing effectively the photoconductive layer 103 or 1502 having the characteristics for accomplishing the objects in the preent invention with good productivity may be generally 10 to 1000 W, preferably 20 to 500 W. The gas pressure within the deposition chamber may be generally 0.01 to 1 Torr, preferably about 0.1 to 0.5 Torr.

In the present invention, the numerical value ranges desirable for the substrate temperature, discharging power during formation of the photoconductive layer 103 or 1502 may be the values within the ranges as mentioned above, but these layer forming factors are not determined independently and separately, but it is desirable that the optimum values for the factors for forming respective layers should be determined based on the mutual organic relationship so that a photoconductive layer 103 or 1502 with desired characteristics may be formed.

The layer thickness of the photoconductive layer 103 or 1502 may be determined suitably as desired so that the photocarriers generated by irradiation of a light having desired spectral characteristic may be transported with good efficiency, and it is preferably 1 to 100 $\mu$, more preferably 2 to 50 $\mu$.

The surface layer 104 or 1503 formed on the photoconductive layer 103 or 1502 has a free surface 105 or 1504, which is provided primarily for accomplishing the objects of the present invention in humidity resistance, continuous repeated use characteristic, dielectric strength, use environment characteristic, durability, etc.

And, in the light-receiving member of the present invention, it is an extremely important point that the optical band gaps Eg opt of the both layers at the interface between the surface layer 104 or 1503 and the photoconductive layer 103 or 1502 should be matched to each other or matched at least to the extent which can prevent substantially reflection of the incident light at the interface between the surface layer 104 or 1503 and the photoconductive layer 103 or 1502, and it is also an important point that this presents an extremely specific preferable condition in relationship with the hydrogen content. Further, in the present invention, it is necessary to set the hydrogen content at the region near the surface of the surface layer 104 or 1503, at least at the outermost surface at a predetermined concentration.

For satisfying the various conditions as mentioned above, the distribution states of the constituent elements within the surface layer 104 or 1503 are required to be determined under strict condition control.

Further, in addition to the conditions as described above, at the end portion on the free surface side of the surface layer 104 or 1503, it is also another point of consideration to constitute the optical band gap Eg opt possessed by the surface layer 104 or 1503 sufficiently great at the end portion on the free surface side of the surface layer 104 or 1503 in order to ensure sufficiently the dose of incident light reaching the photoconductive layer 103 or 1502 provided beneath the surface layer 104 or 1503. And, simultaneously with constitution so that optical band gaps Eg opt may be matched at the interface between the surface layer 104 or 1503 and the photoconductive layer 103 or 1502, when the optical band gap Eg opt is constituted sufficiently great at the end portion of the free surface side of the surface layer 104 or 1503, the optical band gap Eg opt possessed by the surface layer 104 or 1503 is constituted so as to contain at least the region wherein it is continuously changed in the layer thickness direction of the surface layer 104 or 1503.

For controlling the values of optical band gap Eg opt in the surface layer 104 or 1503 in the layer thickness direction, it can be typically practiced by controlling of the amount of the carbon atom (C) which is the main controlling atom for the optical band gap Eg opt to be contained in the surface layer 104 or 1503, and also for the hydrogen atoms having the function of matching other characteristics of the surface layer 104 or 1503 to the optimum condition in the form corresponding to the change in optical band gap Eg opt, its content is controlled to a specific distribution state.

Referring now to FIG. 6 through FIG. 9, some typical examples of distribution states of carbon atoms and hydrogen atoms in the layer thickness direction of the surface layer 104 or 1503 are described, but the present invention is not limited by these examples.

In FIGS. 6 through 9, the axis of abscissa indicates the distributed concentration C of the carbon atoms (C), silicon atoms (Si), and hydrogen atoms (H), and the axis of ordinate the layer thickness t of the surface layer. In the FIGS. $t_T$ shows the interface position between the photoconductive layer and the surface layer, $t_F$ the free surface position, the solid line the change in distributed concentration of the carbon atoms (C), the two-dot chain line the change in the distributed concentration of silicon atoms (Si), and the one-dot chain line the change in distributed concentration of hydrogen atoms (H), respectively.

Figure 6:
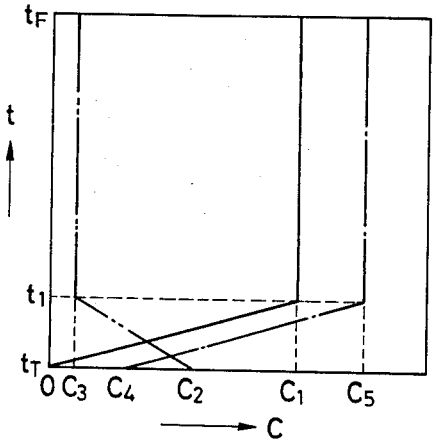
FIGS. 6 to 9 are illustrations showing examples of the distribution states in the layer thickness direction of carbon atoms and hydrogen atoms in the surface layer.

FIG. 6 shows a first typical example of the distributed state in the layer thickness of the atoms (C), silicon atoms (Si), and hydrogen atoms (H) to be contained in the surface layer. In said example, from the interface position $t_T$ to the position $t_1$, the distributed concentration C of the atoms (C) is increased from 0 to the concentration $C_1$ as a first order function, while the distributed concentration of silicon atoms is reduced from the concentration $C_2$ to the concentration $C_3$ as a first order function and the distributed concentration of hydrogen atoms in increased from $C_4$ to $C_5$ as a first order function. From the position $t_l$ to the position $t_F$, the distributed concentration C of the atoms (C) and silicon atoms and hydrogen atoms maintain the constant values of the respective concentrations $C_l$, $C_3$, and $C_5$, respectively. Here, for convenience in explanation, the inflection points of the distributed states of the respective components are all made $t_l$, but there is substantially no trouble if they are deviated from one another.

Figure 7:
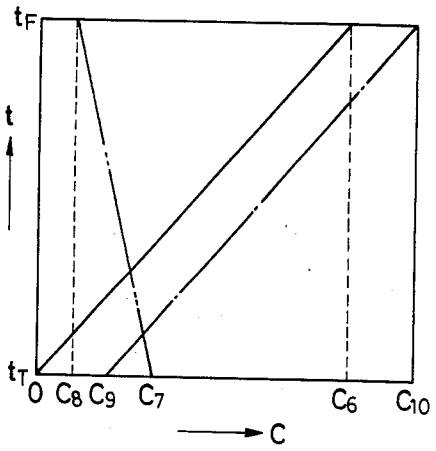

In the example shown in FIG. 7, from the position $t_T$ to the position $t_F$, the carbon atoms (C) are varied from 0 to the concentration $C_6$, the silicon atoms (Si) from $C_7$ to $C_8$, and the hydrogen atoms (H) from $C_9$ to $C_{10}$, respectively, as a first order function. In the case of this example, since the components are varied over the entire region of the surface layer, the troubles caused by discontinuity of the components can be further improved.

Figure 8:
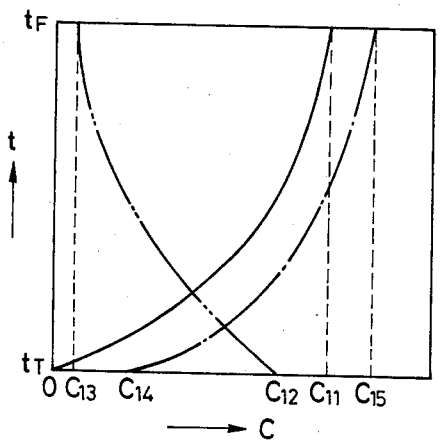
Figure 9:
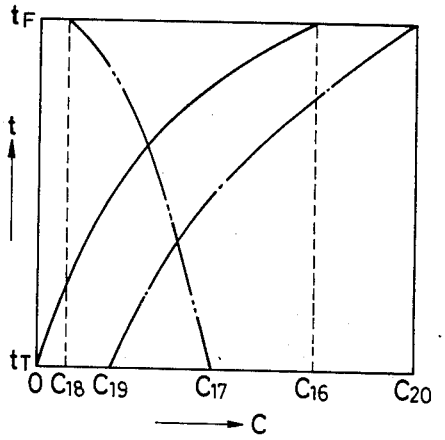

Also, it is possible to use, for example, the patterns in which the change rates of the components are varied from time to time as shown in FIGS. 8 and 9 and a combination of the typical examples as described with reference to FIGS. 6 to 9, which can be selected suitably depending on the desired film characteristics or the conditions in the preparation apparatus, etc. Further, matching in optical band gap Eg opt of the interface may be a substantially sufficient value, and in that sense the carbon content at $t_T$ is not limited to 0, but may also have a finite value, and also stagnation in change of the components in the distributed region for a certain interval may be also permissible from this standpoint.

Formation of the surface layer 104 or 1503 may be practiced according to the glow discharge method, the microwave discharge method, the sputtering method, the ion implantation method, the ion plating method, the electron beam method, etc. These preparation methods may be employed by suitable selection depending on the factors such as preparation conditions, the degree of load of installation investment, preparation scale, the desired characteristics for the light-receiving number for electrophotography to be prepared, but the glow discharge method or the sputtering method may be preferably employed for such advantages as relatively easy control of the preparation conditions for preparing the light-receiving member for electrophotography having desired characterisrics, easy introduction of carbon atoms and hydrogen atoms together with silicon atoms into the surface layer 104 or 1503, etc.

Further, in the present invention, the surface layer 104 or 1503 may be formed by using the glow discharge method and the sputtering method in combination in the same apparatus system.

For formation of the surface layer 104 or 1503 by the glow discharge method, the basic procedure may be the same in the distributed region or the constant region of the constituents, and comprises introducing the starting gases for formation of $A\text{-}(Si_xC_{l-x})_y$: $H_{1-y}$, optionally mixed with a diluting gas at a desired mixing ratio, into a deposition chamber for vacuum deposition in which a substrate 101 or 1501 is placed, and exciting glow discharging of the gases introduced to form a gas plasma, thereby depositin $A(Si_xC_{1-x})_y$: $H_{1-y}$ on the photoconductive layer 103 or 1502 already formed on the above substrate 101 or 1501. Formation of the distributed region can be easily done by setting the components to be changed, for example, flow rates of a carbon atom containing gas, of a silicon atom containing gas, and of a hydrogen atom containing gas, etc., respectively, to a desired distribution pattern from the flow rate on start-up and increasing the flow rates following a specific sequence.

In the present invention, as the starting gases for formation of $A\text{-}(Si_xC_{1-x})_y$: $H_{1-y}$ most of the gaseous substances or gasified gasifiable substances containing at least one of Si, C, and H as the constituent atoms can be used.

When employing a starting material gas containing Si as one of Si, C, and H as the constituent atom, for example, a starting gas containing Si as the constituent atom, a starting material gas containing C as the constituent atom, and a starting gas containing H as the constituent atom may be used by mixing at a desired mixing ratio, or alternatively a starting material gas containing Si as the constituent atom, and a starting gas containing C and H as the constituent atoms may be mixed also at a desired ratio, or a starting gas containing Si as the constituent atom may be used as a mixture with a starting material gas containing the three constituent atoms of Si, C, and H.

Also, it is possible to use a mixture of a starting material gas containing Si and H as the constituent aoms with a starting material gas containing C as the constituent atom. Also, in the distributed region, the above mixing ratio may be varied following a predetermined sequence.

The substance effectively used as the starting materials for formation of the surface layer 104 or 1503 in the present invention may include hydrogenated silicon hydride gases constituted of silicon atoms (Si) and hydrogen atoms (H) such as silane, as exemplified by $SiH_4$, $Si_2H_6$, $Si_3H_8$, $Si_4H_{10}$, etc., hydrocarbons constituted of C and H such as saturated hydrocarbons having 1 to 4 carbon atoms, ethylenic hydrocarbons having 2 to 4 carbon atoms or acetylenic hydrocarbons having 2 to 3 carbon atoms.

More specifically, typical examples are saturated hydrocarbons such as methane ($CH_4$), ethane ($C_2H_6$) propane ($C_3H_8$), n-butane (n-$C_4H_{10}$), pentane ($C_5H_{12}$), and the like; ethylenic hydrocarbons such as ethylene ($C_2H_4$), propylene ($C_3H_6$), butene-1 ($C_4H_8$), butene-2 ($C_4H_8$), isobutylene ($C_4H_8$), pentene ($C_5H_{10}$), and the like; and acetylenic hydrocarbons such as acetylene ($C_2H_2$), methylacetylene ($C_3H_4$), butyne ($C_4H_6$), and the like.

Typical examples of the starting gas having Si, C, and H as constituent atoms are alkyl silanes such as $Si(CH_3)_4$, Si $(C_2H_5)_4$, and the like. In addition to these starting gases, $H_2$ can of course be effectively used as the starting gas for introduction of hydrogen atoms (H).

For formation of the surface layer 104 or 1503 by the sputtering method, a single crystalline or polycrystalline Si wafer or C wafer or a wafer containing Si and C mixed therein is used as a target and subjected to sputtering in an atmosphere of various gases.

For example, when Si wafer is used as target, a starting gas for introduction of C and H, which may be diluted with a diluting gas, if desired, is introduced into a deposition chamber for sputter to form a gas plasma of these gases therein and effect sputtering of said Si wafer. The distributed region in this case may be formed by, for example, varying the concentration of the starting material gas containing C following a certain sequence.

Alternatively, Si and C as separate targets or one sheet target of a mixture of Si and C can be used and sputtering is effected in a gas atmosphere containing at least hydrogen atoms. The distributed region in this case is required to be formed by using a gas containing either one of C or Si in combination and varying these gas concentrations following a certain sequence.

As the starting gas for introduction of C or H, there may be employed those as mentioned in the glow discharge method as described above as effective gases also in the case of sputtering.

In the present invention, as the diluting gas to be employed in forming the surface layer 104 or 1503 according to the glow discharge method or the sputtering method, there may be included so called rare gases such as He, Ne or Ar as suitable ones.

The surface layer 104 or 1503 in the present invention is formed carefully so that it may have a distributed region along the spirit of the present invention as described above and the characteristics required from the view point of entire layers may be given exactly as desired.

That is, a substance constituted of Si, C and H, can take various forms from crystalline to amorphous, electrical properties from conductive through semiconductive to insulating, and photoconductive properties from photoconductive to nonphotoconductive depending on the preparation conductions. In the present invention, the preparation conditions are severely selected as desired so that there may be formed A-$Si_xC_{1-x}$ having desired characteristics depending on the purposes.

For example, for providing the surface layer 104 or 1503 primarily for the purpose of improving dielectric strength, A-$(Si_xC_{1-x})_y$:$H_{1-y}$ is arranged as an amorphous material with remarkable electrical insulating behaviors in the use environment.

On the other hand, when the surface layer 104 or 1503 is provided primarily for the purpose of improving continuous repeated use characteristics or use environmental characteristics, the degree of the above electrical insulating property is alleviated to some extent and A-$(Si_xC_{1-x})_y$ :$H_{1-y}$ is arranged as an amorphous material having some sensitivity to the light irradiated.

During formation of the surface layer 104 or 1503 comprising A-$(Si_xC_{1-x})_y$:$H_{1-y}$ on the surface of the photoconductive layer 103 or 1502, the substrate temperature during layer formation is an important factor which influences the structure and the characteristic of the layer to be formed and, in the present invention, the substrate temperature during layer formation should desirably be controlled strictly so that A-$(Si_xC_{1-x})_y$:$H_{1-y}$ having desired characteristics may be prepared as desired.

As the substrate temperature during formation of the surface layer 104 or 1503 accomplishing effectively the object in the present invention, a suitable optimal range corresponding to the formation method of the surface layer 104 or 1503 may be selected to practice formation of the surface layer 104 or 1503, but is may be preferably 50° C. to 350° C., more preferably 100° C. to 300° C. For formation of the surface layer 104 or 1503, it is advantageous to employ the glow discharge method or the sputtering method for such reasons as relatively easier severe control of the composition ratio of the atoms constituting the layer or the control of layer thickness as compared with other methods. For formation of the surface layer 104 or 1503 according to these layer forming methods, the discharging power or the gas pressure during layer formation is one of important factors influencing the characteristics of A-$(Si_xC_{1-x})_y$:$H_{1-y}$ prepared.

The discharging power condition for preparing effectively A-$(Si_xC_{1-x})_y$:$H_{1-y}$ having the characteristics for accomplishing the objects in the present invention with good productivity may be preferably 10 to 1000 W, more preferably 20 to 500 W. The gas pressure in the deposition in chamber may be preferably 0.01 to 1 Torr, more preferably 0.1 to 0.5 Torr.

In the present invention, the desirable numerical value ranges for the substrate temperature and discharging power during formation of the surface layer 104 or 1503 may be those as mentioned above, but these layer formation factors are not determined independently and separately, but it is desirable that the optimum values of the respective layer formation factors are desirably determined based on the mutual organic relationship so that the surface layer 104 or 1503 comprising A-$(Si_xC_{1-x})_y$:$H_{1-y}$ having desired characteristics may be formed.

The amounts of carbon atoms and hydrogen atoms contained in the surface layer 104 or 1503 in the light-receiving member for electrophotography of the present invention are also important factors for forming the surface layer 104 or 1503 having the desired characteristics to accomplish the objects of the present invention similarly as the preparation conditions of the surface layer 104 or 1503.

The amount of the carbon atoms contained in the surface layer 104 or 1503 in the present invention should be desirably varied in the distributed region preferably from $1\times10^{-4}$ to 90 atomic %, more preferably $1\times10^{-4}$ to 85 atomic %, optimally from $1\times10^{-4}$ to 80 atomic % based on the total amounts of silicon atoms and carbon atoms, and also should desirably in the constant region preferably $1\times10^{-3}$ to 90 atomic %, more preferably 1 to 90 atomic %, optimally 10 to 80 atomic %. The content of hydrogen atoms should be desirably made constant or varied in the distributed region within the range from 1 to 70 atomic % based on the total amount of the constituent atoms, and also should be desirably made in the constant region or at least on the outermost surface of the surface layer preferably 41 to 70 atomic %, more preferably 45 to 60 atomic %.

The light-receiving member having the surface layer prepared under the quantitative range as specified above and the above distributed state and further the above preparation conditions can be applied sufficiently as the material which is extremely excellent as not found in the prior art in practical aspect.

Referring to several examples, its action is described.

To describe about the aspect of matching in band gap, for example, when there exists a clear optical interface between the surface layer and the photoconductive layer as in the case of the prior art, reflection of incident light occurs at said interface, whereby there is observed the phenomenon that the dose of the incident light into the photoconductive layer may be more or less influenced by the interference between this reflection at said interface and the refletion at the free surface. Particularly, when coherent light such as laser beam is used as the light source, this tendency is marked. On the other hand, in the case of a copying machine using, for example, the blade cleaning method, the surface layer will be inevitably more or less abraded by prolonged use, and the film thickness change of the surface layer by this abrasion will cause a change in the above interference state. That is, there is observed the phenomenon that the dose of incident light into the photoconductive layer will be more or less influenced by the abrasion. Controlling band gap to match in the present invention has one aspect of bringing about the effect of minimizing reflection at the above interface from the aspect of continuity of the components, and also separately imparts continuity to light absorption itself by changing the band gap, thus giving rise to double preferable actions. Accordingly, the action which should be specially mentioned in this case may be said to be the outstanding effect concerning particularly maintenance of the characteristics during prolonged use among the preferable electrophotographic various characteristics as already described.

Next, the role of hydrogen in the surface layer is described. The defects existing within the surface layer (primarily dangling bonds of silicon atoms or carbon atoms) have been known to exert bad influences on the characteristics as the light-receiving member for electrophotography. For example, there may be caused deteriorat-on of charging characteristics by injection of charges from the free surface, fluctuation in charging characteristics due to change in the surface structure under the use environment such as high humidity, and further residual image phenomenon during repeated use by injection of charges from the photoconductive layer to the surface layer during corona charging or light irradiation and trapping of the charges by the defects within the surface layer as mentioned above.

However, by controlling the hydrogen content within the surface layer in at least the outermost surface region to 41 atomic % or higher, all of the above problems can be cancelled, and particularly a dramatic improvement can be effected in the electrical characteristics and high speed continuous use characteristic as compared with the prior art product.

On the other hand, if the hydrogen content in the above surface becomes 71 atomic % or higher, the hardness of the surface layer will be lowered, whereby the light-receiving member cannot stand repeated uses. Therefore, it is one of very important factors in obtaining extremely excellent desired electrophotographic characteristics to control the hydrogen content in the surface layer within the range as specified above. The hydrogen content in the surface layer can be controlled by the flow rate of $H_2$ gas, the substrate temperature, the discharging power, the gas pressure, etc.

There is also a specific relationship between the above matching in the optical band gap Eg opt and the hydrogen atoms (containing state.) Particularly, in the distributed region of carbon atoms (C) which is the representative change component of the optical band gap Eg opt, the hydrogen containing state is such that its content is set so as to optimize the structure in that region or/and minimize dangling bonds, and also so as to become the value necessary for effecting the action as described in the role of hydrogen in the above surface layer. In other words, it is set in the most natural form to make the content of hydrogen atoms increased toward at least the free surface side.

Thus, the hydrogen atoms containing state in the surface layer in the present invention can be also said to have another action of taking matching between the following both actions so that the action of matching in the optical band gap Eg opt and the action by the hydrogen atoms content itself may be both exhibited to full extent.

The numerical range of the layer thickness in the present invention is one of the important factors for accomplishing effectively the objects of the present invention.

The numerical range of the layer thickness of the surface layer 104 or 1503 in the present invention may be determined suitably as desired depending on the initial purpose so that the objects of the present invention can be effcctively accomplished.

Also, the layer thickness of the surface layer 104 or 1503 is required to be determined suitably in relationship with the layer thickness of the photoconductive layer 103 or 1502, as desired under the organic relationship corresponding to the characteristics demanded for the respective layer regions. Further, in addition, it is desirably determined in view of economical considerations including productivity or bulk productivity.

The layer thickness of the surface layer 104 or 1503 in the present invention should be desirably be made generally 0.003 to 30 $\mu$, preferably 0.004 to 20 $\mu$, optimally 0.005 to 10$\mu$.

The layer thickness of the light-receiving layer of the light-receiving member 100 for electrophotography in the present invention may be determined suitably as desired as fitted for the purpose.

In the present invention, the layer thickness of the light-receiving layer 102 or 1500 may be determined suitably as desired in the layer thickness relationship between the photoconductive layer 103 or 1502 and the surface layer 104 or 1503 so that the characteristics imparted to the photoconductive layer 103 or 1502 and the surface layer 104 or 1503 constituting the light-receiving layer 102 or 1500 can be effectively utilized respectively to accomplish effectively the objects of the present invention, and it is preferable that the layer thickness of the photoconductive layer 103 or 1502 should be made some hundred to some thousand-fold or more relative to the layer thickness of the surface layer 104 or 1503.

In the light-receiving member for electrophotography of the present invention, for further improvement of adhesion between the substrate 101 or 1501 and the photoconductive layer 103 or 1502, there may be also provided an adhesion layer constituted of, for example, amorphous materials containing at least one of $Si_3N_4$, $Si0_2$, SiO, hydrogen atoms, and halogen atoms and at least one of nitrogen atoms, oxygen atoms, and carbon atoms and silicon atoms, etc.

Figure 1B:
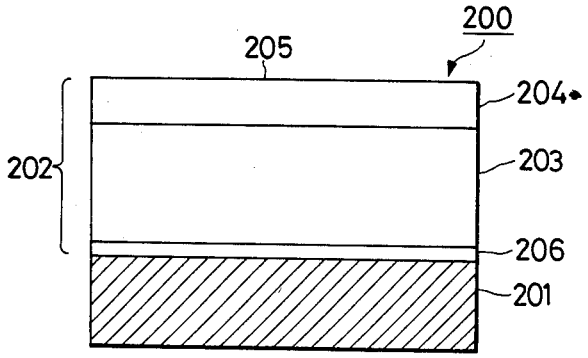

FIG. 1B shows an example of the light-receiving member for electrophotography having such a layer constitution.

The light-receiving member for electrophotography 200 shown in FIG. 1B has the same layer constitution as the light-receiving layer for electrophotography 100 shown in FIG. 1A except for having an adhesion layer 206. That is, on the adhesion layer 206 are provided successively the photoconductive layer 203 and the surface layer 204, and the photoconductive layer 203 is constituted of the same material and has the same function as the photoconductive layer 103, and also the surface layer 204 as the surface layer 104.

Adhesion layer

The adhesion layer of the light-receiving member for electrophotography in the present invention is constituted of an amorphous or polycrystalline material containing at least one of nitrogen atoms, oxygen atoms and carbon atoms, silicon atoms and optionally at least one of hydrogen atoms and halogen atoms. Further, the above adhesion layer 206 may also contain a substance for controlling conductivity (valence electron controller) as the constituent atom.

That is, the primary object of said adhesion layer is to improve adhesion between the substrate and the photoconductive layer. Also, by containing a substance for controlling conductivity in said layer, the transport of charges between the substrate and the photoconductive layer can be effected more efficiently.

Nitrogen atoms, oxygen atoms, carbon atoms, hydrogen atoms, halogen atoms and the substance for controlling conductivity may be contained either uniformly throughout said layer or under nonuniform distribution state in the layer thickness direction.

The amount of carbon atoms, oxygen atoms or nitrogen atoms contained in the adhesion layer formed in the present invention or the combined amount of at least two of them must be determined suitably as desired, but it may preferably be 0.0005 to 70 atomic %, more preferably 0.001 to 50 atomic %, optimally 0.002 to 30 atomic %.

The layer thickness of the adhesion layer 206 may be determined suitably in view of adhesion property, transport efficiency of charge, production efficienty, but it may preferably be 0.01 to 10 μm, more preferably 0.02 to 5 μm.

The amount of hydrogen atoms, the amount of halogen atoms or the sum of the amounts of hydrogen atoms and halogen atoms contained in the adhesion layer may preferably be 0.1 to 70 atomic %, more preferably 0.5 to 50 atomic %, optimally 1.0 to 30 atomic %.

Figure 1C:
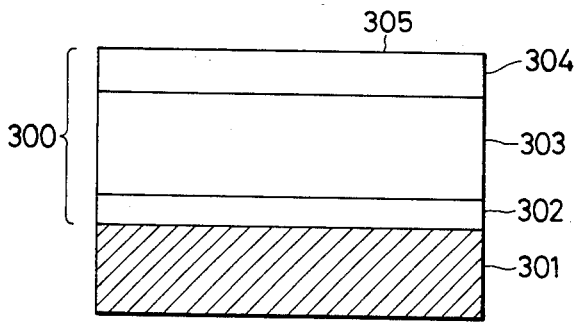
Figure 1D:
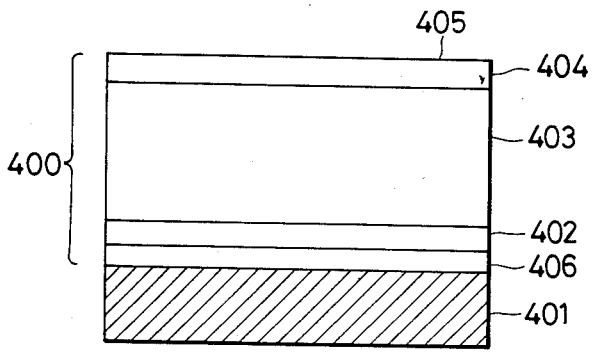

FIG. 1C and FIG. 1D illustrate schematically layer constitutions of the third preferred embodiment and the fourth preferred embodiment, respectively, of the light-receiving member for electrophotography of the present invention.

The light-receiving member for electrophotography shown in FIG. 1C and FIG. 1D has a light-receiving layer 300, 400 on a substrate 301, 401 for light-receiving member, said light-receiving layer 300, 400 having a layer constitution, comprising a charge injection preventive layer 302, 402, a photoconductive layer 303, 403 having photoconductivity and a surface layer 304, 404. Also, 406 represents an adhesion layer.

The photoconductive layers 303, 403, the surface layers 304, 404, the adhesion layer 404 in FIGS. 1C and 1D are respectively the same as the photoconductive layers 103, 203, the surface layers 104, 204 and the adhesion layer 206 shown in FIGS. 1A and 1B, and therefore description of these layers is omitted.

The charge injection preventive layers 302, 402 newly added in the light-receiving member for electrophotography shown in FIGS. 1C and 1D are described in detail below.

Charge Injection Preventive Layer

The charge injection preventive layer 302, 402 in the present invention is constituted of A-Si (H, X) or polycrystalline silicon and contains a substance for controlling conductivity (valence electron controller) uniformly throughout the whole layer region or preferably nonuniformly as enriched on the substrate side in said layer 302, 402. Further, if necessary, oxygen atoms or/and nitrogen atoms or/and carbon atoms may be contained uniformly throughout the whole layer region or a partial layer region of said layer 102 or preferably nonuniformly as enriched on the substrate side, whereby improvement of adhesion between the charge injection preventive layer 102 and the substrate and control of band gap can be effected.

As the substance for controlling conductivity to be contained in the charge injection preventive layer 302, 402, there may be mentioned so called impurities in the field of semiconductors similarly as in above description of photoconductive layer. In the present invention, there may be employed the atoms belonging to the group III of the periodic table giving p-type conductivity characteristics (the group III atoms) or the atoms belonging to the group V atoms of the periodic table giving n-type conductivity characteristics (the group V atoms).

FIGS. 10 through 14 show typical examples of distributed states in the layer thickness direction of the group III atoms or the group V atoms contained in the charge injection preventive layer 302, 402. In FIGS. 10 through 14, the axis of abscissa indictes the distributed concentration C of the group III atoms or the group V atoms, and the axis of ordinate the layer thickness t of the charge injection preventive layer 302, 402 $t_B$ showing the interface position on the substrate 301, 401 side, $t_T$ the interface position on the side opposite to the substrate 301, 401 side. That is, the charge injection preventive layer is formed from the $t_B$ side toward the $t_T$ side.

Figure 10:
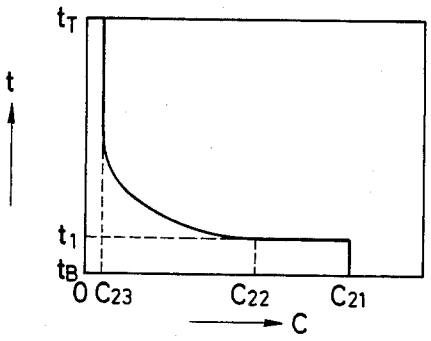
FIGS. 10 to 14 are illustrations showing examples of the distribution states in the layer thickness direction of the group III atoms and the group V atoms of the periodic table in the charge injection preventive layer.

FIG. 10 shows a first typical example of the distributed state in the layer thickness direction of the group III atoms or the group V atoms contained in the charge injection preventive layer 302, 402.

In the example shown in FIG. 10, from the interface position $t_B$ to the position $t_1$, the group III atoms or the group V atoms are contained with the concentration C taking a constant value of $C_1$, and the distributed concentration C being reduced from $C_{22}$ gradually and continuously from the position $t_1$ to the interface position $t_T$. At the interface position $t_T$, the distributed concentration is made $C_{23}$.

Figure 11:
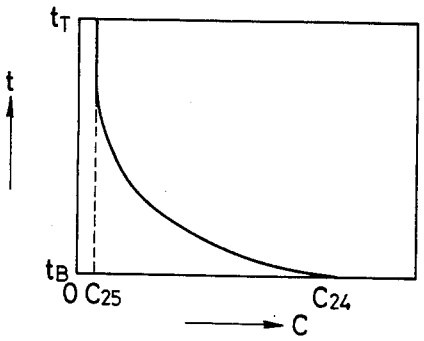

In the example shown in FIG. 11, the distributed concentration C of the group III atoms or the group V atoms contained is reduced from $C_{24}$ gradually and continuously from the position $t_B$ to the position $t_T$, until it becomes $C_{25}$ at the position $t_T$.

Figure 12:
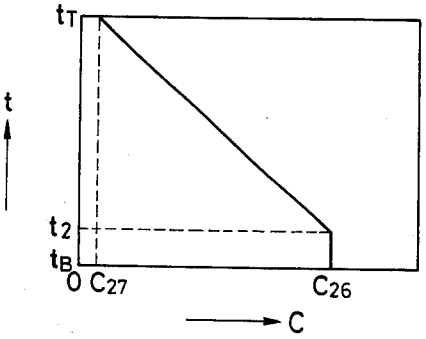

In the example shown in FIG. 12, the distributed concentration C of the group III atoms or the group V atoms is a constant value of $C_{26}$ between the position $t_B$ and the position $t_2$ and made $C_{27}$ at the position $t_T$.

Between the position $t_2$ and the position $t_T$, the distributed concentration C is reduced as a first order function from the position $t_2$ to the position $t_T$.

Figure 13:
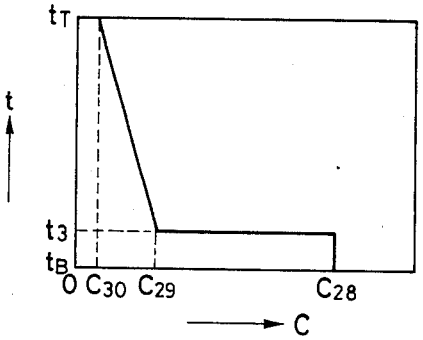

In the example shown in FIG. 13, the distributed concentration C takes a constant value of $C_{28}$ from the position $t_B$ to the position $t_3$, and is reduced from $C_{29}$ to $C_{30}$ as a first order function from the position $t_3$ to the position $t_T$.

Figure 14:
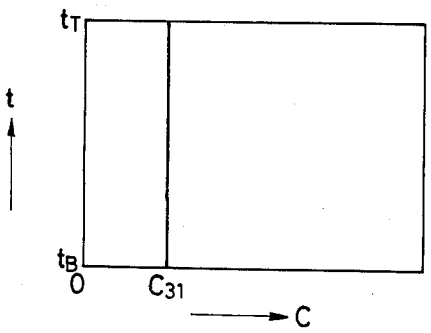

In the example shown in FIG. 14, the distributed concentration C takes a constant value of $C_{31}$ from the position $t_B$ to the position $t_T$.

In the present invention, when the charge injection preventive layer 302, 402 contains the group III atoms or the group V atoms in the distribution state where they are enriched on the substrate side, it is preferable that the layer should be formed to a distribution state such that the maximum value of the distributed concentration value of the group III atoms or the group V atoms may be 50 atomic ppm or more, more preferably 80 atomic ppm or more, optimally 100 atomic ppm or more.

In the present invention, the content of the group III atoms or the group V atoms in the charge injection preventive layer 302, 402 may be determined suitably as desired so as to accomplish effectively the objects of the present invention, but preferably 30 to $5\times10^4$ atomic ppm, more preferably 50 to $1\times10^4$ atomic ppm, optimally $1\times10^2$ to $5\times10^3$ atomic ppm.

The charge injection preventive layer 302, 402 has the effect of primarily improving adhesion between the substrate 301, 401 and the charge injection preventive layer 302, 402, improving adhesion between the charge injection preventive layer 302, 402 and the photoconductive layer 303, 403 or controlling the band gap Egopt of the charge injection preventive layer 302, 402 by containment of oxygen atoms or/and nitrogen atoms or/and carbon atoms as mentioned above.

FIGS. 15 through 21 show typical examples of distribution states in the layer thickness direction of oxygen atoms or/and nitrogen atoms or/and carbon atoms to be contained in the charge injection preventive layer 302, 402. In the examples shown in FIGS. 15 through 21, the axis of abscissa indicates the distributed concentration C of oxygen atoms or/and nitrogen atoms or/and carbon atoms, and the axis of ordinate the layer thickness t of the charge injection preventive layer 302, 402, $t_B$ showing the interface position on the substrate side and the $t_T$ the interface position on the side opposite to the substrate side. That is, the charge injection preventive layer is formed from the $t_B$ side toward the $t_T$ side.

Figure 15:
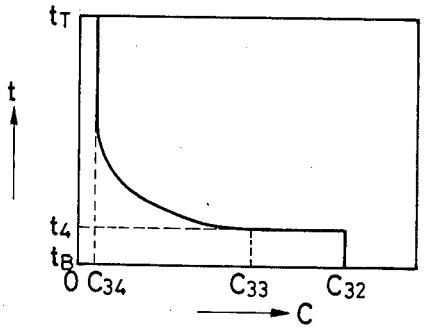
FIGS. 15 to 21 are illustrations showing examples of the distribution states in the layer thickness direction of oxygen atoms and/or nitrogen atoms and/or carbon atoms in the charge injection preventive layer.

In FIG. 15, there is shown a first typical example in which the distribution state in the layer thickness direction of oxygen atoms or/and nitrogen atoms or/and carbon atoms contained in the charge injection preventive layer 302, 402.

In the example shown in FIG. 15, from the interface position $t_B$ to the position $t_4$, oxygen atoms or/and nitrogen atoms or/and carbon atoms are contained while the concentration C taking a constant value of $C_{32}$, and the distributed concentration C is gradually and continuously reduced from $C_{33}$ from the position $t_4$ to the interface position $t_T$. At the interface position $t_T$, the distributed concentration is made $C_{34}$.

Figure 16:
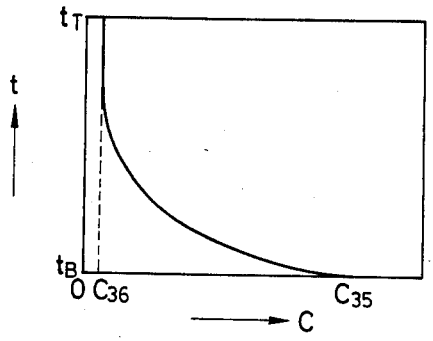

In the example shown in FIG. 16, the distributed concentration C of oxygen atoms or/and nitrogen atoms or/and carbon atoms contained is reduced gradually and continuously from $C_{35}$ from the position $t_B$ to the position $t_T$, and at the position $t_T$ the concentration becomes $C_{36}$.

Figure 17:
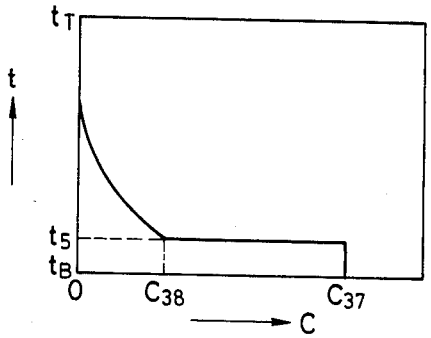

In the case of FIG. 17, the distributed concentration C of oxygen atoms or/and nitrogen atoms or/and carbon atoms is made a constant value $C_{37}$ from the position $t_B$ to the position $t_5$, and reduced gradually and continuously from $C_{38}$ between the position $t_5$ and the position $t_T$, until it is made substantially zero at the position $t_T$.

Figure 18:
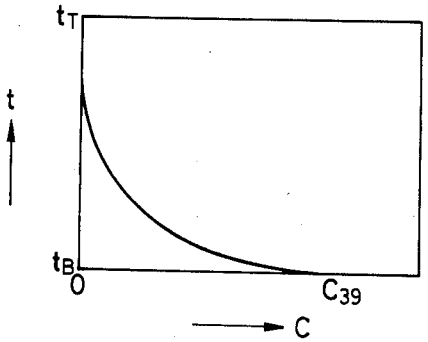

In the case of FIG. 18, the distributed concentration C of oxygen atoms or/and nitrogen atoms or/and carbon atoms is reduced gradually and continuously from $C_{39}$ from the position $t_B$ to the position $t_T$, until it is made substantially zero at the position $t_T$.

Figure 19:
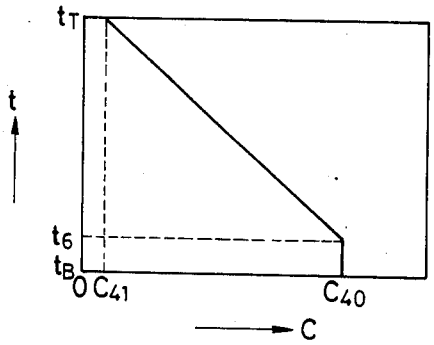

In the example shown in FIG. 19, the distributed concentration C of oxygen atoms or/and nitrogen atoms or/and carbon atoms takes a constant value of $C_{40}$ from the position $t_B$ to the position $t_6$, and reduced as a first order function from $C_{40}$ to $C_{41}$ from the position $t_6$ to the position $t_T$.

Figure 20:
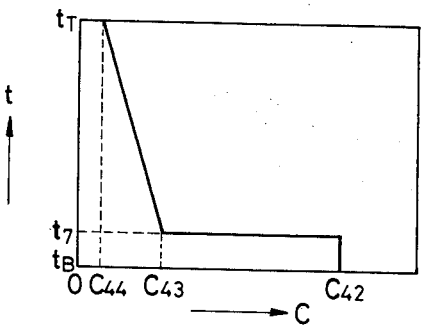
Figure 21:
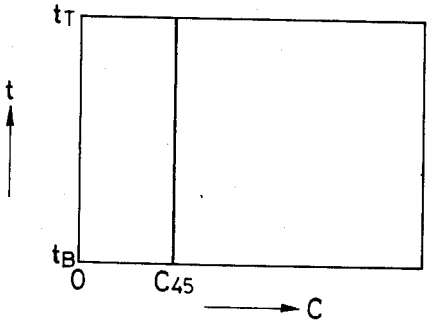

In the example shown in FIG. 20, the distributed concentration C of oxygen atoms or/and nitrogen atoms or/and carbon atoms is a constant value of $C_{42}$ between the position $t_B$ and the position $t_7$, and made $C_{44}$ at the position $t_T$. Between the position $t_6$ and the position $t_T$, the distributed concentration C is reduced as a first order concentration from $C_{43}$ at the position $t_6$ to $C_{44}$ at the position $t_T$ In the example shown in FIG. 21, the distributed concentration takes a constant value of $C_{45}$from the position $t_B$ to the position $t_T$.

In the present invention, when the charge injection preventive layer 302, 402 contains oxygen atoms or/and nitrogen atoms or/and carbon atoms in a distribution state as enriched on the substrate 301, 401 side, it is preferable that the maximum value of the distribution concentration value of oxygen atoms or/and nitrogen atoms or/and carbon atoms or the sum of those of two kinds among them should be 500 atomic ppm or more, preferably 800 ppm or more, optimally 1000 atomic ppm or more.

In the present invention, the content of oxygen atoms or/and nitrogen atoms or/and carbon atoms or the sum of those of two kinds among them contained in the charge injection preventive layer 302, 402 may be determined suitably as desired so as the accomplish effectively the objects of the present invention, but may be preferably 0.001 to 50 atomic %, more preferably 0.002 to 40 atomic %, optimally 0.003 to 30 atomic %.

In the present invention, the layer thickness of the charge injection preventive layer may be preferably 0.01 to 10 μ, more preferably 0.05 to 8 μ, optimally 0.1 to 5 μ, for obtaining desired electrophotographic characteristics and also from the standpoint of economy.

In the present invention, halogen atoms (X) contained in the charge injection preventive layer 302, 402 may preferably be F, Cl, Br, I, particularly F, Cl.

In the present invention, for formation of a charge injection preventive layer constituted of a polycrystalline silicon or A-Si(H,X), for example, there may be employed the vacuum deposition method utilizing discharging phenomenon such as the glow discharge method, the microwave discharge method, the sputtering method or the ion plating method. For example, for formation of a layer constituted of a polycrystalline silicon or A-Si(H,X), the basic procedure comprises introducing a starting gas for Si capable of supplying silicon atoms (Si) together with a starting gas for introduction of hydrogen atoms (H) or/and a starting gas for introduction of halogen atoms (X) into a deposition chamber which can be brought to a reduced pressure to excite glow discharging within said deposition chamber and form a layer comprising a polycrystalline silicon or a layer comprising A-Si(H,X) on the surface of a predetermined substrate which is previously placed at a predetermined position. On the other hand, for formation according to the sputtering method, for example, when sputtering a target constituted of Si in an atmosphere of an inert gas such as Ar, He, etc., or a gas mixture based on these gases, the gas for introduction of hydrogen atoms (H) or/and halogen atoms (X) may be introduced into the deposition chamber for sputtering.

The substance which can be the starting material gas for Si supply to be used in the present invention may include gaseous or gasifiable hydrogenated silicon (silanes) such as $SiH_4$, $Si_2H_6$, $Si_3H_8$, $Si_4H_{10}$ and the like as effective ones, particularly preferably $SiH_4$, $Si_2H_6$ for easiness in handling during layer formation working, good Si supply efficiency, etc.

As the effective starting gas for incorporation of halogen atoms to be used in the present invention, there may be mentioned a number of halogen compounds such as halogen gases, halides, interhalogen compounds and silane derivatives substituted with halogens which are gaseous or gasifiable.

Further, it is also effective in the present invention to use a gaseous or gasifiable silicon compound containing halogen atoms which is constituted of both silicon atoms and halogen atoms.

Typical examples of halogen compounds preferably used in the present invention may include halogen gases such as of fluorine, chlorine, bromine or iodine and interhalogen compounds such as BrF, ClF, $ClF_3$, $BrF_5$, $BrF_3$, $IF_3$, $IF_7$, ICl, IBr, etc.

As the silicon compound containing halogen atom, namely the so-called silane derivatives substituted with halogen atoms, silicon halides such as $SiF_4$, $Si_2F_6$, $SiCl_4$, $SiBr_4$, or the like are preferred.

When the specific photoconductive member of this invention is formed according to the glow discharge method by use of such a silicon compound containing halogen atoms, it is possible to form a layer constituted of a polycrystalline silicon or A-Si:H containing halogen atoms on a desired substrate without use of a hydrogenated silicon gas as the starting gas capable of supplying Si.

In the case of preparing a layer containing halogen atoms according to the glow discharge method, the basic procedure comprises introducing a silicon halide as the starting material gas for Si supply together with a gas such as Ar, $H_2$, He, etc. at a predetermined mixing ratio and gas flow rates into a deposition chamber for formation of a desired layer, and exciting glow discharge to form a plasma atmosphere of these gases, whereby a desired layer can be formed on a desired substrate. For effecting introduction of hydrogen atoms, a gas of a silicon compound containing hydrogen atoms may be further mixed into these gases in a desired amount for layer formation.

The respective gases used are not limited only to single species, but a plural number of gas species may be used at a desired mixing ratio.

For formation of a layer comprising polycrystalline silicon or A-Si(H,X) by the reactive sputtering method or the ion-plating method, for example, a target of Si is used and sputtering is effected thereon in a suitable gas plasma atmosphere in the case of the sputtering method. Alternatively, in the case of ion-plating method, a polycrystalline or single crystalline silicon is placed as vaporization source in a vapor deposition boat, and the silicon vaporization source is vaporized by heating by resistance heating method, electron beam method (EB method) or the like thereby to permit vaporized flying substances to pass through a suitable gas plasma atmosphere.

During this procedure, in either of the sputtering method or the ion-plating method, for introduction of halogen atoms into the layer formed, a gas of a halogen compound as mentioned above or a silicon compound containing halogen as mentioned above may be introduced into the deposition chamber to form a plasma atmosphere of said gas therein.

When hydrogen atoms are to be introduced, a starting gas for introduction of hydrogen atoms such as $H_2$ and a gas such as silanes as mentioned above may be introduced into the deposition chamber for sputtering, followed by formation of a plasma atmosphere of said gases.

In the present invention, as the starting gas for introduction of halogen atoms, the halogen compounds or silicon compounds containing halogens as mentioned above can effectively be used. In addition, it is also possible to use a gaseous or gasifiable halide containing hydrogen atom as one of the constituents such as hydrogen halide, including HF, HCl, HBr, HI and the like or halo-substituted hydrogenated silicon, including $SiH_2F_2$, $SiH_2I_2$, $SiH_2Cl_2$, $SiHCl_3$, $SiH_2Br_2$, $SiHBr_3$ and the like as an effective starting material for formation of a charge injection preventive layer and a photoconductive layer.

These halides containing hydrogen atom, which can introduce hydrogen atoms very effective for controlling electrical or optical characteristics into the layer during formation of the layer simultaneously with introduction of halogen atoms, can preferably be used as the starting material for introduction of halogen atoms.

For incorporation of hydrogen atoms structurally into the layer formed, in addition to those as mentioned above, $H_2$ or a gas of hydrogenated silicon, including $SiH_4$, $Si_2H_6$, $Si_3H_8$, $Si_4H_{10}$ and so on may be permitted to be co-present with a silicon compound for supplying Si in a deposition chamber, wherein discharging is excited.

For example, in the case of the reaction sputtering method, a Si target is used and a gas for introduction of halogen atoms and $H_2$ gas are introduced together with, if necessary, an inert gas such as He, Ar, etc. into a deposition chamber, wherein a plasma atmosphere is formed to effect sputtering of said Si target, thereby forming a layer consisting of a polycrystalline silicon or A-Si(H,X) on the substrate.

Further, there may also be introduced a gas such as of $B_2H_6$ or the like in order to effect also doping of impurities.

The amount of hydrogen atoms (H) or halogen atoms (X) incorporated in the charge injection preventive layer 302, 402 in the light-receiving member for electrophotography according to the present invention, or total amount of both of these atoms, may be preferably 1 to 40 atomic %, more preferably 5 to 30 atomic %.

For controlling the amounts of hydrogen atoms (H) and/or halogen atoms (X) in the layer formed, the substrate temperature and/or the amounts of the starting materials for incorporation of hydrogen atoms (H) or halogen atoms (X) to be introduced into the deposition device system or the discharging power may be controlled.

For incorporating the group III atoms or the group V atoms, and the carbon atoms, oxygen atoms or nitrogen atoms in the charge injection preventive layer 302, 402, during formation of the charge injection preventive layer by glow discharge method or sputtering method, the starting material for introduction of the group III atoms or the group V atoms, and the starting material for introduction of oxygen atoms, nitrogen atoms or carbon atoms may be used together with the starting material for formation of the charge injection preventive layer as described above, while controlling their amounts in the layer formed.

As such starting materials for introduction of carbon atoms, oxygen atoms and/or nitrogen atoms, or the starting materials for introduction of the group III atoms or the group V atoms, most of gaseous substances or gasified gasifiable substances containing at least one of carbon atoms, oxygen atoms and nitrogen atoms, or the group III atoms or the group V atoms may be employed.

For example, for incorporating oxygen atoms, a starting gas containing silicon atom (Si) as the constituent atom, a starting gas containing oxygen atoms (O) as the constituent atom and optionally a starting gas containing hydrogen atom (H) and/or halogen atom (X) as the constituent atom may be used as a mixture with a desired mixing ratio. Alternatively, a starting gas containing silicon atom (Si) as the constituent atom and a starting gas containing oxygen atom (O) and hydrogen atom (H) as the constituent atoms may be mixed also at a desired mixing ratio, or a starting gas containing silicon atoms (Si) as the constituent atom and a starting gas containing the three of silicon atom (Si), oxygen atom (O) and hydrogen atom (H) as the constituent atoms may be used as a mixture.

As another method, a gas mixture comprising a starting gas containing silicon atom (Si) and hydrogen atom (H) and a starting gas containing oxygen atom (O) may be also employed.

As the starting gas for introduction of oxygen atoms and nitrogen atoms, there may be included, for example, oxygen ($O_2$), ozone ($O_3$), nitrogen monooxide (NO), nitrogen dioxide ($NO_2$), dinitrogen monoxide ($N_2O$), dinitrogen trioxide ($N_2O_3$), trinitrogen tetraoxide ($N_2O_4$), dinitrogen pentaoxide ($N_2O_5$), nitrogen trioxide ($NO_3$), nitrogen ($N_2$), ammonia ($NH_3$), hydrogen azide ($HN_3$), hydrazine ($NH_2NH_2$). As the compound containing silicon (Si), oxygen (O) and hydrogen atom (H) as the constituent atoms, there may be included lower siloxanes containing, silicon atoms (Si), oxygen atoms (O) and hydrogen atoms (H) such as disiloxane ($H_3SiOSiH_3$), trisiloxane ($H_3SiOSiH_2OSiH_3$) and the like.

As carbon atom containing compounds for the starting material for introduction of carbon atoms, there may be included, for example, saturated hydrocarbons having 1 to 4 carbon atoms, ethylenic hydrocarbons having 2 to 4 carbon atoms, acetylenic hydrocarbons having 2 to 3 carbon atoms, etc.

More specifically, typical examples are saturated hydrocarbons such as methane ($CH_4$), ethane ($C_2H_6$), propane ($C_3H_8$), n-butane (n-$C_4H_{10}$), pentane ($C_5H_{12}$); ethylenic hydrocarbons such as ethylene ($C_2H_4$), propylene ($C_3H_6$), butene-1 ($C_4H_8$), butene-2 ($C_4H_8$), isobutylene ($C_4H_8$), pentene ($C_5H_{10}$); and acetylenic hydrocarbons such as acetylene ($C_2H_2$), methylacetylene ($C_3H_4$), butyne ($C_4H_6$) and the like.

Typical examples of the starting gas having Si, C and H as constituent atoms are alkylsilanes such as $Si(CH_3)_4$, $Si(C_2H_5)_4$ and the like.

When the glow discharge method is used for forming a charge injection preventive layer containing the group III atoms or the group V atoms, the starting materials which become the starting gases for formation of the layer comprise one selected suitably from among the starting materials for formation of the charge injection preventive layer constituted of polycrystaline silicon or A-Si(H,X) as mentioned above and a starting material for introduction of the group III atoms or the group V atoms added thereto. As such starting material for introduction of the group III atoms or the group V atoms may be any of gaseous substances or gasified gasifiable substances containing the group III atoms or the group V atoms as the constituent atom.

Specific examples of such starting materials for introduction of the group III atoms may include those for introduction of boron atoms such as hydrogenated boron, including $B_2H_6$, $B_4H_{10}$, $B_5H_9$, $B_5H_{10}$, $B_6H_{10}$, $B_6H_{12}$, $B_6H_{14}$ and the like, halogenated boron such as $BF_3$, $BCl_2$, $BBr_3$ and the like. Otherwise, $AlCl_3$, $GaCl_3$, $InCl_3$, $TlCl_3$ may be also employed.

The starting material for introduction of the group V atoms which can be effectively used in the present invention may include hydrogenated phosphorus such as $PH_3$, $P_2H_4$ and the like; halogenated phosphorus such as $PH_4I$, $PF_3$, $PF_5$, $PCl_3$, $PCl_5$, $PBr_3$, $PBr_5$, $PI_3$ and the like for introduction of phosphorus atoms. Otherwise, $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$, $BiBr_3$, etc. may be also employed as effective starting materials for introduction of the group V atoms.

The content of the group III atoms or the group V atoms in the charge injection preventive layer containing the group III atoms or the group V atoms can be controlled freely by controlling the gas flow rates, the gas flow rate ratios of the starting materials for introduction of the group III atoms or the group V atoms, the discharging power, the substrate temperature and the pressure in the deposition chamber, etc.

The substrate temperature for the purpose of accomplishing effectively the objects of the present invention should be selected suitably within the optimum range. When a charge injection preventive layer 302, 402 consisting of A-Si(H,X) is formed, it should be generally 50° to 350° C., preferably 100° to 300° C. When a charge injection preventive layer is formed of polycrystalline silicon, it should be generally 200° C. to 700° C., preferably 250° C. to 600° C.

For formation of the charge injection preventive layer in the present invention, it is desirable to employ the glow discharge method or the sputtering method for the reasons such as relatively easier severe control of the composition ratio of the atoms constituting the layer or control of the layer thickness, and in the case of forming a charge injection preventive layer according to these layer forming methods, discharging power or gas pressure during layer formation is also one of important factors influencing the characteristic of the charge injection preventive layer to be prepared similarly as the above substrate temperature.

The discharging power condition for preparing effectively the charge injection preventive layer having the characteristics for accomplished the objects in the present invention with good productivity and efficiency may be generally 1100 to 5000 W, preferably 1500 to 4000 W for the substrate temperature (Ts) of 200° to 350° C. and generally 100 to 5000 W, preferably 200 to 4000 W for the substrate temperature of 350° to 700° C., in the case of forming a charge injection preventive layer constituted of polycrystalline silicon, or generally 10 to 1000 W, preferably 20 to 500 W in the case of forming a charge injection preventive layer constituted of A-Si(H,X). The gas pressure within the deposition chamber may be $10^{-3}$ to 0.8 Torr, preferably $5\times10^{-3}$ to 0.5 Torr in the case of forming a charge injection preventive layer constituted of polycrystalline silicon or 0.01 to 1 Torr, preferably 0.1 to 0.5 Torr in the case of forming a charge injection preventive layer of A-Si(H,X).

In the present invention, the numerical value ranges desirable for the substrate temperature, discharging power for preparing a charge injection preventive layer may be the values within the ranges as mentioned above, but these layer forming factors are not determined independently and separately, but it is desirable that the optimum values for the factors for forming respective layers should be determined based on the mutual organic relationship so that a charge injection preventive layer with desired characteristics may be formed.

Figure 1E:
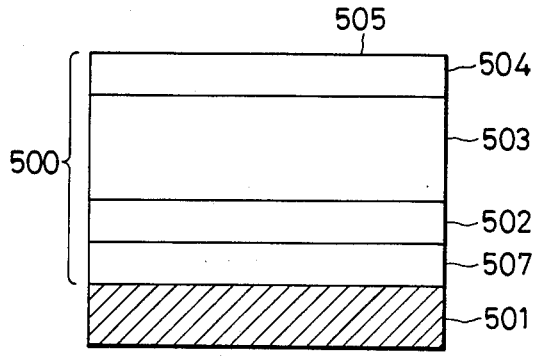
Figure 1F:
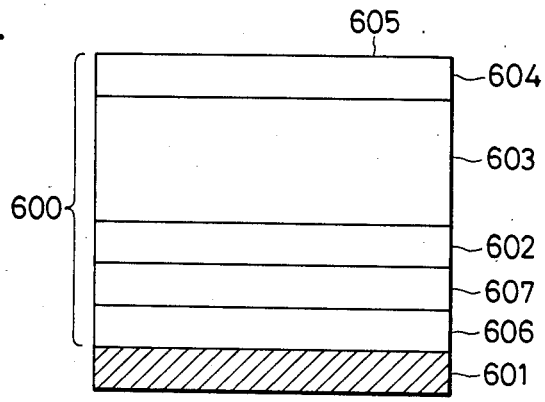

FIG. 1E and FIG. 1F illustrate schematically the fifth and sixth preferred embodiments of the light-receiving member for electrophotography of the present invention.

The light-receiving member for electrophotography shown in FIG. 1E and FIG. 1F has a light-receiving layer 500, 600 on the substrate 501, 601 on the substrate for light-receiving member, said light-receiving layer 500, 600 comprising a longer wavelength light absorbing layer 507, 607, a charge injection preventive layer 502, 602, a photoconductive layer 503, 603 comprising A-Si(H,X) and having photoconductivity, and surface layer 504, 604. 606 shows an adhesion layer.

The light-receiving member 500, 600 shown in FIG. 1E and 1F corresponds to the light-receiving member for electrophotography 300, 400 shown in FIG. 1C, 1D and, except for having a longer wavelength light absorbing layer (IR layer) 507, 607, the lightreceiving member for electrophotography 500 shown in FIG. 1E is entirely the same as the light-receiving member for electrophotography 300 shown in FIG. 1C, and the light-receiving member for electrophotography 600 shown in FIG. 1F as the light-receiving member for electrophotography 400 shown in FIG. 1D.

Accordingly, description except for the longer wavelength light absorbing layer 507, 607 is omitted below.

Longer Wavelength Absorbing Layer

The longer wavelength absorbing layer 507,607 in the present invention is constituted of an inorganic material containing silicon atoms and germanium atoms (polycrystalline material or amorphous material), and the germanium atoms contained in said layer may be contained uniformly throughout the layer, or alternatively may be contained throughout the layer but with nonuniform distributed concentration in the layer thickness direction. However, in either case, it is required also for uniformization of the characteristics in the interplanar direction that they should be contained throughout the layer with uniform distribution in the interplanar direction in parallel to the surface of the substrate. That is, the germanium atoms may be contained throughout the layer thickness direction in the longer wavelength absorbing layer 507,607 and in the state enriched toward the above substrate side opposite to the side (the free surface side of the light-receiving layer) where the above substrate is provided, or in the distribution state opposited thereto.

In the light-receiving member of the present invention, the distribution state of germanium atoms contained in the longer wavelength absorbing layer 507,607 as mentioned above should desirably take the distribution state as mentioned above in the layer thickness direction, while a uniform distribution state in the interplanar direction in parallel to the surface of the substrate.

Also, in one preferred embodiment, the distribution state of germanium atoms in the longer wavelength absorbing layer 507,607 is such that germanium atoms are distributed continuously throughout the whole layer region and the distributed concentration C in the layer thickness direction is given a change in which it is reduced from the substrate side toward the charge injection preventive layer, and therefore affinity between the longer wavelength absorbing layer 507,607 and the charge injection preventive layer 502,602 is excellent, and also by making extremely greater the distributed concentration C of germanium atoms at the end portion on the substrate side as described later, the light on the wavelength side which cannot substantially be absorbed by the photoconductive layer 503, 603 can be absorbed substantially completely by the longer wavelength absorbing layer, whereby interference by reflection from the substrate surface can be prevented.

FIGS. 22 through 27 show typical examples when the distribution state in the layer thickness direction of germanium atoms contained in the longer wavelength absorbing layer 507, 607 of the light-receiving member in the present invention is non-uniform.

In FIGS. 22 through 27, the axis of abscissa indicates the distributed concentration C of germanium atoms, and the axis of ordinate the layer thickness of the longer wavelength absorbing layer, $t_B$ showing the position of the end face of the longer wavelength absorbing layer 507, 607 on the substrate side, $t_T$ the position of the end face of the longer wavelength absorbing layer 507, 607 on the opposite side to the substrate side. That is, the longer wavelength absorbing layer containing germanium atoms is formed from the $t_B$ side toward the $t_T$ side.

Figure 22:
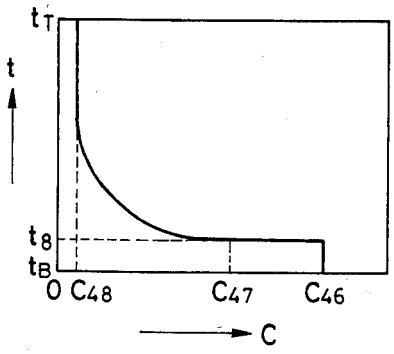
FIGS. 22–27 are illustrations showing examples of the distribution states in the layer thickness direction of germanium atoms in the longer wavelength absorbing layer.

FIG. 22 shows a first typical example of the distribution in the layer thickness direction of germanium atoms contained in the longer wavelength absorbing layer.

In the example shown in FIG. 22, from the interface position $t_B$ where the surface on which the longer wavelength absorbing layer 507, 607 containing germanium atoms is formed contacts the surface of said longer wavelength absorbing layer 507, 607 to the position $t_8$, germanium atoms are contained in the longer wavelength absorbing layer 507, 607 formed while the distributed concentration C of germanium atoms taking a constant value of $C_{46}$, and the concentration is reduced gradually and continuously from the concentration $C_2$ from the position $t_1$ to the interface position $t_T$. At the interface position $t_T$, the distributed concentration C of germanium atoms is made $C_{48}$.

Figure 23:
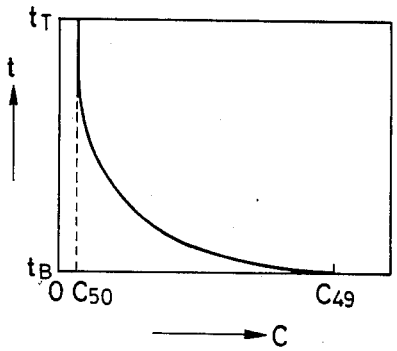

In the example shown in FIG. 23, the distributed concentration C of germanium atoms contained is reduced from the concentration $C_{49}$ gradually and continuously from the position $t_B$ to the position $t_T$, until it becomes the concentration $C_{50}$ at the position $t_T$.

Figure 24:
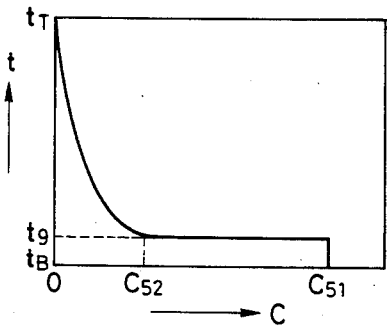

In the case of FIG. 24, the distributed concentration C of germanium atoms is made a constant value of $C_{51}$ from the position $t_B$ to the position $t_9$, and reduced gradually and continuously between the position $t_9$ and the position $t_T$, until the distributed concentration C is made substantially zero at the position $t_T$(here, substantially zero means the case of less than detectable limit of amount).

Figure 25:
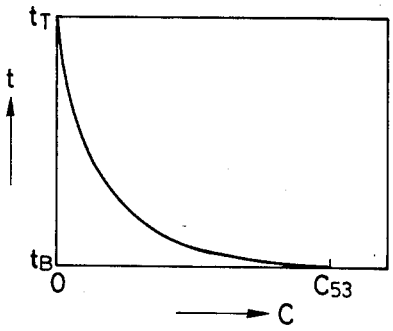

In the case of FIG. 25, the distributed concentration C of germanium atoms is reduced from the concentration $C_{53}$ continuously and gradually from the position $t_B$ to the position $t_T$, until it is made substantially zero at the position $t_T$.

Figure 26:
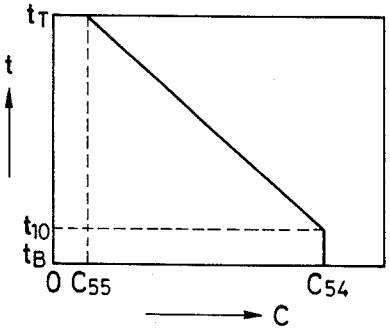

In the example shown in FIG. 26, the distributed concentration C of germanium atoms is constantly a value of $C_{54}$ between the position $t_B$ and the position $t_{10}$, and is made a concentration $C_{55}$ at the position $t_T$. Between the positions $t_{10}$ and $t_T$, the distributed concentration C is reduced as a first order function from the position $t_{10}$ to the position $t_T$.

Figure 27:
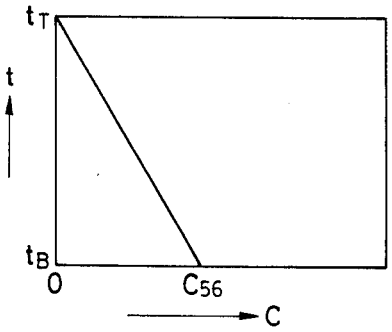
Figure 28:
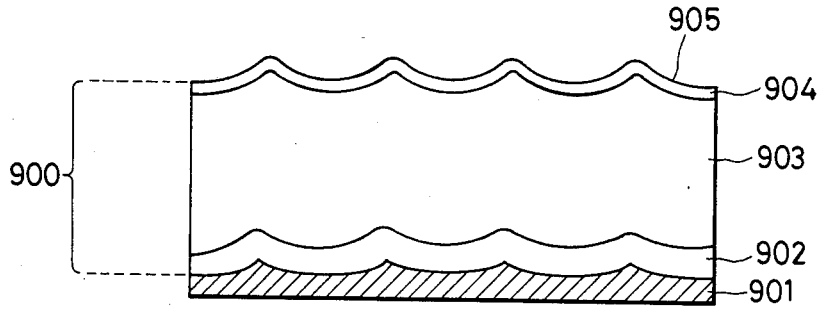
Figure 29:
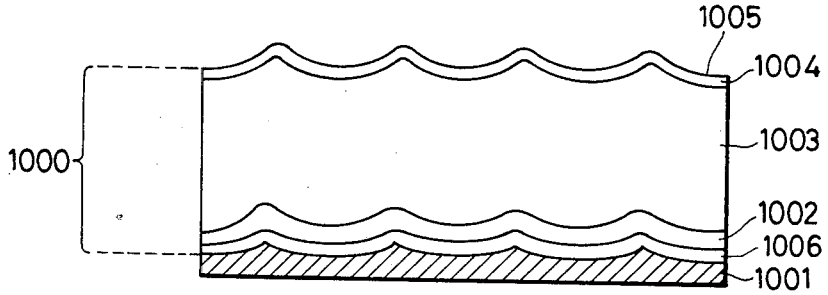
Figure 30:
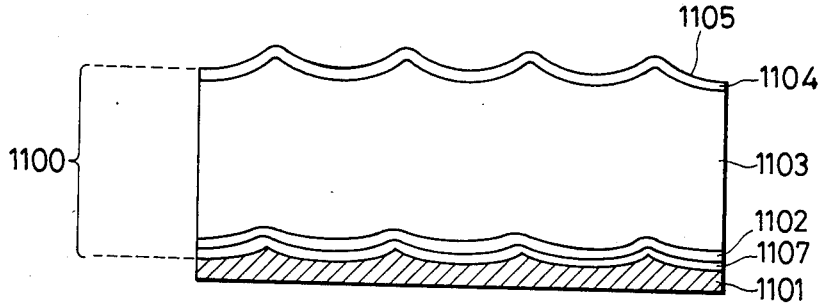
Figure 31:
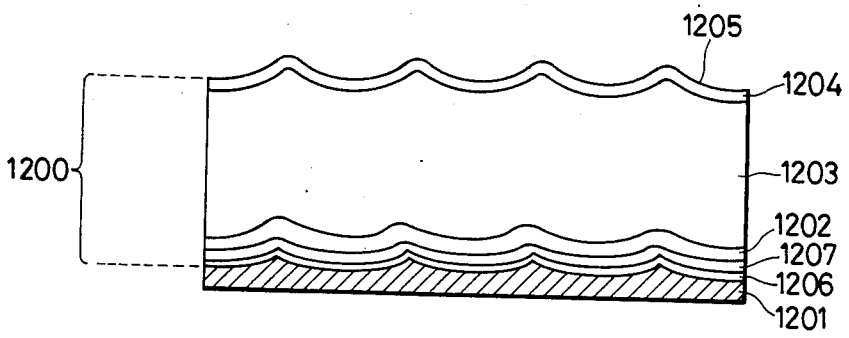
Figure 32:
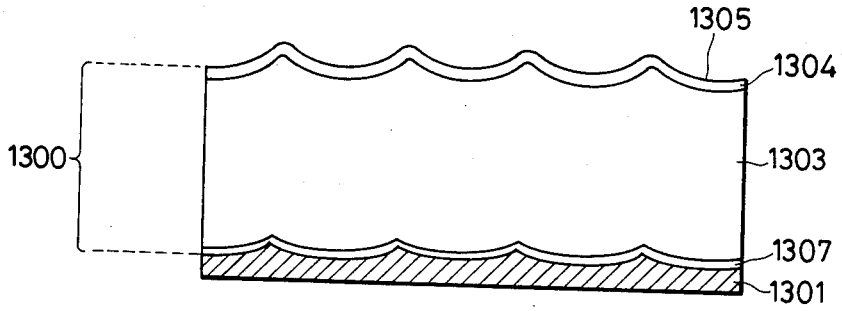

In the example shown in FIG. 27, the distributed concentration C of germanium atoms is reduced from the concentration $C_{56}$ to substantially zero as a first order function from the position $t_B$ to the position $t_T$.

As described above about some typical examples of distribution state in the layer thickness direction of germanium atoms contained in the longer wavelength absorbing layer by referring to FIGS. 22 through 27, in the present invention, the case of providing a distribution state of germanium atoms having a portion of higher distributed concentration C of germanium atoms on the substrate side and having a portion of the above distributed concentration C which has been made considerably made lower as compared with the substrate side on the interface $t_T$ side may be mentioned as a preferable example. As the distribution state in the layer thickness direction of germanium atoms, it is desirably that the layer formation should be effected so that the maximum value Cmax of the distributed concentration of germanium atoms should preferably be 1000 atomic ppm or more, more preferably 5000 atomic ppm or more, optimally $1\times10^4$ atomic ppm or more, based on the sum with silicon atoms.

In the present invention, the content of germanium atoms contained in the longer wavelength absorbing layer 507, 607 may be determined as desired so as to accomplish effectively the objects of the present invention, but may be preferably 1 to $10\times10^5$ atomic ppm, more preferably 100 to $9.5\times10^5$ atomic ppm, optimally 500 to $8\times10^5$ atomic ppm, based on the sum with silicon atoms.

The above-mentioned longer wavelength absorbing layer 507, 607 may also contain at least one of substances for controlling conductivity (valence electron controller), oxygen atoms, nitrogen atoms and carbon atoms.

As the substance for controlling conductivity to be contained in the charge injection preventive layer 102, there may be mentioned such impurities in the field of semiconductors as described in the explanation of the charge injection preventive layer 302, 402.

In the present invention, the content of the substance for controlling conductivity characteristic to be contained in the longer wavelength absorbing layer 507, 607 may be preferably 0.01 to $5\times10^5$ atomic ppm, more preferably 0.5 to $1\times10^4$ atomic ppm, optimally 1 to $5\times10^3$ atomic ppm.

The content of nitrogen atoms (N), oxygen atoms (0), carbon atoms (C) or the sum of the contents of two or more of these in the longer wavelength absorbing layer 507, 607 may be preferably 0.01 to 40 atomic %, more preferably 0.05 to 30 atomic %, optimally 0.1 to 25 atomic %.

In the present invention, the layer thickness of the longer wavelength absorbing layer 507, 607 may preferably be 30Å to 50 μm, more preferably 40Å to 40 μm, optimally 50Å to 30 μm.

In the present invention, typical examples of halogen atoms (X) to be incorporated in the longer wavelength light absorbing layer 507, 607 are F, Cl, Br, I, especially preferably F and Cl.

In the present invention, formation of the longer wavelength light absorbing layer 507, 607 may be conducted according to the vacuum deposition method utilizing discharging phenomenon, such as glow discharge method, sputtering method or ion-plating method.

For example, for formation of the longer wavelength absorbing layer 507, 607 constituted of a polycrystalline or amorphous material containing silicon atoms and germanium atoms according to the glow discharge method, the basic procedure comprises introducing a starting gas for Si supply capable of supplying silicon atoms (Si) and a starting gas for Ge supply capable of supplying germanium atoms (Ge), optionally together with a starting gas for introduction of hydrogen atoms (H) or/and a starting gas for introduction of halogen atoms (X) into a deposition chamber which can be internally brought to a reduced pressure to excite glow discharging within said deposition chamber and form a layer on the surface of a predetermined substrate which is previously placed at a predetermined position. On the other hand, for formation according to the sputtering method, a target constituted of Si or two sheets of said target and a target constituted of Ge, or a target of a mixture of Si and Ge may be used in an atmosphere such as of an inert gas of Ar, He, etc. or a gas mixture based on these gases, and a starting gas for Ge supply optionally diluted with a diluting gas such as He, Ar, etc. is introduced, optionally together with a gas for introduction of hydrogen atoms (H) or/and halogen atoms (X), into the deposition chamber for sputtering and form a plasma atmosphere of desired gases.

The substance which can be the starting material gas for Si supply to be used in the present invention may include gaseous or gasifiable hydrogenated silicon (silanes) such as $SiH_4$, $Si_2H_6$, $Si_3H_8$, $Si_4H_{10}$ and the like as effective ones, particularly preferably $SiH_4$, $Si_2H_6$ for easiness in handling during layer formation working, good Si supply efficiency, etc.

The substance which can be the staring material gas for Ge supply may include gaseous or gasifiable hydrogenated germanium such as $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$, $Ge_9H_{20}$ and the like as effective ones, particularly preferably $GeH_4$, $Ge_2H_6$, $Ge_3H_8$ for easiness in handling during layer formation working, good Ge supply efficiency, etc.

As the effective starting gas for incorporation of halogen atoms to be used in the present invention, there may be mentioned a number of halogen compounds such as halogen gases, halides, interhalogen compounds and silane derivatives substituted with halogens which are gaseous of gasifiable.

Further, it is also effective in the present invention to use a gaseous or gasifiable silicon compound containing halogen atoms which is constituted of both silicon atoms and halogen atoms.

Typical examples of halogen compounds preferably used in the present invention may include halogen gases such as of fluorine, chlorine, bromine or iodine and interhalogen compounds such as BrF, ClF, $ClF_3$, $BrF_5$, $BrF_3$, $IF_3$, $IF_7$, ICl, IBr, etc.

As the silicon compound containing halogen atom, namely the so-called silane derivatives substituted with halogen atoms, silicon halides such as $SiF_4$, $Si_2F_6$, $SiCl_4$, $SiBr_4$, or the like are preferred.

When the specific light-receiving member of this invention is formed according to the glow discharge method by use of such a silicon compound containing halogen atoms, it is possible to form a layer constituted of A-Si:H containing halogen atoms on a desired substrate without use of a hydrogenated silicon gas as the starting gas capable of supplying Si.

In the case of preparing a layer containing halogen atoms according to the glow discharge method, the basic procedure comprises introducing a silicon halide as the starting material gas for Si supply together with a gas such as Ar, $H_2$, He, etc. at a predetermined mixing ratio and gas flow rates into a deposition chamber for formation of a layer, and exciting glow discharge to form a plasma atmosphere of these gases, whereby a desired layer can be formed on a desired substrate. For effecting introduction of hydrogen atoms, a gas of a silicon compound containing hydrogen atoms may be further mixed into these gases in a desired amount for layer formation.

In the case of forming a longer wavelength light absorbing layer 507, 607, as the starting gas for introduction of halogen atoms, the halogen compounds or silicon compounds containing halogens as mentioned above can effectively be used. In addition, it is also possible to use a gaseous or gasifiable substance such as halides containing hydrogen atom as one constituent, for example, hydrogenated germanium halide such as $GeHF_3$, $GeH_2F_2$, $GeH_3F$, $GeHCl_3$, $GeH_2Cl_2$, $GeH_3Cl$, $GeHBr_3$, $GeH_2Br_2$, $GeH_2Br$, $GeHI_2$, $GeH_2I_2$, $GeH_3I$ and the like; and halogenated germanium such as $GeF_4$, $GeCl_4$, $GeBr_4$, $GeI_4$, $GeF_2$, $GeCl_2$, $GeBr_2$, $GeI_2$ and the like as an effective starting material for formation of a longer wavelength light absorbing layer.

The respective gases used are not limited only to single species, but a plural number of gas species may be used at a desired mixing ratio.

For formation of a layer comprising A-Si(H,X) by the reactive sputtering method or the ion-plating method, for example, a target of Si is used and sputtering is effected thereon in a suitable gas plasma atmosphere in the case of the sputtering method. Alternatively, in the case of ion-plating method, a polycrystalline or single crystalline silicon is placed as vaporization source in a vapor deposition boat, and the silicon vaporization source is vaporized by heating by resistance heating method or electron beam method (EB method) thereby to permit vaporized flying substances to pass through a suitable gas plasma atmosphere.

During this procedure, in both of the sputtering method and the ion-plating method, for introduction of halogen atoms into the layer formed, a gas of a halogen compound as mentioned above or a silicon compound containing halogen as mentioned above may be introduced into the deposition chamber to form a plasma atmosphere of said gas therein.

When hydrogen atoms are to be introduced, a starting gas for introduction of hydrogen atoms such as $H_2$ and a gas such as silanes as mentioned above may be introduced into the deposition chamber for sputtering, followed by formation of a plasma atmosphere of said gases.

In the present invention, as the starting gas for introduction of halogen atoms, the halogen compounds or silicon compounds containing halogens or germanium compounds containing halogens as mentioned above can effectively be used. In addition, it is also possible to use a gaseous or gasifiable halide containing hydrogen atom as one of the constituents such as hydrogen halide, including HF, HCl, HBr, HI and the like or halo-substituted hydrogenated silicon, including $SiH_2F_2$, $SiH_2I_2$, $SiH_2Cl_2$, $SiHCl_3$, $SiH_2Br_2$, $SiHBr_3$ and the like as an effective starting material for formation of a longer wavelength light absorbing layer.

These halides containing hydrogen atom, which can introduce hydrogen atoms very effective for controlling electrical or optical characteristics into the layer during formation of the layer simultaneously with introduction of halogen atoms, can preferably be used as the starting material for introduction of halogen atoms.

For incorporation of hydrogen atoms structurally into the layer formed, in addition to those as mentioned above, $H_2$ or a gas of hydrogenated silicon, including $SiH_4$, $Si_2H_6$, $Si_3H_8$, $Si_4H_{10}$ and so on may be permitted to be co-present with a silicon compound for supplying Si in a deposition chamber, wherein discharging is excited.

For example, in the case of the reactive sputtering method, a Si target is used and a gas for introduction of halogen atoms and $H_2$ gas are introduced together with, if necessary, an inert gas such as He, Ar, etc. into a deposition chamber, wherein a plasma atmosphere is formed to effect sputtering of said Si target, thereby forming a layer of A-Si(H,X) on the substrate.

Further, there may also be introduced a gas such as of $B_2H_6$ or others in order to effect also doping of impurities.

The amount of hydrogen atoms (H) or halogen atoms (X) incorporated in the longer wavelength light absorbing layer in the light-receiving member for electrophotography according to the present invention, or total amount of both of these atoms, may be preferably 0.01 to 40 atomic %, more preferably 0.05 to 30 atomic %, optimally 0.1 to 25 atomic %.

For controlling the amounts of hydrogen atoms (H) or/and halogen atoms (X) in the layer formed, the substrate temperature or/and the amounts of the starting materials for incorporation of hydrogen atoms (H) or halcgen atoms (X) to be introduced into the deposition device system or the discharging power may be controlled.

For incorporating the group III atoms or the group V atoms, and the carbon atoms, oxygen atoms or nitrogen atoms in the longer wavelength light absorbing layer 507, 607, during formation of the longer wavelength light absorbing layer 507, 607, by glow discharge or reactive sputtering method, the starting material for introduction of the group III atoms or the group V atoms, and the starting material for introduction ofoxygen atoms, nitrogen atoms or carbon atoms may be used together with the starting material for formation of the longer wavelength light absorbing layer as described above, while controlling their amounts in the layer formed.

As such starting materials for introduction of carbon atoms, oxygen atoms or/and nitrogen atoms, or the starting materials for introduction of the group III atoms or the group V atoms, most of gaseous substances or gasified or gasifiable substances containing at least one of carbon atoms, oxygen atoms and nitrogen atoms, or the group III atoms or the group V atoms may be employed.

For example, for incorporating oxygen atoms, a starting gas containing silicon atom (Si) as the constituent atom, a starting gas containing oxygen atoms (O) as the constituent atom and optionally a starting gas containing hydrogen atom or/and halogen atom (X) as the constituent atom may be used as a mixture with a desired mixing ratio. Alternatively, a starting gas containing silicon atom (Si) as the constituent and a starting gas containing oxygen atom (O) and hydrogen atom (H) as the constituent atoms may be mixed also at a desired mixing ratio, or a starting gas containing silicon atom (Si) as the constituent atom and a starting gas containing the three of silicon atom (Si), oxygen atom (O) and hydrogen atom (H) as the constituent atoms may be used as a mixture.

As another method, a gas mixture comprising a starting gas containing silicon atom (Si) and hydrogen atom (H) and a starting gas containing oxygen atom (O) may be also employed.

As the starting gas for introduction of oxygen atoms and nitrogen atoms, there may be included, for example, oxygen ($O_2$), ozone ($O_3$), nitrogen monooxide (NO), nitrogen dioxide ($NO_2$), dinitrogen monooxide ($N_2O$), dinitrogen trioxide ($N_2O_3$), dinitrogen tetraoxide ($N_2O_4$), dinitrogen pentaoxide ($N_2O_5$), nitrogen trioxide ($NO_3$), nitrogen ($N_2$), ammonia ($NH_3$), hydrogen azide ($HN_3$), hydrazine ($NH_2NH_2$) As the compound containing silicon (Si), oxygen (O) and hydrogen atom (H) as the constituent atoms, there may be included lower siloxanes such as disiloxane ($H_3SiOSiH_3$), trisiloxane ($H_3SiOSiH_2OSiH_3$) and the like.

As carbon atom containing compounds for the starting material for introduction of carbon atoms, there may be included, for example, saturated hydrocarbons having 1 to 4 carbon atoms, ethylenic hydrocarbons having 2 to 4 cartons, acetylenic hydrocarbons having 2 to 3 carbon atoms, etc.

More specifically, typical examples are saturated hydrocarbons such as methane ($CH_4$), ethane ($C_2H_6$), propane ($C_3H_8$), n-butane (n-$C_4H_{10}$), pentane ($C_5H_{12}$); ethylenic hydrocarbons such as ethylene ($C_4H_4$), propylene ($C_3H_6$), butene-1 ($C_4H_8$), butene-2 ($C_4H_8$), isobutylene ($C_4H_8$), pentene ($C_5H_{10}$); and acetylenic hydrocarbons such as acetylene ($C_2H_2$), methylacetylene ($C_3H_4$), butyne ($C_4H_6$) and the like.

Typical examples of the starting gas having Si, C and H as constituent atoms are alkylsilicides such as $Si(CH_3)_4$, $Si(C_2H_5)_4$ and the like.

When the glow discharge method is used for forming a longer wavelength light absorbing layer 507, 607 containing the group III atoms or the group V atoms, the starting materials which become the starting gases for formation of said layer comprise one selected suitably from among the starting materials for formation of the longer wavelength light absorbing layer 507, 607 and a starting material for introduction of the group III atoms or the group V atoms added thereto. As such starting material for introduction of the group III atoms or the group V atoms may be any of gaseous substances or gasified gasifiable substances containing the group III atoms or the group V atoms as the constituent atom.

Specific examples of such starting materials for introduction of the group III atoms may include those for introduction of boron atoms such as hydrogenated boron, including $B_2H_6$, $B_4H_{10}$, $B_5H_9B_5H_{10}$, $B_6H_{10}$, $B_6H_{12}$, $B_6H_{14}$ and the like, halogenated boron such as $BF_3$, $BCl_2$, $BBr_3$ and the like. Otherwise, $AlCl_3$, $GaCl_3$, $InCl_2$, $TlCl_3$, etc., may be also employed.

The starting material for introduction of the group V atoms which can be effectively used in the present invention may include hydrogenated phosphorus such as $PH_3$, $P_2H_4$ and the like; halogenated phosphorus such as $PH_4I$, $PF_3$, $PF_5$, $PCl_3$ $PCl_5$, $PBr_3$, $PBr_5$, $PI_3$ and the like for introduction of phosphorus atoms. Otherwise, $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$, $BiBr_3$, etc. may be also employed as effective starting materials for introduction of the group V atoms.

The content of the group III atoms or the group V atoms in the longer wavelength light absorbing layer 507, 607 containing the group III atoms or the group V atoms can be controlled desirably by controlling the gas flow rates, the gas flow rate ratios of the starting materials for introduction of the group III atoms or the group V atoms, the discharging power, the substrate temperature and the pressure in the deposition chamber, etc.

The substrate temperature for the purpose of accomplishing effectively the objects of the present invention should be selected suitably within the optimum range. When a longer wavelength light absorbing layer 507, 607 is formed of a polycrystalline material, it should preferably 200° to 700° C., more preferably 250° to 600° C. When a longer wavelength light absorbing layer is formed of an amorphous material, it should preferably 50° C. to 350° C., more preferably 100° C. to 300° C.

For formation of the longer wavelength light absorbing layer 507, 607, it is desirable to employ the glow discharge method or the sputtering method for the reasons such as relatively easiness in delicate control of the composition ratio of the atoms constituting the layer or of the layer thickness compared to other methods, and in the case of forming a longer wavelength light absorbing layer 507, 607 according to these layer forming methods, discharging power or gas pressure during layer formation is also one of important factors influencing the characteristic of the longer wavelength light absorbing layer 507, 607 to be prepared similarly as the above substrate temperature.

The discharging power condition for preparing effectively the longer wavelength light absorbing layer 507, 607 having the characteristics for accomplishing the objects in the present invention with good productivity and efficiency may be preferably 100 to 5000 W, more preferably 200 to 2000 W, in the case of forming a longer wavelength light absorbing layer 507, 607 constituted of a polycrystalline material, or preferably 10 to 1000 W, more preferably 20 to 500 W in the case of forming a longer wavelength light absorbing layer 507, 607 constituted of an amorphous material. The gas pressure within the deposition chamber may be preferably $10^{-3}$ to 0.8 Torr, more preferably $5\times10^{-3}$ to 0.5 Torr in the case of forming a longer wavelength light absorbing layer 507, 607 constituted of a polycrystalline material, or preferably 0.01 to 1 Torr, more preferably 0.1 to 0.5 Torr in the case of forming a longer wavelength light absorbing layer 507, 607 constituted of an amorphous material.

In the present invention, desirable numerical value ranges of substrate temperature and discharging power for preparing a longer wavelength light absorbing layer 507, 607 may be the values within the ranges as mentioned above, but these layer forming factors are not determined independently and separately, but it is desirable that the optimum values for the factors for forming respective layers should be determined based on the mutual organic relationship so that a longer wavelength light absorbing layer 507, 607 with desired characteristics may be formed.

Figure 1G:
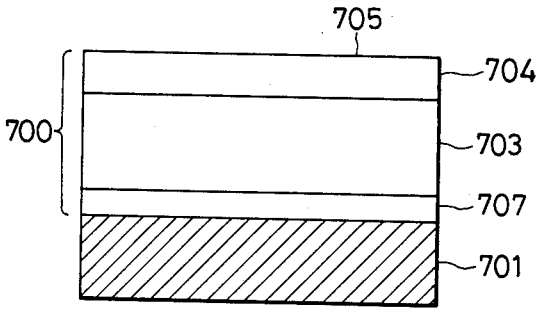
Figure 1H:
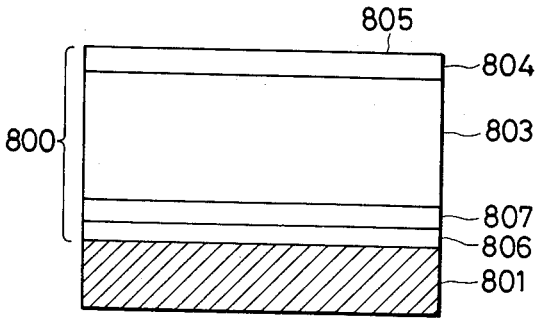

FIG. 1G and FIG. 1H show the seventh and the eighth examples of the preferred embodiments of the light-receiving member for electrophotography of the present invention.

The respective layer constitutions of the light-receiving members for electrophotography shown in FIG. 1G and FIG. 1H are the same as the respective light-receiving members shown in FIG. 1C and FIG. 1D except that the longer wavelength light absorbing layers (IR layers) 707, 807 posessed by the light-receiving members for electrophotography shown in FIG. 1E and FIG. 1F are provided in place of the charge injection preventive layers 302, 402 posessed by the light-receiving members for electrophotography shown in FIG. 1C and FIG. 1D.

The respective light-receiving members for electrophotography shown in FIG. 1G and FIG. 1H can absorb effectively the longer wavelength light effectively by providing longer wavelength light absorbing layers 707, 807 between the substrates 701, 801 and the photoconductive layers 703, 803, whereby interference when using a coherent light such as laser beam can be effectively prevented.

FIG. 28 through FIG. 32 respectively show examples of light-receiving members for electrophotography having light-receiving layers with the same layer constitutions as the light-receiving members for electrophotography shown in FIGS. 1C through 1G on the same substrate as the substrate 1501 of the light-receiving member for electrophotography 1500 shown in FIG. 3.

That is, in FIGS. 28 through 32, 900, 1000, 1100, 1200, and 1300 represent light-receiving layers, 901, 1001, 1101, 1201, and 1301 substrates, 902, 1002, 1102, and 1202 charge injection preventive layers, 903, 1003, 1103, 1203, and 1303 photoconductive layers, 904, 1004, 1104, 1204, and 1304 surface layers, 905, 1005, 1105, 1205, and 1305 free surfaces, 906 and 1206 adhesion layers, 1107, 1207, and 1307 longer wavelength light absorbing layers, respectively.

Next, the method for forming the lightreceiving member is outlined below.

Figure 33:
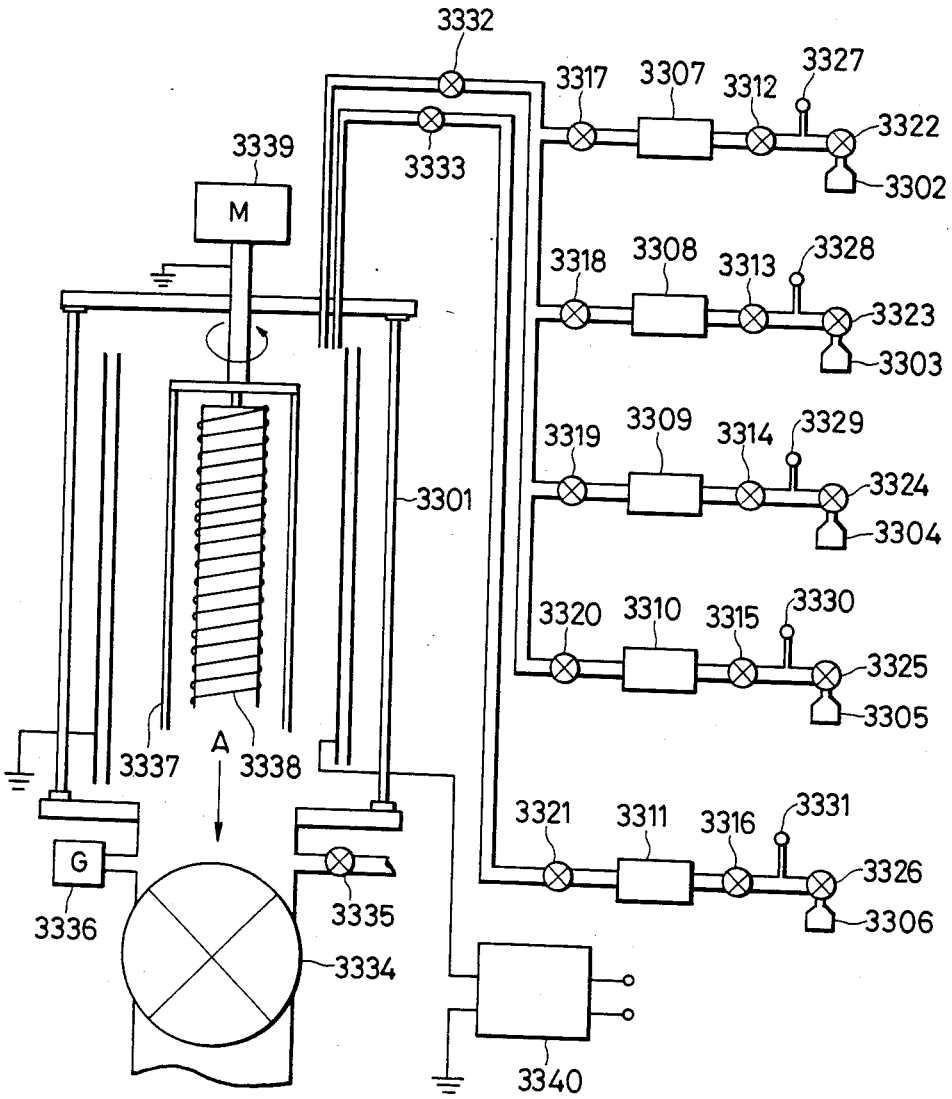
FIG. 33 is a schematic illustration of the preparation device according to the glow discharge method which is an example of the device for forming the light-receiving layer of the light-receiving member for electrophotography of the present invention.

FIG. 33 show an example of the apparatus for preparation of the light-receiving member for electrophotography.

The gas bombs 3302 through 3306 in the Figure are hermetically filled with the starting gases for formation of the respective layers of the present invention. For example, 3302 is a $SiH_4$ gas (purity 99.999%) bomb, 3303 a $B_2H_6$ gas diluted with $H_2$ (purity 99.999%, hereinafter abbreviated as $B_2H_6/H_2$) bomb, 3304 a $H_2$ gas (purity 99.99999%) bomb, 3305 a NO gas (purity 99.999%) bomb, and 3306 a $CH_4$ gas (purity 99.99%) bomb.

For permitting these gases to flow into the reaction chamber 3301, on confirmation that the valves 3322 to 3326 of the gas bombs 3302 to 3306 and the leak valve 3335 are closed, and also on confirmation that the inflow valves 3312 to 3316, the outflow valves 317 to 3321, and the auxiliary valves 3332 to 3333 are opened, first the main valve 3334 is opened to evacuated the reaction chamber 3301 and the gas pipelines. Next, when the reading on the vacuum gauge 3336 becomes about $5\times10^{-6}$ Torr, the auxiliary valves 3332 to 3333 and the outflow valves 3317 to 3312 are closed.

Referring to an example when a light-receiving member for electrophotography with a layer constitution shown in FIG. 1F is formed on the substrate cylinder 3337, $SiH_4$ gas from the gas bomb 3302, $H_2$ gas from the gas bomb 3304, $B_2H_6/H_2$ gas from the gas bomb 3303, and NO gas from the gas bomb 3305 are permitted to flow into the mass flow controllers 3307 to 3310 by opening the valves 3322 through 3325 to control the pressures at the outlet pressure gauges 3327 to 3330 to 1 $Kg/cm^2$ and opening gradually the inflow valves 3312 to 3315. Subsequently, by opening gradually the outflow valves 3317 to 3320 and the auxiliary valve 3332, the respective gases are permitted to flow into the reaction chamber 3301. During this operation, the outflow valves 3317 to 3320 are controlled so that the ratio of $SiH_4$ gas flow rate, $B_2H_6/He$ gas flow rate, and NO gas flow rate may become a desired value and also the opening of the main valve 3334 is controlled while seeing the reading on the vacuum gauge 3336 so that the pressure within the reaction chamber may become a desired value. And, after the temperature of the substrate cylinder 3337 is confirmed to be set at a temperature of 50° to 350° C. by the heater 3338, the power 3340 is set at a desired power to excite glow discharging within the reaction chamber 3301 and at the same time the operation of changing gradually the valve 3318 or/and 3320 manually or by use of an externally driven motor to change the flow rate of $B_2H_6/H_2$ gas or/and NO gas following the change rate curve previously designed, thereby controlling the distributed concentration of boron atoms or/and oxygen atoms in the layer thickness direction contained in the layer formed.

At the point when a charge injection preventive layer containing boron atoms and oxygen atoms to a desired thickness is formed, the outflow valves 3320 and 3318 are closed, with shut-down of inflow of $B_2H_6/He$ gas and NO gas, and at the same time with control of flow rates of $SiH_4$ gas and $H_2$ gas by controlling the outflow valves 3317 and 3319, layer formation is subsequently performed, thereby forming a photoconductive layer containing none of oxygen atoms and boron atoms on the charge injection preventive layer to a desired thickness.

Also, when a photoconductive layer containing oxygen atoms or/and boron atoms is formed, the outflow valves 3318 or/and 3320 may be controlled to desired flow rates in place of being closed.

When halogen atoms are contained in the charge injection preventive layer and the photoconductive layer, for example, $SiF_4$ gas in further added to the above gases to be delivered into the reaction chamber 3301.

In formation of the respective layers, depending on the selection of the gas species, the layer forming speed can be enhanced. For example, when layer formation is performed by use of $Si_2H_6$ gas in place of $SiH_4$ gas, the speed can be enhanced by several times to improve productivity.

For formation of the surface layer on the photoconductive layer as prepared above, according to the same valve operations as in the case of forming the photoconductive layer, for example, $SiH_4$ gas, $CH_4$ gas, and optionally a diluting gas such as $H_2$, etc., may be flowed at desired flow rate ratio into the reaction chamber 3301, followed by excitation of glow discharging following desired conditions.

The content of carbon atoms contained in the surface layer can be controlled as desired by varying freely the flow rate ratio of $SiH_4$ gas and $CH_4$ gas introduced into the reaction chamber 3301 as desired.

Also, the content of hydrogen atoms contained in the surface layer can be controlled by, for example, varying freely the flow rate of $H_2$ gas introduced into the reaction chamber 3301 as desired.

All of the outflow valves other than those for necessary gases during formation of the respective layer are closed as a matter of course and also, in order to avoid remaining of the gases employed for formation of the previous layer during formation of each layer in the reaction chamber 3301, and in the pipelines from the outflow valves 3317 to 3321 to the reaction chamber 3301, the operation of evacuating internally the system once to high vacuum by closing of the outflow valves 3317 to 3321 and full opening of the main valve 3334 by opening of the auxiliary valve 3332 is practiced, if necessary.

Also, during layer formation, in order to effect uniformization, the substrate cylinder 3337 may be also rotated at a desired constant speed by a motor 3339.

EXAMPLE 1A

By use of the preparation device shown in FIG. 33, a light-receiving member for electrophotography was formed on an aluminum cylinder applied with mirror surface working following the preparation conditions in Table 1A. The light-receiving member (hereinafter expressed as drum) was set on an electrophotographic device, and, under various conditions, electrophotographic characteristics such as initial charging ability, residual potential, ghost, etc., were checked, and also lowering in charging ability, sensitivity deterioration and increase of image defects after successive copying of 1,500,000 sheets were examined. Further, the image flow of the drum in an atmosphere of high temperature and high humidity of 35° C. and 85% was also evaluated. And, the drum completed of evaluation was cut out at the portions corresponding to the upper, middle and lower portions of the image portion to prepare a samples, which were provided for quantitative analysis of hydrogen contained in the surface layer by utilization of SIMS, and also the component profiles in the layer thickness direction of silicon atoms (Si), carbon atoms (C) and hydrogen atoms (H) in the surface layer were examined. The above evaluation results and the maximum value of the hydrogen content in the surface layer are shown in Table 2A, and the above component profiles are shown in Table 34. As shown in Table 2A, remarkable superiority was observed in the respective items particularly of initial charging ability, image flow, residual potential, ghost and photosensitive irregularity in the axial direction, sensitivity deterioration.

COMPARATIVE EXAMPLE 1A

Except for changing the preparation conditions as shown in Table 3A, the drum and samples for analysis were prepared by the same device and method as in Example 1A and provided for the same evaluation and analysis. The results are shown in Table 4A.

As can be seen from Table 4A, it was recognized that the respective items were inferior as compared with Example 1A.

EXAMPLE 2A, COMPARTIVE EXAMPLE 2A

The preparation conditions of the surface layer were changed variously as shown in Table 5A, with other conditions being the same as in Example 1A, to prepare a plural number of drums and samples for analysis. These drums and samples were evaluated and analyzed similarly as in Example 1A to obtain the results as shown in Table 6A.

EXAMPLE 3A

The preparation conditions of the photoconductive layer were changed variously as shown in Table 7A, with other conditions being the same as in Example 1A, to prepare a plural number of drums. These drums were evaluated similarly as in Example 1A to obtain the results as shown in Table 8A.

EXAMPLE 4A

The preparation conditions of the photoconductive layer were changed variously as shown in Table 9A, with other conditions being the same as in Example 1A, to prepare a plural number of drums. These drums were evaluated similarly as in Example 1A to obtain the results as shown in Table 10A.

EXAMPLE 5A

On substrate cylinders were formed adhesion layers under several conditions as shown in Table 11A, followed further by formation of the light receiving member thereon under the same preparation conditions as in Example 1A. Separately, samples having only adhesion layers formed thereon were prepared. The light-receiving members were subjected to the same evaluation as in Example 1A, and a part of the sample was cut out for examination of presence or absence of crystallinity by determining the diffraction pattern corresponding to Si (111) around the diffraction angle 27° by means of a X-ray diffraction device. The results are shown in Table 12.

EXAMPLE 6A

On substrate cylinders were formed adhesion layers under several conditions as shown in Table 13A, followed further by formation of the light receiving member thereon under the same preparation conditions as in Example 1A. Separately, samples having only adhesion layers formed thereon were prepared. The light-receiving members were subjected to the same evaluation as in Example 1A, and a part of the sample was cut out for examination of presence or absence of crystallinity by determining the diffraction pattern corresponding to Si (111) around the diffraction angle 27° by means of a X-ray diffraction device. The results are shown in Table 14A.

EXAMPLE 7A

Figure 35:
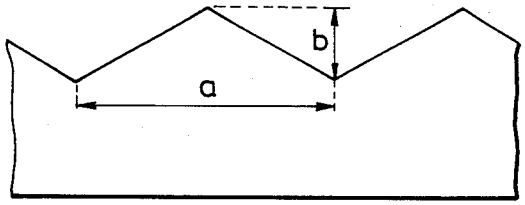
FIG. 35 and 36 are each illustration showing the crosssectional shape of the substrate used in Examples of the present invention.

A cylinder applied with mirror surface working was further subjected to lathe working with sword bit having various angles to prepare a plural number of cylinders having a cross-sectional shape as shown in FIG. 35 and various cross-sectional patterns as shown in Table 15A. Said cylinder was successively set in the prepatation device shown in FIG. 33 and subjected to drum preparation under the preparation cinditions similarly as in Example 1A. The drum prepared was evaluated variously by means of an electrophotographic device of a digital exposure function with the use of a semiconductor laser having a wavelength of 780 nm as the light source to give the results shown in Table 16A.

EXAMPLE 8A

Figure 36:
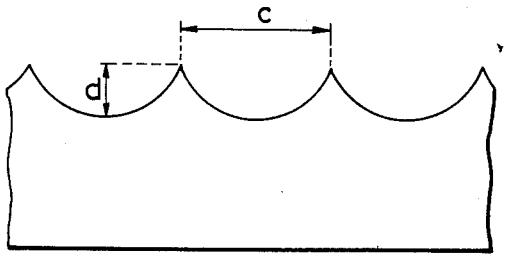

The surface of the cylinder applied with mirror surface working was applied with the so called surface dimple formation treatment in which it was subsequently exposed to falling of a large number of balls for bearing to form numberless hitted marks on the cylinder surface, to prepare a plural number of cylinders having a cross-section shape as shown in FIG. 36 and various cross-section patterns as shown in Table 17A. Said cylinder was successively set in the preparation device shown in FIG. 33 and subjected to drum preparation under the preparation conditions similarly as in Example 1A. The drum prepared was evaluated variously by means of an electrophotographic device of a digital exposure function with the use of a semiconductor laser having a wavelength of 780 nm as the light source to give the results as shown in Table 18A.

TABLE 1B

By use of the preparation device shown in FIG. 33, a light-receiving member for electrophotography was formed on an aluminum cylinder applied with mirror surface working following the preparation conditions in Table 1B. Also, by use of the device of the same model as shown in FIG. 33, samples having only charge injection preventive layers formed on the cylinder with the same specification were separately prepared. The light-receiving member (hereinafter expressed as drum) was set on an electrophotographic device, and, under various conditions, electrophotographic characteristics such as initial charging ability, residual potential, ghost, etc., were checked, and also lowering in charging ability, sensitivity deterioration and increase of image defects after successive copying for 1,500,000 sheets were examined. Further, the image flow of the drum in an atmosphere of high temperature and high humidity of 35° C. and 85% was also evaluated. And, the drum completed of evaluation was cut out at the portions corresponding to the upper, middle and lower portions of the image portion to prepare samples, which were provided for quantitative analysis of hydrogen contained in the surface layer by utilization of SIMS. Also, the sample having only the charge injection preventive layer was cut out in the same manner, and the diffraction pattern corresponding to Si (111) around the diffraction angle 27° was determined by a X-ray diffraction device for examination of presence of crystallinity. The above evaluation results, the maximum value of the hydrogen content in the surface layer and also presence of crystallinity of the charge injection preventive layer are comprehensively shown in Table 2B. As shown in Table 2B, remarkable superiority was observed in the respective items particularly of initial charging ability, image flow, residual potential, ghost, increase of image defects and photosensitive irregularity in the axial direction, sensitivity deterioration.

COMPARATIVE EXAMPLE 1B

Except for changing the preparation conditions as shown in Table 3B, the drum and samples for analysis were prepared by the same device and method as in Example 1B and provided for the same evaluation and analysis. The results are shown in Table 4B.

As can be seen from Table 4B, it was recognized that the respective items were inferior as compared with Example 1B.

EXAMPLE 2B

Figure 37:
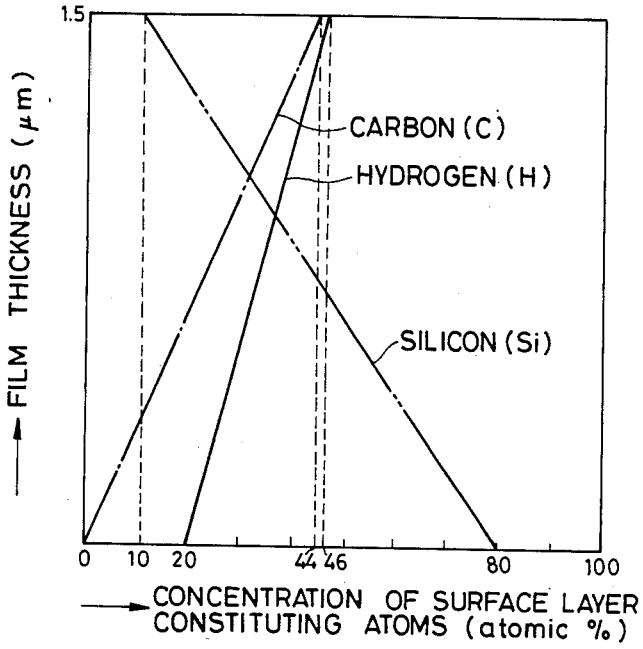
Figure 38:
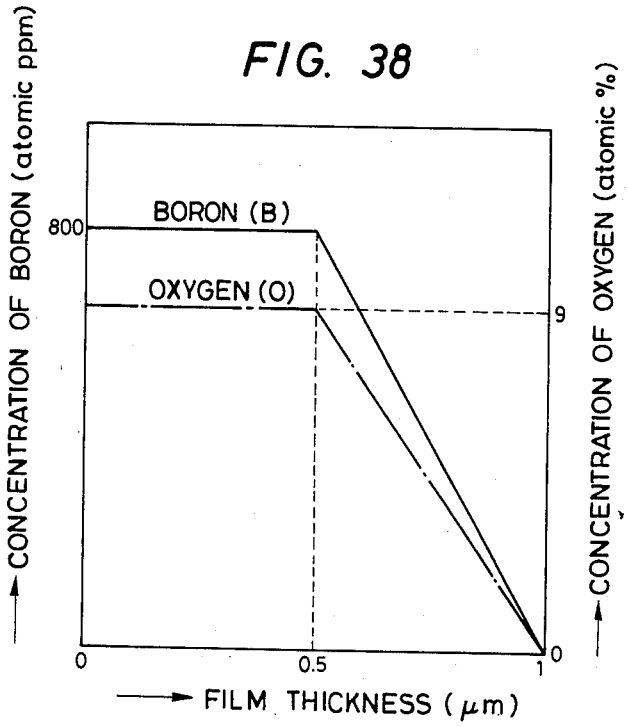

By use of the preparation device shown in FIG. 33, a light-receiving member for electrophotography was formed on an aluminum cylinder applied with mirror surface working following the preparation conditions in Table 5B. Also, by use of the device of the same model as shown in FIG. 33, samples having only charge injection preventive layers formed on the cylinder with the same specification were separately prepared. The light-receiving member (hereinafter expressed as drum) was set on an electrophotographic device, and, under various conditions, electrophotographic characteristics such as initial charging ability, residual potential, ghost, etc., were checked, and also lowering in charging ability, sensitivity deterioration and increase of image defects after successive copying for 1,500,000 sheets were examined. Further, the image flow of the drum in an atmosphere of high temperature and high humidity of 35° C. and 85% was also evaluated. And, the drum completed of evaluation was cut out at the portions corresponding to the upper, middle and lower portions of the image portion to prepare samples, which were provided for quantitative analysis of hydrogen contained in the surface layer by utilization of SIMS, and also the component profiles in the layer direction of silicon atoms (Si), carbon atoms (C) and hydrogen atoms (H) in the surface layer were examined. Further, the component profiles of boron (B) and oxygen (O) in the charge injection preventive layer were examined. Also, the sample having only the charge injection preventive layer was cut out in the same manner, and the diffraction pattern corresponding to Si (111) around the diffraction angle 27° was determined by a X-ray diffraction device for examination of presence of crystallinity. The above evaluation results and the maximum value of the hydrogen content in the surface layer, and also presence or absence of crystallinity of the charge injection preventive layer are comprehensively shown in Table 6B. Further, the component profiles of said elements in the above surface layer are shown in FIG. 37, and the component profiles of said elements in the above charge injection preventive layer are shown in FIG. 37.

As shown in Table 6B, remarkable superiority was observed in the respective items particularly of initial charging ability, image flow, residual potential, ghost, increase of image defects and photosensitive irregularity in the axial direction, sensitivity deterioration.

EXAMPLE 3B, COMPARATIVE EXAMPLE 2B

The preparation conditions of the surface layer were changed variously as shown in Table 7B, with other conditions being the same as in Example 1B, to prepare a plural number of drums, which were provided for the same evaluation. And the drums completed of evaluation were cut out in the same manner as in Example 1B to give samples, which were subjected to the same analysis. The above results are shown in Table 8B.

EXAMPLE 4B

The preparation conditions of the photoconductive layer were changed variously as shown in Table 9B, with other conditions being the same as in Example 1B, to prepare a plural number of drums. These drums were evaluated similarly as in Example 1B to obtain the results as shown in Table 10B.

EXAMPLE 5B

The preparation conditions of the charge injection preventive layer were changed variously as shown in Table 11B, with other conditions being the same as in Example 1B, to prepare a plural number of drums and samples having only charge injection preventive layers formed. These drums and samples for analysis were subjected to the same evaluation and analysis similarly as in Example 1B to obtain the results as shown in Table 12B.

EXAMPLE 6B

The preparation conditions of the charge injection preventive layer were changed variously as shown in Table 13B, with other conditions being the same as in Example 1B, to prepare a plural number of drums and samples having only charge injection preventive layers formed. These drums and samples for analysis were subjected to the same evaluation and analysis similarly as in Example 1B to obtain the results as shown in Table 14B.

EXAMPLE 7

On a substrate cylinder, an adhesion layer was formed under several preparation conditions as indicated in Table 15B, and further a light-receiving member was formed under the same preparation conditions as in Example 1B. Separately, samples having only adhesion layers formed were prepared. The light-receiving member was subjected to the same evaluation as in Example 1B, while a part of the sample was cut out and the diffraction pattern corresponding to Si (111) around the diffraction angle 27° was determined for examination of presence or absence of crystallinity. The above results are shown in Table 16B.

EXAMPLE 8B

On a substrate cylinder, an adhesion layer was formed under several preparation conditions as indicated in Table 17B, and further a light-receiving member was formed under the same preparation conditions as in Example 1B. Separately, samples having only adhesion layers formed were prepared. The light-receiving member was subjected to the same evaluation as in Example 1B, while a part of the sample was cut out and the diffraction pattern corresponding to Si (111) around the diffraction angle 27° was determined for examination of presence or absence of crystallinity. The above results are shown in Table 18B.

EXAMPLE 9B

A cylinder applied with mirror surface working was further subjected to lathe working with sword bit having various angles to prepare a plural number of cylinders having a cross-sectional shape as shown in FIG. 35 and various cross-sectional patterns as shown in Table 19B. Said cylinder was successively set in the preparation device shown in FIG. 33 and subjected to drum preparation under the preparation conditions similarly as in Example 1B. The drum prepared was evaluated variously by means of an electrophotographic device of a digital exposure function with the use of a semiconductor laser having a wavelength of 780 nm as the light source to give the results shown in Table 20B.

EXAMPLE 10B

The surface of the cylinder applied with mirror surface working was applied with the so called surface dimple formation treatment in which it was subsequently exposed to falling of a large number of balls for bearing to form numberless hitted marks on the cylinder surface, to prepare a plural number of cylinders having a cross-section shape as shown in FIG. 36 and various cross-section patterns as shown in Table 21B. Said cylinder was successively set in the preparation device shown in FIG. 33 and subjected to drum preparation under the preparation conditions similarly as in Example 1B. The drum prepared was evaluated variously by means of an electrophotographic device of a digital exposure function with the use of a semiconductor laser having a wavelength of 780 nm as the light source to give the results as shown in Table 22B.

EXAMPLE 1C

By use of the preparation device shown in FIG. 33, a light-receiving member for electrophotography was formed on an aluminum cylinder applied with mirror surface working following the preparation conditions in Table 1C. The light-receiving member (hereinafter expressed as drum) was set on an electrophotographic device, and, under various conditions, electrophotographic characteristics such as initial charging ability, residual potential, ghost, etc., were checked, and also lowering in charging ability, sensitivity deterioration and increase of image defects after successive copying for 1,500,000 sheets were examined. Further, the image flow of the drum in an atmosphere of high temperature and high humidity of 35° C. and 85% was also evaluated. And, the drum completed of evaluation was cut out at the portions corresponding to the upper, middle and lower portions of the image portion to prepare samples, which were provided for quantitative analysis of hydrogen contained in the surface layer by utilization of SIMS. The above evaluation results and the maximum value of the hydrogen content in the surface layer are shown in Table 2C. As shown in Table 2C, remarkable superiority was observed in the respective items particularly of initial charging ability, image flow, residual potential, ghost and photosensitive irregularity in the axial direction, sensitivity deterioration.

COMPARATIVE EXAMPLE 1C

Except for changing the preparation conditions as shown in Table 3C, the drum and samples for analysis were prepared by the same device and method as in Example 1 and provided for the same evaluation and analysis. The results are shown in Table 4C.

As can be seen from Table 4C, it was recognized that the respective items were inferior as compared with Example 1C.

By use of the preparation device shown in FIG. 33, a light-receiving member for electrophotography was formed on an aluminum cylinder applied with mirror surface working following the preparation conditions in Table 5C. The light-receiving member (hereinafter expressed as drum) was set on an electrophotographic device, and, under various conditions, electrophotographic characteristics such as initial charging ability, residual potential, ghost, etc., were checked, and also lowering in charging ability, sensitivity deterioration and increase of image defects after successive copying for 1,500,000 sheets in a real machine were examined. Further, the image flow of the drum in an atmosphere of high temperature and high humidity of 35° C. and 85% was also evaluated.

Figure 42:
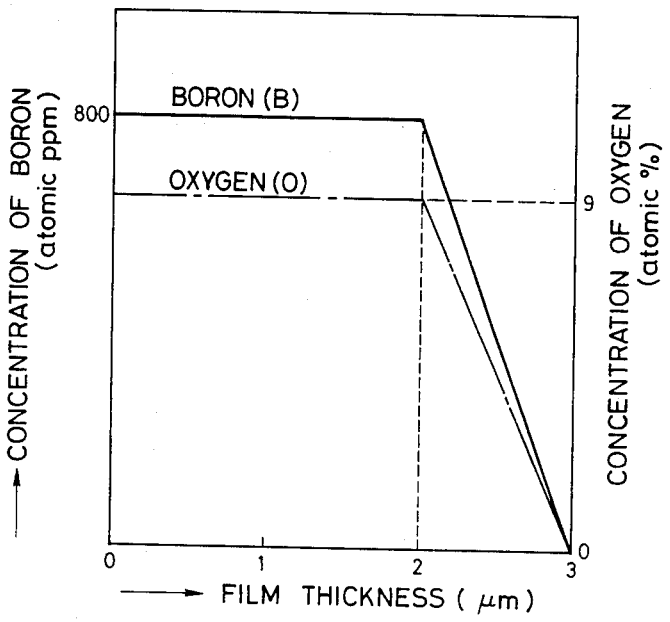

And, the drum completed of evaluation was cut out at the portions corresponding to the upper, middle and lower portions of the image portion to prepare samples, which were provided for quantitative analysis of hydrogen contained in the surface layer by utilization of SIMS, and also the component profiles in the layer direction of silicon atoms (Si), carbon atoms (C) and hydrogen atoms (H) in the surface layer were examined. Further, the component profiles of boron (B) and oxygen (O) in the charge injection preventive layer were examined. The above evaluation results and the maximum value of the hydrogen content in the surface layer are shown in Table 6C. Also, the component profiles of said elements in the above surface layer are shown in FIG. 37, and further the component profiles of said elements in the above charge injection preventive layer are shown in FIG. 42. As shown in Table 6C, remarkable superiority was observed in the respective items particularly of initial charging ability, image flow, residual potential, ghost and photosensitive irregularity in the axial direction, sensitivity deterioration.

EXAMPLE 3C, COMPARATIVE EXAMPLE 2C

The preparation conditions of the surface layer were changed variously as shown in Table 7C, with other conditions being the same as in Example 1C, to prepare a plural number of drums and samples for analysis. These drums and samples were evaluated and analyzed similarly as in Example 1C to obtain the results as shown in Table 8C.

EXAMPLE 4C

The preparation conditions of the photoconductive layer were changed variously as shown in Table 9C, with other conditions being the same as in Example 1C, to prepare a plural number of drums. These drums were evaluated similarly as in Example 1C to obtain the results as shown in Table 10C.

EXAMPLE 5C

The preparation conditions of the charge injection preventive layer were changed variously as shown in Table 11C, with other conditions being the same as in Example 1C, to prepare a plural number of drums. These drums were evaluated similarly as in Example 1C to obtain the results as shown in Table 12C.

EXAMPLE 6

The preparation conditions of the charge injection preventive layer were changed variously as shown in Table 13C, with other conditions being the same as in Example 1C, to prepare a plural number of drums. These drums were evaluated similarly as in Example 1C to obtain the results as shown in Table 14C.

EXAMPLE 7C

A cylinder applied with mirror surface working was further subjected to lathe working with sword bit having various angles to prepare a plural number of cylinders having a cross-sectional shape as shown in FIG. 35 and various cross-sectional patterns as shown in Table 15C. Said cylinder was successively set in the preparation device shown in FIG. 33 and subjected to drum preparation under the preparation conditions similarly as in Example 1C. The drum prepared was evaluated variously by means of an electrophotographic device of a digital exposure function with the use of a semiconductor laser having a wavelength of 780 nm as the light source to give the results shown in Table 16C.

EXAMPLE 8

The surface of the cylinder applied with mirror surface working was applied with the so called surface dimple formation treatment in which it was subsequently exposed to falling of a large number of balls for bearing to form numberless hitted marks on the cylinder surface, to prepare a plural number of cylinders having a cross-section shape as shown in FIG. 36 and various cross-section patterns as shown in Table 17C. Said cylinder was successively set in the preparation device shown in FIG. 33 and subjected to drum preparation under the preparation conditions similarly as in Example 1C. The drum prepared was evaluated variously by means of an electrophotographic device of a digital exposure function with the use of a semiconductor laser having a wavelength of 780 nm as the light source to give the results as shown in Table 18C.

EXAMPLE 1D

By use of the preparation device shown in FIG. 24, a light-receiving member for electrophotography was formed on an aluminum cylinder applied with mirror surface working following the preparation conditions in Table 1D. The light-receiving member (hereinafter expressed as drum) was set on an electrophotographic device of a digital exposure function with a semiconductor laser having a wavelength of 780 nm as the light source, and, under various conditions, electrophotographic characteristics such as initial charging ability, residual potential, ghost, etc., were checked, and also lowering in charging ability, sensitivity deterioration and increase of image defects after successive copying for 1,500,000 sheets in a real machine were examined. Further, the image flow of the drum in an atmosphere of high temperature and high humidity of 35° C. and 85% was also evaluated. And, the drum completed of evaluation was cut out at the portions corresponding to the upper, middle and lower portions of the image portion to prepare samples, which were provided for quantitative analysis of hydrogen contained in the surface layer by utilization of SIMS. The above evaluation results and the maximum value of the hydrogen content in the surface layer are shown in Table 2D. As shown in Table 2D, remarkable superiority was observed in the respective items particularly of initial charging ability, image flow, residual potential, ghost and photosensitive irregularity in the axial direction, sensitivity deterioration.

COMPARATIVE EXAMPLE 1D

Except for changing the preparation conditions as shown in Table 3D, the drum and samples for analysis were prepared by the same device and method as in Example 1D and provided for the same evaluation and analysis. The results are shown in Table 4D.

As can be seen from Table 4D, it was recognized that the respective items were inferior as compared with Example 1D.

EXAMPLE 2D

Figure 39:
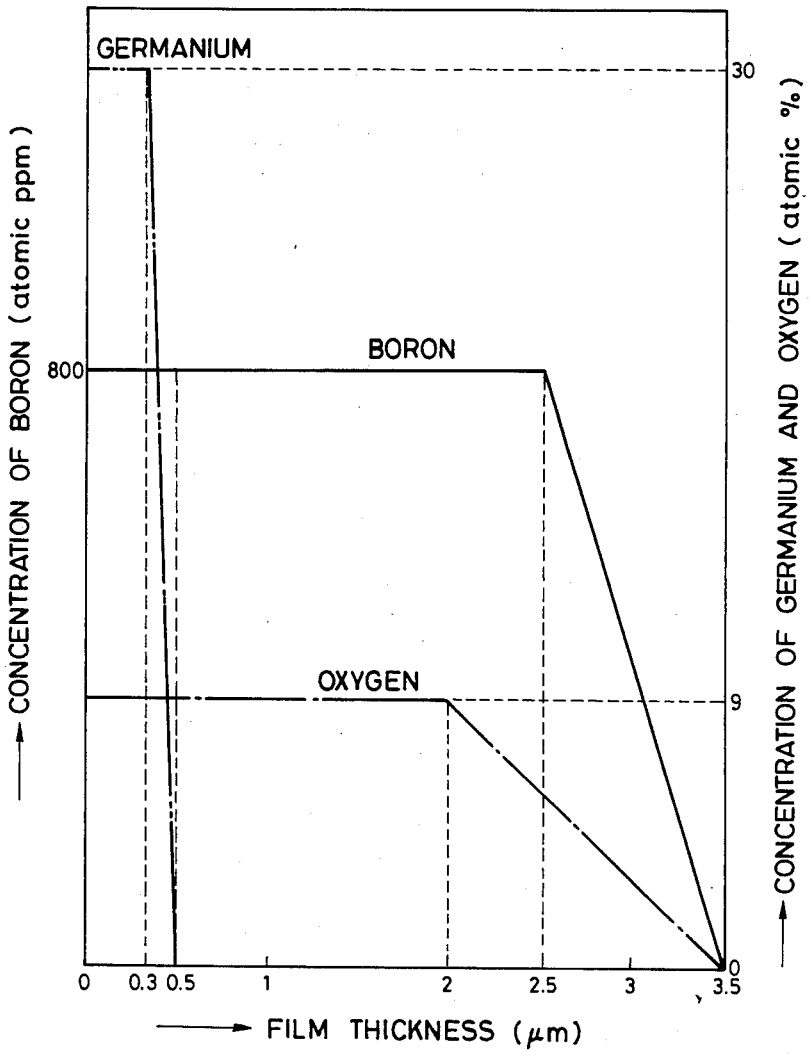

By use of the preparation device shown in FIG. 33, a light-receiving member for electrophotography was formed on an aluminum cylinder applied with mirror surface working following the preparation conditions in Table 5D. The light-receiving member (hereinafter expressed as drum) was set on an electrophotographic device of a digital exposure function with a semiconductor laser having a wavelength of 780 nm as the light source, and, under various conditions, electrophotographic characteristics such as initial charging ability, residual potential, ghost, etc., were checked, and also lowering in charging ability, sensitivity deterioration and increase of image defects after successive copying for 1,500,000 sheets in a real machine were examined. Further, the image flow of the drum in an atmosphere of high temperature and high humidity of 35° C. and 85% was also evaluated. And, the drum completed of evaluation was cut out at the portions corresponding to the upper, middle and lower portions of the image portion to prepare samples, which were provided for quantitative analysis of hydrogen contained in the surface layer by utilization of SIMS, and also the component profiles in the layer direction of silicon atoms (Si), carbon atoms (C) and hydrogen atoms (H) in the surface layer were examined. Further, the component profiles of boron (B) and oxygen (O) in the charge injection preventive layer and the component of germanium (Ge) in the layer thickness direction in the longer wavelength absorbing layer were examined. The above evaluation results and the maximum value of the hydrogen content in the surface layer are shown in Table 6D. Also, the component profiles of said elements in the above surface layer are shown in FIG. 37, and further the component profiles of said elements in the above charge injection preventive layer and the component profile of said element in the longer wavelength absorbing layer are shown in FIG. 39. As shown in Table 6D, remarkable superiority was observed in the respective items particularly of initial charging ability, image flow, residual potential, ghost and photosensitive irregularity in the axial direction, sensitivity deterioration and increase of image defects as well as interference fringe.

EXAMPLE 3D, COMPARATIVE EXAMPLE 2D

The preparation conditions of the surface layer were changed variously as shown in Table 7D, with other conditions being the same as in Example 1D, to prepare a plural number of drums and samples for analysis. These drums and samples were evaluated and analyzed similarly as in Example 1D to obtain the results as shown in Table 8D.

EXAMPLE 4D

The preparation conditions of the photoconductive layer were changed variously as shown in Table 9D, with other conditions being the same as in Example 1D, to prepare a plural number of drums. These drums were evaluated similarly as in Example 1D to obtain the results as shown in Table 10D.

EXAMPLE 5

The preparation conditions of the charge injection preventive layer were changed variously as shown in Table 11D, with other conditions being the same as in Example 1D, to prepare a plural number of drums. These drums were evaluated similarly as in Example 1D to obtain the results as shown in Table 12D.

EXAMPLE 6D

The preparation conditions of the charge injection preventive layer were changed variously as shown in Table 13D, with other conditions being the same as in Example 1D, to prepare a plural number of drums. These drums were evaluated similarly as in Example 1D to obtain the results as shown in Table 14D.

EXAMPLE 7

The preparation conditions of the longer wavelength absorbing layer were changed variously as shown in Table 15D, with other conditions being the same as in Example 1D, to prepare a plural number of drums. These drums were evaluated similarly as in Example 1D to obtain the results as shown in Table 16D.

EXAMPLE 8

The preparation conditions of the longer wavelength absorbing layer were changed variously as shown in Table 17D, with other conditions being the same as in Example 1D, to prepare a plural number of drums. These drums were evaluated similarly as in Example 1D to obtain the results as shown in Table 18D.

EXAMPLE 9D

A cylinder applied with mirror surface working was further subjected to lathe working with sword bit having various angles to prepare a plural number of cylinders having a cross-sectional shape as shown in FIG. 29D and various cross-sectional patterns as shown in Table 19D. Said cylinder was successively set in the preparation device shown in FIG. 33 and subjected to drum preparation under the preparation conditions similarly as in Example 1D. The drum prepared was evaluated variously by means of an electrophotographic device of a digital exposure function with the use of a semiconductor laser having a wavelength of 780 nm as the light source to give the results shown in Table 20D.

EXAMPLE 10

The surface of the cylinder applied with mirror surface working was applied with the so called surface dimple formation treatment in which it was subsequently exposed to falling of a large number of balls for bearing to form numberless hitted marks on the cylinder surface, to prepare a plural number of cylinders having a cross-section shape as shown in FIG. 36 and various cross-section patterns as shown in Table 21D. Said cylinder was successively set in the preparation device shown in FIG. 33 and subjected to drum preparation under the preparation conditions similarly as in Example 1D. The drum prepared was evaluated variously by means of an electrophotographic device of a digital exposure function with the use of a semiconductor laser having a wavelength of 780 nm as the light source to give the results as shown in Table 22D.

EXAMPLE 1E

By use of the preparation device shown in FIG. 33, a light-receiving member for electrophotography was formed on an aluminum cylinder applied with mirror surface working following the preparation conditions in Table 1E. Also, by use of a device of the same model as shown in FIG. 33, samples for analysis having only the charge injection preventive layer and only the longer wavelength absorbing layer on the cylinder with the same specification, respectively, were prepared separately. The light-receiving member (hereinafter expressed as drum) was set on an electrophotographic device of a digital exposure function with a semiconductor laser having a wavelength of 780 nm as the light source, and, under various conditions, electrophotographic characteristics such as initial charging ability, residual potential, ghost, etc., were checked, and also lowering in charging ability, sensitivity deterioration and increase of image defects after successive copying for 1,500,000 sheets in a real machine were examined. Further, the image flow of the drum in an atmosphere of high temperature and high humidity of 35° C. and 85% was also evaluated. And, the drum completed of evaluation was cut out at the portions corresponding to the upper, middle and lower portions of the image portion to prepare samples, which were provided for quantitative analysis of hydrogen contained in the surface layer by utilization of SIMS. On the other hand, the sample having only the charge injection preventive layer and the sample having only the longer wavelength absorbing layer were cut out in the same manner, and then diffraction patterns corresponding to Si (111) around the diffraction angle 27° were determined by use of a X-ray diffraction device for examination of presence or absence of crystallinity. The above evaluation results and the maximum value of the hydrogen content in the surface layer, and further presence or absence of crystallinity of the charge injection preventive layer and the longer wavelength absorbing layer are comprehensively shown in Table 2E. As shown in Table 2E, remarkable superiority was observed in the respective items particularly of initial charging ability, image flow, residual potential, ghost, image defects and photosensitive irregularity in the axial direction, sensitivity deterioration.

COMPARATIVE EXAMPLE 1

Except for changing the preparation conditions as shown in Table 3E, the drum and samples for analysis were prepared by the same device and method as in Example 1E and provided for the same evaluation and analysis. The results are shown in Table 4E.

As can be seen from Table 4E, it was recognized that the respective items were inferior as compared with Example 1E.

EXAMPLE 2E

Figure 40:
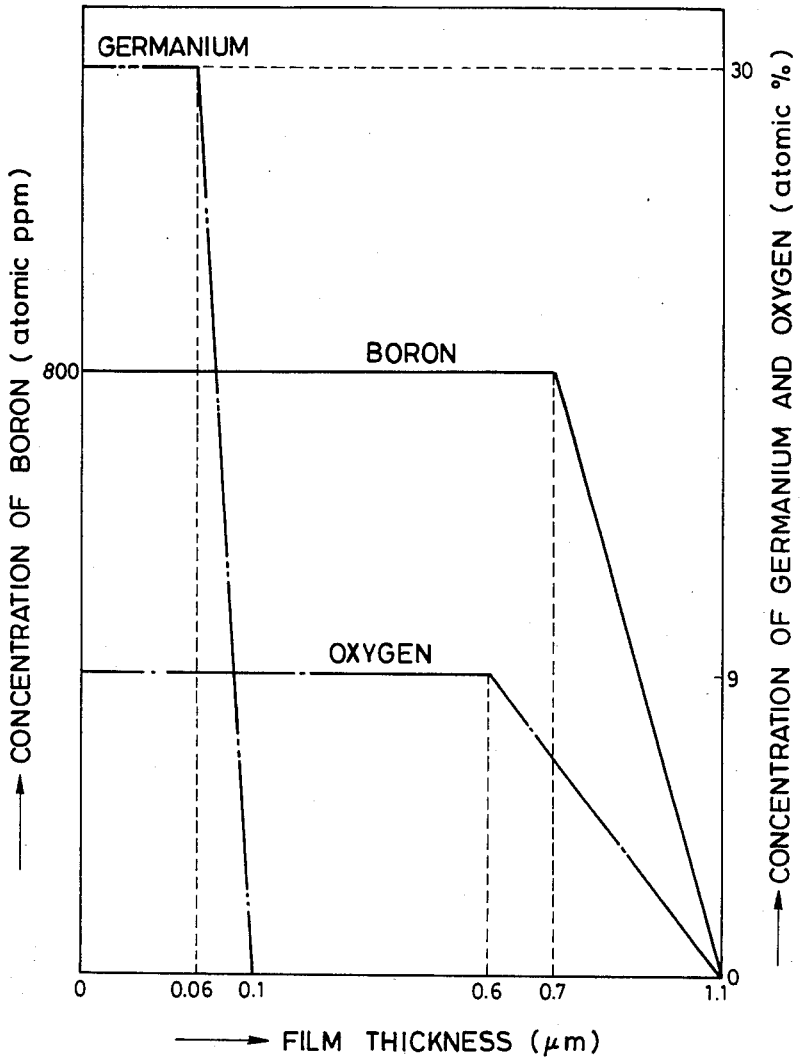

By use of the preparation device shown in FIG. 33, a light-receiving member for electrophotography was formed on an aluminum cylinder applied with mirror surface working following the preparation conditions in Table 5E. Also, by use of a device of the same model as shown in FIG. 33, samples for analysis having only the charge injection preventive layer and only the longer wavelength absorbing layer on the cylinder with the same specification, respectively, were prepared separately. The light-receiving member (hereinafter expressed as drum) was set on an electrophotographic device of a digital exposure function with a semiconductor laser having a wavelength of 780 nm as the light source, and, under various conditions, electrophotographic characteristics such as initial charging ability, residual potential, ghost, etc., were checked, and also lowering in charging ability, sensitivity deterioration and increase of image defects after successive copying for 1,500,000 sheets in a real machine were examined. Further, the image flow of the drum in an atmosphere of high temperature and high humidity of 35° C. and 85% was also evaluated. And, the drum completed of evaluation was cut out at the portion corresponding to the upper, middle and lower portions of the image portion to prepare samples, which were provided for quantitative analysis of hydrogen contained in the surface layer by utilization of SIMS, and also the component profiles in the layer direction of silicon atoms (Si), carbon atoms (C) and hydrogen atoms (H) in the surface layer were examined. Further, the component profiles of boron (B) and oxygen (O) in the charge injection preventive layer and the component of germanium (Ge) in the layer thickness direction in the longer wavelength absorbing layer were examined. On the other hand, the sample having only the charge injection preventive layer and the sample having only the longer wavelength photosensitive layer were cut out in the same manner, and then diffraction patterns corresponding to Si (111) around the diffraction angle 27° were determined by use of a X-ray diffration device for examination of presence or absence of crystallinity. The above evaluation results and the maximum value of the hydrogen content in the surface layer, and further presence or absence of crystallinity of the charge injection preventive layer and the longer wavelength absorbing layer are comprehensively shown in Table 6E. Further, the component profiles of said elements in the above surface layer are shown in FIG. 37 and the component profiles of said element in the above charge injection preventive layer and the component profile of said element in the longer wavelength photosensitive layer are shown in FIG. 40.

As shown in Table 6E, remarkable superiority was observed in various and many items particularly of initial charging ability, image flow, residual potential, ghost, image defects and photosensitive irregularity in the axial direction, sensitivity deterioration and increase of image defects as well as interference fringe.

EXAMPLE 3E, COMPARATIVE EXAMPLE 2E

The preparation conditions of the surface layer were changed variously as shown in Table 7E, with other conditions being the same as in Example 1E, to prepare a plural number of drums, which were provided for the same evaluation. And, the drums completed of evaluation were cut out into samples and subjected to the same analysis. The above results are shown in Table 8E.

EXAMPLE 4E

The preparation conditions of the photoconductive layer were changed to several conditions as shown in Table 9E, with other conditions being the same as in Example 1E, to prepare a plural number of drums. These drums were evaluated similarly as in Example 1E to obtain the results as shown in Table 10E.

EXAMPLE 5E

The preparation conditions of the charge injection preventive layer were changed to several conditions as shown in Table 11E, with other conditions being the same as in Example 1E, to prepare a plural number of drums and samples having only the charge injection preventive layer formed. These drums and samples for analysis were subjected to evaluation and analysis as in Example 1E to obtain the results as shown in Table 12E.

EXAMPLE 6E

The preparation conditions of the charge injection preventive layer were changed to several conditions as shown in Table 13E, with other conditions being the same as in Example 1E, to prepare a plural number of drums and samples having only the charge injection preventive layer formed. These drums and samples for analysis were subjected to evaluation and analysis as in Example 1E to obtain the results as shown in Table 14E.

EXAMPLE 7E

The preparation conditions of the longer wavelength absorbing layer were changed to several conditions as shown in Table 15E, with other conditions being the same as in Example 1E, to prepare a plural number of drums and samples for analysis having only longer wavelength photosensitive layer formed. The drum was subjected to the same evaluation as in Example 1E, while a part of the sample was cut out and the diffraction pattern corresponding to Si (111) around the diffraction angle 27° was determined for examination of presence or absence of crystallinity. The above results are shown in Table 16E.

EXAMPLE 8

The preparation conditions of the longer wavelength absorbing layer were changed to several conditions as shown in Table 17E, with other conditions being the same as in Example 1E, to prepare a plural number of drums and samples for analysis having only longer wavelength absorbing layer formed. The drum was subjected to the same evaluation as in Example 1E, while a part of the sample was cut out and the diffraction pattern corresponding to Si (111) around the diffraction angle 27° was determined for examination of presence or absence of crystallinity. The above results are shown in Table 18E.

EXAMPLE 9E

The preparation conditions of the longer wavelength absorbing layer were changed to several conditions as shown in Table 19E, with other conditions being the same as in Example 1E, to prepare a plural number of drums and samples for analysis having only longer wavelength absorbing layer formed. The drum was subjected to the same evaluation as in Example 1, while a part of the sample was cut out and the diffraction pattern corresponding to Si (111) around the diffraction angle 27° was determined for examination of presence or absence of crystallinity. The above results are shown in Table 20E.

EXAMPLE 10

The preparation conditions of the longer wavelength absorbing layer were changed to several conditions as shown in Table 21E, with other conditions being the same as in Example lE, to prepare a plural number of drums and samples for analysis having only longer wavelength absorbing layer formed. The drum was subjected to the same evaluation as in Example 1E, while a part of the sample was cut out and the diffraction pattern corresponding to Si (111) around the diffraction angle 27° was determined for examination of presence or absence of crystallinity. The above results are shown in Table 22E.

EXAMPLE 11

On a substrate cylinder, an adhesion layer was formed under several preparation conditions as indicated in Table 23E, and further a light-receiving member was formed under the same preparation conditions as in Example 1E. Separately, samples having only adhesion layers formed were prepared. The light-receiving member was subjected to the same evaluation as in Example 1E, while a part of the sample was cut out and the diffraction pattern corresponding to Si (111) around the diffraction angle 27° was determined for examination of presence or absence of crystallinity. The above results are shown in Table 24E.

EXAMPLE 12E

On a substrate cylinder, an adhesion layer was formed under several preparation conditions as indicated in Table 25E, and further a light-receiving member was formed under the same preparation conditions as in Example E. Separately, samples having only adhesion layers formed were prepared. The light-receiving member was subjected to the same evaluation as in Example 1E, while a part of the sample was cut out and the diffraction pattern corresponding to Si (111) around the diffraction angle 27° was determined for examination of presence or absence of crystallinity. The above results ar shown in Table 26E.

EXAMPLE 13E

A cylinder applied with mirror surface working was further subjected to lathe working with sword bit having various angles to prepare a plural number of cylinders having a cross-sectional shape as shown in FIG. 35 and various cross-sectional patterns as shown in Table 27E. Said cylinder was successively set in the preparation device shown in FIG. 33 and subjected to drum preparation under the preparation conditions similarly as in Example 1E. The drum prepared was evaluated variously by means of an electrophotographic device of a digital exposure function with the use of a semiconductor laser having a wavelength of 780 nm as the light source to give the results shown in Table 28E.

EXAMPLE 14

The surface of the cylinder applied with mirror surface working was applied with the so called surface dimple formation treatment in which it was subsequently exposed to falling of a large number of balls for bearing to form numberless hitted marks on the cylinder surface, to prepare a plural number of cylinders having a cross-section shape as shown in FIG. 36 and various cross-section patterns as shown in Table 29E. Said cylinder was successively set in the preparation device shown in FIG. 33 and subjected to drum preparation under the preparation conditions similarly as in Example 1E. The drum prepared was evaluated variously by means of an electrophotographic device of a digital exposure function with the use of a semiconductor laser having a wavelength of 780 nm as the light source to give the results as shown in Table 30E.

EXAMPLE 1F

By use of the preparation device shown in FIG. 33, a light-receiving member for electrophotography was formed on an aluminum cylinder applied with mirror surface working following the preparation conditions in Table 1F. The light-receiving member (hereinafter expressed as drum) was set on an electrophotographic device, and, under various conditions, electrophotographic characteristics such as initial charging ability, residual potential, ghost, etc., were checked, and also lowering in charging ability, sensitivity deterioration and increase of image defects after successive copying for 1,500,000 sheets in as real machine were examined. Further, the image flow of the drum in an atmosphere of high temperature and high humidity of 35° C. and 85% was also evaluated. And, the drum completed of evaluation was cut out at the portions corresponding to the upper, middle and lower portions of the image portion to prepare samples, which were provided for quantitative analysis of hydrogen contained in the surface layer by utilization of SIMS. The above evaluation results, the maximum value of the hydrogen content in the surface layer are shown in Table 2F. As shown in Table 2F, remarkable superiority was observed in the respective items particularly of initial charging ability, image flow, residual potential, ghost, image defects and photosensitive irregularity in the axial direction, sensitivity deterioration.

COMPARATIVE EXAMPLE 1F

Except for changing the preparation conditions as shown in Table 3F, the drum and samples for analysis were prepared by the same device and method as in Example 1F and provided for the same evaluation and analysis. The results are shown in Table 4.

As can be seen from Table 4F, it was recognized that the respective items were inferior as compared with Example 1F.

Example 2F

Figure 41:
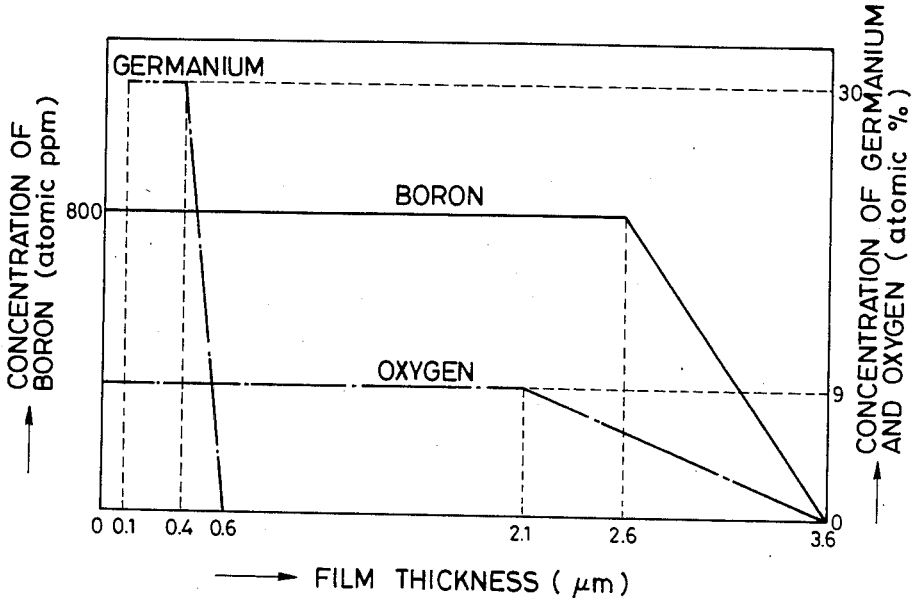

By use of the preparation device shown in FIG. 33, a light-receiving member for electrophotography was formed on an aluminum cylinder applied with mirror surface working following the preparation conditions in Table 5F. The light-receiving member (hereinafter expressed as drum) was set on an electrophotographic device, and, under various conditions, electrophotographic characteristics such as initial charging ability, residual potential, ghost, etc., were checked, and also lowering in charging ability, sensitivity deterioration and increase of image defects after successive copying for 1,500,000 sheets in a real machine were examined. Further, the image flow of the drum in an atmosphere of high temperature and high humidity of 35° C. and 85% was also evaluated. And, the drum completed of evaluation was cut out at the portions corresponding to the upper, middle and lower portions of the image portion to prepare samples, which were provided for quantitative analysis of hydrogen contained in the surface layer by utilization of SIMS, and also the component profiles in the layer direction of silicon atoms (Si), carbon atoms (C) and hydrogen atoms (H) in the surface layer were examined. Further, the component profiles of boron (B) and oxygen (O) in the charge injection preventive layer and the component profile of germanium (Ge) in the layer thickness direction in the longer wavelength absorbing layer were examined. The above evaluation results and the maximum value of the hydrogen content in the surface layer are shown in Table 6F, the component profiles of said elements in the above surface layer in FIG. 37, and the component profile of said elements in the charge injection preventive layer and the component profile of said element in the longer wavelength photosensitive layer in FIG. 41. As shown in Table 6F, remarkable superiority was observed in the respective items particularly of initial charging ability, image flow, residual potential, ghost, increase of image defects and photosensitive irregularity in the generator direction, sensitivity deterioration and increase of image defects, as well as interference fringe.

EXAMPLE 3F, COMPARATIVE EXAMPLE 2F

The preparation conditions of the surface layer were changed variously as shown in Table 7F, with other conditions being the same as in Example 1F, to prepare a plural number of drums and samples for analysis. These drums and samples were subjected to the same evaluation and analysis as in Example 1F to obtain the results as shown in Table 8F.

EXAMPLE 4

The preparation conditions of the photoconductive layer were changed to several conditions as shown in Table 9F, with other conditions being the same as in Example 1F, to prepare a plural number of drums. These drums were evaluated similarly as in Example 1F to obtain the results as shown in Table 10F.

EXAMPLE 5F

The preparation conditions of the charge injection preventive layer were changed to several conditions as shown in Table 11F, with other conditions being the same as in Example 1F, to prepare a plural number of drums. These drums were subjected to the same evaluation similarly as in Example 1F to obtain the results as shown in Table 12F.

EXAMPLE 6F

The preparation conditions of the charge injection preventive layer were changed to several conditions as shown in Table 13F, with other conditions being the same as in Example 1F, to prepare a plural number of drums. These drums were subjected to the same evaluation similarly as in Example 1F to obtain the results as shown in Table 14F.

EXAMPLE 7F

The preparation conditions of the longer wavelength absorbing layer were changed to several conditions as shown in Table 15F, with other conditions being the same as in Example 1F, to prepare a plural number of drums. These drums were subjected to the same evaluation similarly as in Example 1F to obtain the results as shown in Table 16F.

EXAMPLE 8F

The preparation conditions of the longer wavelength photosensitive layer were changed to several conditions as shown in Table 17F, with other conditions being the same as in Example 1F, to prepare a plural number of drums. These drums were subjected to the same evaluation similarly as in Example 1F to obtain the results as shown in Table 18F.

EXAMPLE 9F

On a substrate cylinder, an adhesion layer was formed under several preparation conditions as indicated in Table 19F, and further a light-receiving member was formed under the same preparation conditions as in Example 1F. These light-receiving members were subjected to the same evaluation as in Example 1F to obtain the results as shown in Table 20F.

EXAMPLE 10F

A cylinder applied with mirror surface working was further subjected to lathe working with sword bit having various angles to prepare a plural number of cylinders having a cross-sectional shape as shown in FIG. 35 and various cross-sectional patterns as shown in Table 21F. Said cylinder was successively set in the preparation device shown in FIG. 33 and subjected to drum preparation under the preparation conditions similarly as in Example 1F. The drum prepared was evaluated variously by means of an electrophotographic device of a digital exposure function with the use of a semiconductor laser having a wavelength of 780 nm as the light source to give the results shown in Table 22F.

EXAMPLE 11F

The surface of the cylinder applied with mirror surface working was applied with the so called surface dimple formation treatment in which it was subsequently exposed to falling of a large number of balls for bearing to form numberless hitted marks on the cylinder surface, to prepare a plural number of cylinders having a cross-section shape as shown in FIG. 36 and various cross-section patterns as shown in Table 23F. Said cylinder was successively set in the preparation device shown in FIG. 33 and subjected to drum preparation under the preparation conditions similarly as in Example 1F. The drum prepared was evaluated variously by means of an electrophotographic device of a digital exposure function with the use of a semiconductor laser having a wavelength of 780 nm as the light source to give the results as shown in Table 24F.

TABLE 1A

| Name of layer | Gases employed and flow rates (SCCM) | | Substrate temperature (°C.) | RF power (W) | Inner pressure (torr) | Film thickness (μm) |
|---|---|---|---|---|---|---|
| Photoconductive layer | $SiH_4$ | 200 | 250 | 300 | 0.35 | 20 |
| | $B_2H_6$ (based on $SiH_4$) | 100 ppm | | | | |
| | NO | 4 | | | | |
| Surface layer | $SiH_4$ | 200 → 10 | 250 | 300 → 200 | 0.35 → 0.45 | 1.5 |
| | $CH_4$ | 0 → 500 | | | | |
| | $H_2$ | 0 → 500 | | | | |

TABLE 2A

| Initial charging ability | Initial sensitivity | Image flow | Residual potential | Ghost | Photosensitivity irregularity in generator direction | Image defect | Sensitivity deteriora-tion | Increase of image defects | Maximum value of hydrogen content (atomic %) |
|---|---|---|---|---|---|---|---|---|---|
| ◎ | ○ | ◎ | ◎ | ◎ | ◎ | ○ | ◎ | ○ | 52 |

◎Very good
○ Good
Δ Practically acceptable
X Slightly poor in practical use
(NOTE) The above symbols◎,○, Δ and X each have the same meaning as defined above throughout all Tables.

TABLE 3A

| Name of layer | Gases employed and flow rates (SCCM) | | Substrate temperature (°C.) | RF power (W) | Inner pressure (torr) | Film thickness (μm) |
|---|---|---|---|---|---|---|
| Photoconductive layer | $SiH_4$ | 200 | 250 | 300 | 0.35 | 20 |
| | $B_2H_6$ (based on $SiH_4$) | 100 ppm | | | | |
| | NO | 4 | | | | |
| Surface layer | $SiH_4$ | 200→10 | 150 | 300→100 | 0.35→0.7 | 1.5 |
| | $CH_4$ | 0→500 | | | | |
| | $H_2$ | 0→1000 | | | | |

TABLE 4A

| Initial charging ability | Initial sensitivity | Image flow | Residual potential | Ghost | Photosensitivity irregularity in generator direction | Image defect | Sensitivity deteriora-tion | Increase of image defects | Maximum value of hydrogen content (atomic %) |
|---|---|---|---|---|---|---|---|---|---|
| X | ○ | ○ | X | Δ | Δ | X | ○ | X | 87 |

TABLE 5A

| Drum No. | A201 | | A202 | | | A203 | | A204 | | |
|---|---|---|---|---|---|---|---|---|---|---|
| Flow rate (SCCM) | $SiH_4$ | 200 → 10 | $SiH_4$ | 200 → 10 | $SiH_4$ 10 | $SiH_4$ | 300 → 10 | $SiH_4$ | 150 → 10 | $SiH_4$ 10 |
| | $CH_4$ | 0 → 500 | $CH_4$ | 0 → 500 | $CH_4$ 500 | $CH_4$ | 0 → 600 | $CH_4$ | 0 → 400 | $CH_4$ 400 |
| | $H_2$ | 0 → 400 | $H_2$ | 0 → 500 | $H_2$ 500 | $H_2$ | 0 → 700 | $H_2$ | 0 → 700 | $H_2$ 700 |
| Substrate temperature (°C.) | 200 | | 250 | | | 250 | | 250 | | |
| RF power (W) | 300 → 150 | | 300 → 200 | | 200 | 300 → 200 | | 300 → 200 | | 200 |
| Inner pressure | 0.35 → 0.42 | | 0.35 → 0.45 | | 0.45 | 0.4 → 0.5 | | 0.32 → 0.46 | | 0.46 |

TABLE 5A-continued

| | | | | | | | | | | | | |
|---|---|---|---|---|---|---|---|---|---|---|---|---|
| (torr) Film thickness (μm) | 1.5 | | 1 | | 0.5 | | 1.5 | | 1 | | 0.5 | |
| | Drum No. | A205 | | | | A206 | | | | Comparative example 2A | | |
| | Flow rate (SCCM) | $SiH_2$ | 200 → 10 | $SiH_4$ | 200 → 10 | $SiH_4$ | 10 | $SiH_4$ | 200 → 10 | | | |
| | | $C_2H_4$ | 0 → 500 | $CH_4$ | 0 → 500 | $CH_4$ | 500 | $CH_4$ | 0 → 500 | | | |
| | | $H_2$ | 0 → 700 | $H_2$ | 0 → 500 | $H_2$ | 500 | $H_2$ | 0 → 800 | | | |
| | Substrate temperature (°C.) | 250 | | | 250 | | | 150 | | | | |
| | RF power (W) | 300 → 200 | | 300 → 200 | | 200 | | 300 → 200 | | | | |
| | Inner pressure (torr) | 0.35 → 0.45 | | 0.35 → 0.46 | | 0.46 | | 0.35 → 0.65 | | | | |
| | Film thickness (μm) | 1.5 | | 1 | | 0.5 | | 1.5 | | | | |

TABLE 6A

| Drum No. | Initial charging ability | Initial sensitivity | Image flow | Residual potential | Ghost | Photosensitivity irregularity in generator direction | Image defect | Sensitivity deterioration | Increase of image defects | Sample No. | Maximum value of hydrogen content (atomic %) |
|---|---|---|---|---|---|---|---|---|---|---|---|
| A201 | ○ | ○ | ○ | ◎ | ○ | ◎ | ○ | ◎ | ○ | A201-1 | 48 |
| A202 | ◎ | ○ | ◎ | ◎ | ◎ | ◎ | ○ | ◎ | ○ | A202-1 | 58 |
| A203 | ○ | ○ | ◎ | ○ | ◎ | ○ | ○ | ○ | ○ | A203-1 | 62 |
| A204 | ○ | ○ | ◎ | ○ | ◎ | ○ | ○ | ○ | ○ | A204-1 | 63 |
| A205 | ○ | ○ | ○ | ○ | ○ | ◎ | ○ | ◎ | ○ | A205-1 | 68 |
| A206 | ◎ | ○ | ◎ | ◎ | ◎ | ◎ | ○ | ◎ | ○ | A206-1 | 55 |
| Comparative example 2A | X | ○ | ○ | X | Δ | Δ | X | ○ | X | Comparative example 2-1A | 85 |

TABLE 7A

| Drum No. | A301 | A302 | A303 | A304 | A305 |
|---|---|---|---|---|---|
| Flow rate (SCCM) | $SiH_4$ 200<br>NO 5 | $SiH_4$ 350<br>$H_2$ 350<br>NO 5 | $SiH_4$ 350<br>Ar 350<br>NO 7 | $SiH_4$ 350<br>He 350<br>NO 5 | $SiH_4$ 250<br>$SiF_4$ 100<br>$H_2$ 300<br>NO 3 |
| Substrate temperature (°C.) | 250 | 250 | 250 | 250 | 250 |
| RF power (W) | 200 | 300 | 250 | 300 | 350 |
| Inner pressure (torr) | 0.3 | 0.45 | 0.45 | 0.45 | 0.45 |
| Film thickness (μm) | 20 | 20 | 20 | 20 | 20 |

TABLE 8A

| Drum No. | Initial charging ability | Initial sensitivity | Image flow | Residual potential | Ghost | Photosensitivity irregularity in generator direction | Image defect | Sensitivity deterioration | Increase of image defects |
|---|---|---|---|---|---|---|---|---|---|
| A301 | ○ | ◎ | ◎ | ○ | ○ | ◎ | ◎ | ◎ | ○ |
| A302 | ◎ | ○ | ◎ | ◎ | ◎ | ◎ | ○ | ◎ | ○ |
| A303 | ◎ | ○ | ○ | ◎ | ◎ | ○ | ○ | ○ | ○ |
| A304 | ○ | ◎ | ○ | ◎ | ◎ | ○ | ○ | ○ | ○ |
| A305 | ○ | ○ | ○ | ○ | ○ | ◎ | ○ | ◎ | Δ |

TABLE 9A

| Drum No. | A401 | A402 | A403 | A404 | A405 |
|---|---|---|---|---|---|
| Flow rate (SCCM) | $SiH_4$ 200<br>$B_2H_6$ 100 ppm | $SiH_4$ 350<br>$H_2$ 350 | $SiH_4$ 350<br>Ar 350 | $SiH_4$ 350<br>He 350 | $SiH_4$ 200<br>$SiF_4$ 100 |

TABLE 9A-continued

| Drum No. | A401 | A402 | A403 | A404 | A405 |
|---|---|---|---|---|---|
| | (based on $SiH_4$) NO 4 | $B_2H_6$ 200 ppm (based on $SiH_4$) NO 6 | $B_2H_6$ 200 ppm (based on $SiH_4$) NO 6 | $B_2H_6$ 200 ppm (based on $SiH_4$) NO 6 | $H_2$ 300 $B_2H_6$ 150 ppm (based on $SiH_4$) NO 6 |
| Substrate temperature (°C.) | 250 | 250 | 250 | 250 | 250 |
| RF power (W) | 200 | 300 | 250 | 300 | 350 |
| Inner pressure (torr) | 0.3 | 0.45 | 0.45 | 0.45 | 0.45 |
| Film thickness (μm) | 20 | 20 | 20 | 20 | 20 |

TABLE 10A

| Drum No. | Initial charging ability | Initial sensitivity | Image flow | Residual potential | Ghost | Photosensitivity irregularity in generator direction | Image defect | Sensitivity deterioration | Increase of image defects |
|---|---|---|---|---|---|---|---|---|---|
| A401 | ○ | ○ | ◎ | ○ | ○ | ◎ | ◎ | ◎ | ○ |
| A402 | ○ | ○ | ◎ | ◎ | ◎ | ○ | ○ | ◎ | ○ |
| A403 | ◎ | ○ | ○ | ◎ | ○ | ◎ | ○ | ◎ | ○ |
| A404 | ○ | ◎ | ○ | ◎ | ◎ | ○ | ○ | ○ | ○ |
| A405 | ◎ | ○ | ○ | ○ | ○ | ◎ | ○ | ◎ | Δ |

TABLE 11A

| Drum No. | A501 | A502 | A503 |
|---|---|---|---|
| Flow rate (SCCM) | $SiH_4$ 50 $H_2$ 600 $NH_3$ 500 | $SiH_4$ 50 $H_2$ 600 NO 500 | $SiH_4$ 50 $H_2$ 600 $N_2$ 500 |
| Substrate temperature (°C.) | 350 | 350 | 350 |
| RF power (W) | 1000 | 1000 | 1000 |
| Inner pressure (torr) | 0.6 | 0.6 | 0.5 |
| Film thickness (μm) | 0.1 | 0.1 | 0.1 |

TABLE 13A-continued

| Drum No. | A601 | A602 | A603 |
|---|---|---|---|
| (SCCM) | $NH_3$ 500 | NO 500 | $N_2$ 500 |
| Substrate temperature (°C.) | 250 | 250 | 250 |
| RF power (W) | 150 | 200 | 200 |
| Inner pressure (torr) | 0.3 | 0.3 | 0.3 |
| Film thickness (μm) | 0.1 | 0.1 | 0.1 |

TABLE 14A

| Drum No. | Initial charging ability | Intial sensitivity | Image flow | Residual potential | Ghost | Photosensitivity irregularity in generator direction | Image defect | Sensitivity deterioration | Increase of image defects | Sample No. | Presence of crystallinity |
|---|---|---|---|---|---|---|---|---|---|---|---|
| A601 | ○ | ○ | ◎ | ◎ | ◎ | ◎ | ○ | ◎ | ○ | A601-1 | None |
| A602 | ◎ | ○ | ◎ | ◎ | ◎ | ◎ | ◎ | ◎ | ◎ | A602-1 | None |
| A603 | ◎ | ○ | ○ | ○ | ◎ | ◎ | ◎ | ◎ | ◎ | A603-1 | None |

TABLE 12A

| Drum No. | Initial charging ability | Intial sensitivity | Image flow | Residual potential | Ghost | Photosensitivity irregularity in generator direction | Image defect | Sensitivity deterioration | Increase of image defects | Sample No. | Presence of crystallinity |
|---|---|---|---|---|---|---|---|---|---|---|---|
| A501 | ◎ | ○ | ◎ | ◎ | ◎ | ◎ | ◎ | ◎ | ◎ | A501-1 | Observed |
| A502 | ◎ | ○ | ○ | ◎ | ◎ | ◎ | ◎ | ◎ | ◎ | A502-1 | " |
| A503 | ○ | ○ | ◎ | ○ | ◎ | ◎ | ◎ | ◎ | ◎ | A503-1 | " |

TABLE 13A

| Drum No. | A601 | A602 | A603 |
|---|---|---|---|
| Flow rate | $SiH_4$ 50 | $SiH_4$ 50 | $SiH_4$ 50 |

TABLE 15A

| Drum No. | A701 | A702 | A703 | A704 | A705 |
|---|---|---|---|---|---|
| a (μm) | 25 | 50 | 50 | 12 | 12 |
| b (μm) | 0.8 | 2.5 | 0.8 | 1.5 | 0.3 |

TABLE 16A

| Drum No. | Initial charging ability | Initial sensitivity | Image flow | Interference fringe | Residual potential | Ghost | Photosensitivity irregularity in generator direction | Image defect | Sensitivity deterioration | Increase of image defects | Resolving power of image |
|---|---|---|---|---|---|---|---|---|---|---|---|
| A701 | ◎ | ○ | ◎ | Δ | ◎ | ◎ | ◎ | ○ | ◎ | Δ | ○ |
| A702 | ◎ | ○ | ◎ | ○ | ◎ | ◎ | ◎ | ○ | ◎ | ○ | Δ |
| A703 | ◎ | ○ | ◎ | Δ | ◎ | ◎ | ◎ | ○ | ◎ | ○ | Δ |
| A704 | ◎ | ○ | ◎ | ○ | ◎ | ◎ | ◎ | Δ | ◎ | ○ | ○ |
| A705 | ◎ | ○ | ◎ | Δ | ◎ | ◎ | ◎ | Δ | ◎ | Δ | Δ |

TABLE 17A

| Drum No. | A801 | A802 | A803 | A804 | A805 |
|---|---|---|---|---|---|
| c (μm) | 50 | 100 | 100 | 30 | 30 |

TABLE 17A-continued

| Drum No. | A801 | A802 | A803 | A804 | A805 |
|---|---|---|---|---|---|
| d (μm) | 2 | 5 | 1.5 | 2.5 | 0.7 |

TABLE 18A

| Drum No. | Initial charging ability | Initial sensitivity | Image flow | Interference fringe | Residual potential | Ghost | Photosensitivity irregularity in generator direction | Image defect | Sensitivity deterioration | Increase of image defects | Resolving power of image |
|---|---|---|---|---|---|---|---|---|---|---|---|
| A801 | ◎ | ○ | ◎ | Δ~○ | ◎ | ◎ | ◎ | ○ | ◎ | Δ | Δ |
| A802 | ◎ | ○ | ◎ | ○ | ◎ | ◎ | ◎ | Δ | ◎ | ○ | Δ |
| A803 | ◎ | ○ | ◎ | Δ | ◎ | ◎ | ◎ | ○ | ◎ | ○ | Δ |
| A804 | ◎ | ○ | ◎ | ○ | ◎ | ◎ | ◎ | Δ | ◎ | Δ | ○ |
| A805 | ◎ | ○ | ◎ | Δ~○ | ◎ | ◎ | ◎ | Δ | ◎ | ○ | Δ~○ |

TABLE 1B

| Name of layer | Gases employed and flow rates (SCCM) | | Substrate temperature (°C.) | RF power (W) | Inner pressure (torr) | Film thickness (μm) |
|---|---|---|---|---|---|---|
| Charge injection preventive layer | $SiH_4$ | 150 | 350 | 1500 | 0.5 | 1 |
| | $B_2H_6$ (based on $SiH_4$) | 1000 ppm | | | | |
| | NO | 10 | | | | |
| | $H_2$ | 500 | | | | |
| Photoconductive layer | $SiH_4$ | 350 | 250 | 300 | 0.4 | 20 |
| | $H_2$ | 350 | | | | |
| Surface layer | $SiH_4$ | 350→10 | 250 | 300→200 | 0.4→0.45 | 1.5 |
| | $CH_4$ | 0→500 | | | | |
| | $H_2$ | 350→500 | | | | |

TABLE 2B

| Initial charging ability | Initial sensitivity | Image flow | Residual potential | Ghost | Photosensitivity irregularity in generator direction | Image defect | Sensitivity deterioration | Increase of image defects | Maximum value of hydrogen content (atomic %) | Presence of crystallinity |
|---|---|---|---|---|---|---|---|---|---|---|
| ◎ | | ○ | ◎ | ◎ | ◎ | ○ | ◎ | ◎ | 52 | Observed |

TABLE 3B

| Name of layer | Gases employed and flow rates (SCCM) | | Substrate temperature (°C.) | RF power (W) | Inner pressure (torr) | Film thickness (μm) |
|---|---|---|---|---|---|---|
| Charge injection preventive layer | $SiH_4$ | 150 | 350 | 1500 | 0.5 | 1 |
| | $B_2H_6$ (based on $SiH_4$) | 1000 ppm | | | | |
| | NO | 10 | | | | |
| | $H_2$ | 500 | | | | |
| Photoconductive layer | $SiH_4$ | 350 | 250 | 300 | 0.4 | 20 |
| | $H_2$ | 350 | | | | |
| Surface layer | $SiH_4$ | 350→10 | 150 | 300→100 | 0.4→0.7 | 1.5 |
| | $CH_4$ | 0→500 | | | | |
| | $H_2$ | 350→1000 | | | | |

TABLE 4B

| Initial charging ability | Initial sensitivity | Image flow | Residual potential | Ghost | Photosensitivity irregularity in generator direction | Image defect | Sensitivity deterioration | Increase of image defects | Maximum value of hydrogen content (atomic %) | Presence of crystallinity |
|---|---|---|---|---|---|---|---|---|---|---|
| X | O | O | X | Δ | Δ | X | O | X | 87 | Observed |

TABLE 5B

| Name of layer | Gases employed and flow rates (SCCM) | | Substrate temperature (°C.) | RF power (W) | Inner pressure (torr) | Film thickness (μm) |
|---|---|---|---|---|---|---|
| Charge injection preventive layer | $SiH_4$ | 150 | 350 | 1500 | 0.5 | 1 |
| | $B_2H_6$ (based on $SiH_4$) | 1000 ppm | | | | |
| | NO | →0 | | | | |
| | $H_2$ | 10→0 | | | | |
| | | 500 | | | | |
| Photoconductive layer | $SiH_4$ | 350 | 250 | 300 | 0.4 | 20 |
| | $H_2$ | 350 | | | | |
| Surface layer | $SiH_4$ | 350→10 | 250 | 300→200 | 0.4→0.41 | 1.5 |
| | $CH_4$ | 0→400 | | | | |
| | $H_2$ | 350→400 | | | | |

TABLE 6B

| Initial charging ability | Initial sensitivity | Image flow | Residual potential | Ghost | Photosensitivity irregularity in generator direction | Image defect | Sensitivity deterioration | Increase of image defects | Maximum value of hydrogen content (atomic %) | Presence of crystallinity |
|---|---|---|---|---|---|---|---|---|---|---|
| ◎ | O | ◎ | ◎ | ◎ | ◎ | O | ◎ | ◎ | 46 | Observed |

TABLE 7B

| Drum No. | B301 | B302 | B303 | B304 |
|---|---|---|---|---|
| Flow rate (SCCM) | $SiH_4$ 200 → 10<br>$CH_4$ 0 → 500<br>$H_2$ 0 → 400 | $SiH_4$ 200 → 10<br>$CH_4$ 0 → 500<br>$H_2$ 0 → 500 | $SiH_4$ 10<br>$CH_4$ 500<br>$H_2$ 500 | $SiH_4$ 300 → 10<br>$CH_4$ 0 → 600<br>$H_2$ 0 → 700 |
| | $SiH_4$ 150 → 10<br>$CH_4$ 0 → 400<br>$H_2$ 0 → 700 | $SiH_4$ 10<br>$CH_4$ 400<br>$H_2$ 700 | | |
| Substrate temperature (°C.) | 200 | 250 | 250 | 250 |
| RF power (W) | 300 → 150 | 300 → 200 | 200 | 300 → 200 |
| | 300 → 200 | 200 | | |
| Inner pressure (torr) | 0.35 → 0.42 | 0.35 → 0.45 | 0.45 | 0.4 → 0.5 |
| | 0.32 → 0.46 | 0.46 | | |
| Film thickness (μm) | 1.5 | 1 | 0.5 | 1.5 |
| | 1 | 0.5 | | |

| Drum No. | B305 | B306 | Comparative example 2B |
|---|---|---|---|
| Flow rate (SCCM) | $SiH_4$ 200 → 10<br>$C_2H_4$ 0 → 500<br>$H_2$ 0 → 700 | $SiH_4$ 200 → 10<br>$CH_4$ 0 → 500<br>$H_2$ 0 → 500 | $SiH_4$ 10<br>$CH_4$ 500<br>$H_2$ 500 |
| | $SiH_4$ 200 → 10<br>$CH_4$ 0 → 500<br>$H_2$ 0 → 800 | | |
| Substrate temperature (°C.) | 250 | 250 | 150 |
| RF power (W) | 300 → 200 | 300 → 200 | 200 |
| | 300 → 200 | | |
| Inner pressure (torr) | 0.35 → 0.45 | 0.35 → 0.46 | 0.46 |
| | 0.35 → 0.65 | | |
| Film thickness (μm) | 1.5 | 1 | 0.5 |
| | 1.5 | | |

TABLE 8B

| Drum No. | Initial charging ability | Initial sensitivity | Image flow | Residual potential | Ghost | Photosensitivity irregularity in generator direction | Image defect | Sensitivity deterioration | Increase of image defects | Sample No. | Maximum value of hydrogen content (atomic %) |
|---|---|---|---|---|---|---|---|---|---|---|---|
| B301 | ◎ | O | O | ◎ | O | O | ◎ | ◎ | ◎ | B301-1 | 48 |
| B302 | ◎ | O | ◎ | ◎ | ◎ | O | O | O | ◎ | B302-1 | 58 |
| B303 | O | O | ◎ | O | ◎ | ◎ | O | O | O | B303-1 | 63 |
| B304 | O | O | ◎ | O | ◎ | ◎ | O | O | ◎ | B304-1 | 64 |

TABLE 8B-continued

| Drum No. | Initial charging ability | Initial sensitivity | Image flow | Residual potential | Ghost | Photosensitivity irregularity in generator direction | Image defect | Sensitivity deterioration | Increase of image defects | Sample No. | Maximum value of hydrogen content (atomic %) |
|---|---|---|---|---|---|---|---|---|---|---|---|
| B305 | | | | | | | | | | B305-1 | 68 |
| B306 | | | | | | | | | | B306-1 | 55 |
| Comparative example 2B | X | ○ | ○ | X | Δ | Δ | X | ○ | Δ | Comparative example 2-1B | 85 |

TABLE 9B

| Drum No. | B401 | B402 | B403 | B404 | B405 | B406 |
|---|---|---|---|---|---|---|
| Flow rate (SCCM) | $SiH_4$ 350<br>$H_2$ 350 | $SiH_4$ 200<br>$H_2$ 600 | $SiH_4$ 350<br>$H_2$ 350<br>$B_2H_6$ 0.3 ppm (based on $SiH_4$) | $SiH_4$ 350<br>Ar 350 | $SiH_4$ 350<br>He 350<br>$B_2H_6$ 0.3 ppm (based on $SiH_4$) | $SiH_4$ 200<br>$SiH_4$ 100<br>$H_2$ 300 |
| Substrate temperature (°C.) | 250 | 250 | 250 | 250 | 250 | 250 |
| RF power (W) | 200 | 400 | 300 | 250 | 300 | 400 |
| Inner pressure (torr) | 0.4 | 0.42 | 0.4 | 0.4 | 0.4 | 0.38 |
| Film thickness (μm) | 20 | 20 | 20 | 20 | 20 | 20 |

TABLE 10B

| Drum No. | Initial charging ability | Initial sensitivity | Image flow | Residual potential | Ghost | Photosensitivity irregularity in generator direction | Image defect | Sensitivity deterioration | Increase of image defects |
|---|---|---|---|---|---|---|---|---|---|
| B401 | ◎ | ○ | ◎ | ◎ | ◎ | ◎ | ○ | ◎ | ◎ |
| B402 | ◎ | ○ | ◎ | ◎ | ◎ | ◎ | ◎ | ◎ | ◎ |
| B403 | ○ | ○ | ◎ | ◎ | ◎ | ◎ | ○ | ◎ | ◎ |
| B404 | ◎ | ○ | ◎ | ◎ | ◎ | ◎ | ○ | ◎ | ○ |
| B405 | ○ | ○ | ◎ | ◎ | ◎ | ◎ | ○ | ◎ | ○ |
| B406 | ◎ | ○ | ◎ | ◎ | ◎ | ◎ | ○ | ◎ | ○ |

TABLE 11B

| Drum No. | B501 | B502 | B503 | B504 | B505* | B506 |
|---|---|---|---|---|---|---|
| Flow rate (SCCM) | $SiH_4$ 150<br>$B_2H_6$ 500 ppm (based on $SiH_4$)<br>NO 10<br>$H_2$ 500 | $SiH_4$ 150<br>$B_2H_6$ 100 ppm (based on $SiH_4$)<br>NO 5<br>$H_2$ 700 | $SiH_4$ 150<br>$PH_3$ 100 ppm (based on $SiH_4$)<br>NO 5<br>$H_2$ 700 | $SiH_4$ 150<br>$B_2H_6$ 500 ppm (based on $SiH_4$)<br>NO 10<br>Ar 500 | $SiH_4$ 150<br>$B_2H_6$ 1000 ppm (based on $SiH_4$)<br>NO 10<br>He 500 | $SiH_4$ 100<br>$SiF_4$ 50<br>$B_2H_6$ 500 ppm (based on $SiH_4$)<br>NO 10<br>$H_2$ 500 |
| Substrate temperature (°C.) | 300 | 350 | 350 | 350 | 350 | 350 |
| RF power (W) | 1200 | 1200 | 1200 | 1500 | 1500 | 1500 |
| Inner pressure (torr) | 0.5 | 0.5 | 0.5 | 0.5 | 0.5 | 0.5 |
| Film thickness (μm) | 1 | 1 | 1 | 1 | 1 | 0.8 |

*Only the preparation conditions for photoconductive layer are the same as drum No. B405.

TABLE 12B

| Drum No. | Initial charging ability | Initial sensitivity | Image flow | Residual potential | Ghost | Photosensitivity irregularity in generator direction | Image defect | Sensitivity deterioration | Increase of image defects | Remark | Sample No. | Presence of crystallinity |
|---|---|---|---|---|---|---|---|---|---|---|---|---|
| B501 | ◎ | ○ | ○ | ◎ | ◎ | ◎ | ◎ | ◎ | ◎ | | A501-1 | Observed |
| B502 | ○ | ○ | ◎ | ◎ | ◎ | ○ | ○ | ○ | ◎ | | A502-1 | " |
| B503 | ◎ | ○ | ◎ | ◎ | ○ | ○ | ○ | ◎ | ○ | (—) charged | A503-1 | " |

TABLE 12B-continued

| Drum No. | Initial charging ability | Initial sensitivity | Image flow | Residual potential | Ghost | Photosensitivity irregularity in generator direction | Image defect | Sensitivity deterioration | Increase of image defects | Remark | Sample No. | Presence of crystallinity |
|---|---|---|---|---|---|---|---|---|---|---|---|---|
| B504 | ◉ | ○ | ○ | ◎ | ◎ | ◎ | ○ | ○ | ○ | | A504-1 | " |
| B505 | ○ | ○ | ◎ | ◎ | ◎ | ◎ | ○ | ◎ | ◎ | | A505-1 | " |
| B506 | ◎ | ○ | ○ | ◎ | ○ | ◎ | ○ | ◎ | ○ | | A506-1 | " |

TABLE 13B

| Drum No. | B601 | B602 | B603 | B604 | B605* | B606 |
|---|---|---|---|---|---|---|
| Flow rate (SCCM) | $SiH_4$ 150<br>$B_2H_6$ 500 ppm → 0 (based on $SiH_4$)<br>NO 10 → 0<br>$H_2$ 500 | $SiH_4$ 150<br>$B_2H_6$ 100 ppm → 0 (based on $SiH_4$)<br>NO 5 → 0<br>$H_2$ 700 | $SiH_4$ 150<br>$PH_3$ 100 ppm → 0 (based on $SiH_4$)<br>NO 5 → 0<br>$H_2$ 700 | $SiH_4$ 150<br>$B_2H_6$ 500 ppm → 0 (based on $SiH_4$)<br>NO 10 → 0<br>Ar 500 | $SiH_4$ 150<br>$B_2H_6$ 1000 ppm → 0 (based on $SiH_4$)<br>NO 10 → 0<br>He 500 | $SiH_4$ 100<br>$SiF_4$ 50<br>$B_2H_6$ 500 ppm → 0 (based on $SiH_4$)<br>NO 10 → 0<br>$H_2$ 500 |
| Substrate temperature (°C.) | 350 | 350 | 350 | 350 | 350 | 350 |
| RF power (W) | 1200 | 1200 | 1200 | 1500 | 1500 | 1500 |
| Inner pressure (torr) | 0.5 | 0.5 | 0.5 | 0.5 | 0.5 | 0.5 |
| Film thickness (μm) | 1 | 1 | 1 | 1 | 1 | 0.8 |

*Only the preparation conditions for photoconductive layer are the same as drum No. B405.

TABLE 14B

| Drum No. | Initial charging ability | Initial sensitivity | Image flow | Residual potential | Ghost | Photosensitivity irregularity in generator direction | Image defect | Sensitivity deterioration | Increase of image defects | Sample No. | Presence of crystallinity |
|---|---|---|---|---|---|---|---|---|---|---|---|
| B601 | ◉ | ○ | ○ | ◎ | ◎ | ◎ | ◎ | ◎ | ◎ | B601-1 | Observed |
| B602 | ○ | ○ | ◉ | ◎ | ◎ | ○ | ○ | ○ | ◎ | B602-1 | " |
| B603 | ○ | ○ | ◉ | ◎ | ◎ | ○ | ○ | ◎ | ○ | B603-1 | " |
| B604 | ◉ | ○ | ○ | ◎ | ◎ | ◎ | ◎ | ○ | ◎ | B604-1 | " |
| B605 | ○ | ○ | ◉ | ◎ | ◎ | ◎ | ○ | ◎ | ◎ | B605-1 | " |
| B606 | ◉ | ○ | ○ | ◎ | ○ | ◎ | ○ | ◎ | ○ | B606-1 | " |

TABLE 15B

| Drum No. | B701 | B702 | B703 |
|---|---|---|---|
| Flow rate (SCCM) | $SiH_4$ 150<br>$H_2$ 600<br>$NH_3$ 500 | $SiH_4$ 50<br>$H_2$ 600<br>NO 500 | $SiH_4$ 50<br>$H_2$ 600<br>$N_2$ 500 |
| Substrate temperature (°C.) | 350 | 350 | 350 |
| RF power (W) | 1000 | 1000 | 1000 |
| Inner pressure (torr) | 0.6 | 0.6 | 0.5 |
| Film thickness (μm) | 0.1 | 0.1 | 0.1 |

TABLE 17B

| Drum No. | B801 | B802 | B803 |
|---|---|---|---|
| Flow rate (SCCM) | $SiH_4$ 50<br>$NH_3$ 500 | $SiH_4$ 50<br>NO 500 | $SiH_4$ 50<br>$N_2$ 500 |
| Substrate temperature (°C.) | 250 | 250 | 250 |
| RF power (W) | 150 | 200 | 200 |
| Inner pressure (torr) | 0.3 | 0.3 | 0.3 |
| Film thickness (μm) | 0.1 | 0.1 | 0.1 |

TABLE 16B

| Drum No. | Initial charging ability | Initial sensitivity | Image flow | Residual potential | Ghost | Photosensitivity irregularity in generator direction | Image defect | Sensitivity deterioration | Increase of image defects | Sample No. | Presence of crystallinity |
|---|---|---|---|---|---|---|---|---|---|---|---|
| B701 | ◎ | ○ | ◎ | ◎ | ◎ | ◎ | ◎ | ◎ | ◎ | B701-1 | Observed |
| B702 | ◎ | ○ | ○ | ◎ | ◎ | ◎ | ◎ | ◎ | ◎ | B702-1 | " |
| B703 | ◎ | ○ | ◎ | ◎ | ◎ | ◎ | ◎ | ◎ | ◎ | B703-1 | " |

TABLE 18B

| Drum No. | Initial charging ability | Initial sensitivity | Image flow | Residual potential | Ghost | Photosensitivity irregularity in generator direction | Image defect | Sensitivity deterioration | Increase of image defects | Sample No. | Presence of crystallinity |
|---|---|---|---|---|---|---|---|---|---|---|---|
| B801 | ◎ | ○ | ◎ | ○ | ◎ | ◎ | ◎ | ◎ | ◎ | B801-1 | None |
| B802 | ◎ | ○ | ◎ | ○ | ◎ | ◎ | ◎ | ◎ | ◎ | B802-1 | None |
| B803 | ◎ | ○ | ○ | ○ | ◎ | ◎ | ◎ | ◎ | ◎ | B803-1 | None |

TABLE 19B

| Drum No. | B901 | B902 | B903 | B904 | B905 |
|---|---|---|---|---|---|
| a (μm) | 25 | 50 | 50 | 12 | 12 |
| b (μm) | 0.8 | 2.5 | 0.8 | 1.5 | 0.3 |

TABLE 21B

| Drum No. | B1001 | B1002 | B1003 | B1004 | B1005 |
|---|---|---|---|---|---|
| c (μm) | 50 | 100 | 100 | 30 | 30 |
| d (μm) | 2 | 5 | 1.5 | 2.5 | 0.7 |

TABLE 20B

| Drum No. | Initial charging ability | Initial sensitivity | Image flow | Interference fringe | Residual potential | Ghost | Photosensitivity irregularity in generator direction | Image defect | Sensitivity deterioration | Increase of image defects | Resolving power of image |
|---|---|---|---|---|---|---|---|---|---|---|---|
| B901 | ◎ | ○ | ◎ | ○ | ◎ | ◎ | ◎ | ◎ | ◎ | ◎ | ○ |
| B902 | ◎ | ○ | ◎ | ○ | ◎ | ◎ | ◎ | ○ | ◎ | ◎ | ○ |
| B903 | ◎ | ○ | ◎ | Δ | ◎ | ◎ | ◎ | ○ | ◎ | ◎ | Δ |
| B904 | ◎ | ○ | ◎ | ○ | ◎ | ◎ | ◎ | ○ | ◎ | ○ | ○ |
| B905 | ◎ | ○ | ◎ | Δ~○ | ◎ | ◎ | ◎ | ○ | ◎ | ○ | ○ |

TABLE 22B

| Drum No. | Initial charging ability | Initial sensitivity | Image flow | Interference fringe | Residual potential | Ghost | Photosensitivity irregularity in generator direction | Image defect | Sensitivity deterioration | Increase of image defects | Resolving power of image |
|---|---|---|---|---|---|---|---|---|---|---|---|
| B1001 | ◎ | ○ | ◎ | ○ | ◎ | ◎ | ◎ | ◎ | ◎ | ◎ | Δ~○ |
| B1002 | ◎ | ○ | ◎ | ○ | ◎ | ◎ | ◎ | ○ | ◎ | ◎ | Δ~○ |
| B1003 | ◎ | ○ | ◎ | Δ | ◎ | ◎ | ◎ | ○ | ◎ | ◎ | Δ |
| B1004 | ◎ | ○ | ○ | ○ | ◎ | ◎ | ◎ | ○ | ◎ | ○ | ○ |
| B1005 | ◎ | ○ | ◎ | ○ | ◎ | ◎ | ◎ | ○ | ◎ | ○ | ○ |

TABLE 1C

| Name of layer | Gases employed and flow rates (SCCM) | | Substrate temperature (°C.) | RF power (W) | Inner pressure (torr) | Film thickness (μm) |
|---|---|---|---|---|---|---|
| Charge injection preventive layer | $SiH_4$ | 150 | 250 | 150 | 0.25 | 3 |
| | $B_2H_6$ (based on $SiH_4$) | 1000 ppm | | | | |
| | NO | 10 | | | | |
| | $H_2$ | 350 | | | | |
| Photoconductive layer | $SiH_4$ | 350 | 250 | 300 | 0.4 | 20 |
| | $H_2$ | 350 | | | | |
| Surface layer | $SiH_4$ | 350→10 | 250 | 300→200 | 0.4→0.45 | 1.5 |
| | $CH_4$ | 0→500 | | | | |
| | $H_2$ | 350→500 | | | | |

TABLE 2C

| Initial charging ability | Initial sensitivity | Image flow | Residual potential | Ghost | Photosensitivity irregularity in generator direction | Image defect | Sensitivity deterioration | Increase of image defects | Maximum value of hydrogen content (atomic %) |
|---|---|---|---|---|---|---|---|---|---|
| | ◎ | ○ | ◎ | ◎ | ◎ | ◎ | ○ | ◎ | ○ | 52 |

TABLE 3C

| Name of layer | Gases employed and flow rates (SCCM) | | Substrate temperature (°C.) | RF power (W) | Inner pressure (torr) | Film thickness (μm) |
|---|---|---|---|---|---|---|
| Charge injection preventive layer | $SiH_4$ | 150 | 250 | 150 | 0.25 | 3 |
| | $B_2H_6$ (based on $SiH_4$) | 1000 ppm | | | | |
| | NO | 10 | | | | |
| | $H_2$ | 350 | | | | |
| Photoconductive layer | $SiH_4$ | 350 | 250 | 300 | 0.4 | 20 |
| | $H_2$ | 350 | | | | |
| Surface layer | $SiH_4$ | 350→10 | 150 | 300→100 | 0.4→0.7 | 1.5 |
| | $CH_4$ | 0→500 | | | | |

TABLE 3C-continued

| Name of layer | Gases employed and flow rates (SCCM) | | Substrate temperature (°C.) | RF power (W) | Inner pressure (torr) | Film thickness (μm) |
|---|---|---|---|---|---|---|
| | $H_2$ | 350→1000 | | | | |

TABLE 4C

| Initial charging ability | Initial sensitivity | Image flow | Residual potential | Ghost | Photosensitivity irregularity in generator direction | Image defect | Sensitivity deteriora-tion | Increase of image defects | Maximum value of hydrogen content (atomic %) |
|---|---|---|---|---|---|---|---|---|---|
| X | ○ | ○ | X | Δ | Δ | X | ○ | X | 87 |

TABLE 5C

| Name of layer | Gases employed and flow rates (SCCM) | | Substrate temperature (°C.) | RF power (W) | Inner pressure (torr) | Film thickness (μm) |
|---|---|---|---|---|---|---|
| Charge injec-tion preventive layer | $SiH_4$ | 150 | 250 | 150 | 0.25 | 3 |
| | $B_2H_6$ (based on $SiH_4$) | 1000 ppm | | | | |
| | NO | →0 | | | | |
| | $H_2$ | 10→0 | | | | |
| | | 350 | | | | |
| Photoconductive layer | $SiH_4$ | 350 | 250 | 300 | 0.4 | 20 |
| | $H_2$ | 350 | | | | |
| Surface layer | $SiH_4$ | 350→10 | 250 | 300→200 | 0.4→0.41 | 1.5 |
| | $CH_4$ | 0→400 | | | | |
| | $H_2$ | 350→400 | | | | |

TABLE 6C

| Initial charging ability | Initial sensitivity | Image flow | Residual potential | Ghost | Photosensitivity irregularity in generator direction | | Image defect | Sensitivity deteriora-tion | Increase of image defects | | Maximum value of hydrogen content (atomic %) |
|---|---|---|---|---|---|---|---|---|---|---|---|
| | | ◎ | ○ | ◎ | ◎ | ◎ | ◎ | ○ | ◎ | ◎ | 46 |

TABLE 7C

| Drum No. | C301 | | C302 | | | C303 | | C304 | | |
|---|---|---|---|---|---|---|---|---|---|---|
| Flow rate (SCCM) | $SiH_4$ | 200 → 10 | $SiH_4$ | 200 → 10 | $SiH_4$ 10 | $SiH_4$ | 300 → 10 | $SiH_4$ | 150 → 10 | $SiH_4$ 10 |
| | $CH_4$ | 0 → 500 | $CH_4$ | 0 → 500 | $CH_4$ 500 | $CH_4$ | 0 → 600 | $CH_4$ | 0 → 400 | $CH_4$ 400 |
| | $H_2$ | 0 → 400 | $H_2$ | 0 → 500 | $H_2$ 500 | $H_2$ | 0 → 700 | $H_2$ | 0 → 700 | $H_2$ 700 |
| Substrate temperature (°C.) | 200 | | 250 | | | 250 | | 250 | | |
| RF power (W) | 300 → 150 | | 300 → 200 | | 200 | 300 → 200 | | 300 → 200 | | 200 |
| Inner pressure (torr) | 0.35 → 0.42 | | 0.35 → 0.45 | | 0.45 | 0.4 → 0.5 | | 0.32 → 0.46 | | 0.46 |
| Film thickness (μm) | 1.5 | | 1 | | 0.5 | 1.5 | | 1 | | 0.5 |

| Drum No. | C305 | | C306 | | | Comparative example 2C | |
|---|---|---|---|---|---|---|---|
| Flow rate (SCCM) | $SiH_4$ | 200 → 10 | $SiH_4$ | 200 → 10 | $SiH_4$ 10 | $SiH_4$ | 200 → 10 |
| | $C_2H_4$ | 0 → 500 | $CH_4$ | 0 → 500 | $CH_4$ 500 | $CH_4$ | 0 → 500 |
| | $H_2$ | 0 → 700 | $H_2$ | 0 → 500 | $H_2$ 500 | $H_2$ | 0 → 800 |
| Substrate temperature (°C.) | 250 | | 250 | | | 150 | |
| RF power (W) | 300 → 200 | | 300 → 200 | | 200 | 300 → 200 | |
| Inner pressure (torr) | 0.35 → 0.45 | | 0.35 → 0.46 | | 0.46 | 0.35 → 0.65 | |
| Film thickness (μm) | 1.5 | | 1 | | 0.5 | 1.5 | |

TABLE 8C

| Drum No. | Initial charging ability | Initial sensitivity | Image flow | Residual potential | Ghost | Photosensitivity irregularity in generator direction | Image defect | Sensitivity deterioration | Increase of image defects | Sample No. | Maximum value of hydrogen content (atomic %) |
|---|---|---|---|---|---|---|---|---|---|---|---|
| C301 | ◎ | ○ | ○ | ○ | ○ | ◎ | ○ | ◎ | ○ | C301-1 | 48 |
| C302 | ◎ | ○ | ◎ | ○ | ◎ | ○ | ○ | ◎ | ○ | C302-1 | 59 |
| C303 | ○ | ○ | ◎ | ○ | ◎ | ◎ | ○ | ○ | ○ | C303-1 | 62 |
| C304 | ○ | ○ | ◎ | ○ | ◎ | ◎ | ○ | ◎ | ○ | C304-1 | 64 |
| C305 | ○ | ○ | ◎ | ○ | ◎ | ○ | ○ | ○ | ○ | C305-1 | 69 |
| C306 | ◎ | ○ | ○ | ◎ | ○ | ◎ | ○ | ◎ | ○ | C306-1 | 55 |
| Comparative example 2C | X | ○ | ○ | X | Δ | Δ | X | ○ | X | Comparative example 2-1C | 85 |

TABLE 9C

| Drum No. | C401 | C402 | C403 | C404 | C405 | C406 |
|---|---|---|---|---|---|---|
| Flow rate (SCCM) | $SiH_4$ 350<br>$H_2$ 350 | $SiH_4$ 200<br>$H_2$ 600 | $SiH_4$ 350<br>$H_2$ 350<br>$B_2H_6$ 0.3 ppm (based on $SiH_4$) | $SiH_4$ 350<br>Ar 350 | $SiH_4$ 350<br>He 350<br>$B_2H_6$ 0.3 ppm (based on $SiH_4$) | $SiH_4$ 200<br>$SiF_4$ 100<br>$H_2$ 300 |
| Substrate temperature (°C.) | 250 | 250 | 250 | 250 | 250 | 250 |
| RF power (W) | 200 | 400 | 300 | 250 | 300 | 400 |
| Inner pressure (torr) | 0.4 | 0.42 | 0.4 | 0.4 | 0.4 | 0.38 |
| Film thickness (μm) | 20 | 20 | 20 | 20 | 20 | 20 |

TABLE 10C

| Drum No. | Initial charging ability | Initial sensitivity | Image flow | Residual potential | Ghost | Photosensitivity irregularity in generator direction | Image defect | Sensitivity deterioration | Increase of image defects |
|---|---|---|---|---|---|---|---|---|---|
| C401 | ○ | ◎ | ◎ | ◎ | ◎ | ◎ | ○ | ◎ | ○ |
| C402 | ◎ | ○ | ◎ | ◎ | ◎ | ◎ | ○ | ◎ | ○ |
| C403 | ○ | ○ | ◎ | ◎ | ◎ | ◎ | ○ | ◎ | ○ |
| C404 | ◎ | ○ | ◎ | ◎ | ◎ | ◎ | ○ | ◎ | ○ |
| C405 | ○ | ○ | ◎ | ◎ | ◎ | ◎ | ○ | ◎ | ○ |
| C406 | ◎ | ○ | ◎ | ◎ | ◎ | ◎ | ○ | ◎ | ○ |

TABLE 11C

| Drum No. | C501 | C502 | C503 | C504 | C505 | C506 |
|---|---|---|---|---|---|---|
| Flow rate (SCCM) | $SiH_4$ 150<br>$B_2H_6$ 500 ppm (based on $SiH_4$)<br>NO 10<br>$H_2$ 350 | $SiH_4$ 150<br>$B_2H_6$ 100 ppm (based on $SiH_4$)<br>NO 5<br>$H_2$ 350 | $SiH_4$ 150<br>$PH_3$ 100 ppm (based on $SiH_4$)<br>NO 5<br>$H_2$ 350 | $SiH_4$ 150<br>$B_2H_6$ 500 ppm (based on $SiH_4$)<br>NO 10<br>Ar 350 | $SiH_4$ 150<br>$B_2H_6$ 1000 ppm (based on $SiH_4$)<br>NO 10<br>He 350 | $SiH_4$ 100<br>$SiF_4$ 50<br>$B_2H_6$ 500 ppm (based on $SiH_4$)<br>NO 10<br>$H_2$ 350 |
| Substrate temperature (°C.) | 250 | 250 | 250 | 250 | 250 | 250 |
| RF power (W) | 150 | 150 | 150 | 150 | 150 | 150 |
| Inner pressure (torr) | 0.25 | 0.25 | 0.25 | 0.25 | 0.25 | 0.25 |
| Film thickness (μm) | 3 | 3 | 3 | 3 | 3 | 2.7 |
| Remark | | | | | Only the photoconductive layer condition is the same as drum No. C405. | |

TABLE 12C

| Drum No. | Initial charging ability | Initial sensitivity | Image flow | Residual potential | Ghost | Photosensitivity irregularity in generator direction | Image defect | Sensitivity deterioration | Increase of image defects | Remark |
|---|---|---|---|---|---|---|---|---|---|---|
| C501 | ◎ | ○ | ○ | ◎ | ◎ | ○ | ○ | ○ | ○ | |
| C502 | ○ | ○ | ◎ | ◎ | ◎ | ◎ | ○ | ◎ | ○ | |
| C503 | ○ | ○ | ○ | ○ | ○ | ◎ | ○ | ◎ | ○ | (−) charged |
| C504 | ◎ | ○ | ○ | ○ | ○ | ○ | ○ | ○ | ○ | |
| C505 | ○ | ○ | ◎ | ◎ | ◎ | ◎ | ○ | ◎ | ○ | |
| C506 | ◎ | ○ | ○ | ○ | ○ | ◎ | ○ | ◎ | ○ | |

TABLE 13C

| Drum No. | C601 | C602 | C603 | C604 | C605 | C606 |
|---|---|---|---|---|---|---|
| Flow rate (SCCM) | $SiH_4$ 150<br>$B_2H_6$ 500 ppm → 0<br>(based on $SiH_4$)<br>NO 10 → 0<br>$H_2$ 350 | $SiH_4$ 150<br>$B_2H_6$ 100 ppm → 0<br>(based on $SiH_4$)<br>NO 5 → 0<br>$H_2$ 350 | $SiH_4$ 150<br>$PH_3$ 100 ppm → 0<br>(based on $SiH_4$)<br>NO 5 → 0<br>$H_2$ 350 | $SiH_4$ 150<br>$B_2H_6$ 500 ppm → 0<br>(based on $SiH_4$)<br>NO 10 → 0<br>Ar 350 | $SiH_4$ 150<br>$B_2H_6$ 1000 ppm → 0<br>(based on $SiH_4$)<br>NO 10 → 0<br>He 350 | $SiH_4$ 100<br>$SiF_4$ 50<br>$B_2H_6$ 500 ppm → 0<br>(based on $SiH_4$)<br>NO 10 → 0<br>$H_2$ 350 |
| Substrate temperature (°C.) | 250 | 250 | 250 | 250 | 250 | 250 |
| RF power (W) | 150 | 150 | 150 | 150 | 150 | 150 |
| Inner pressure (torr) | 0.25 | 0.25 | 0.25 | 0.25 | 0.25 | 0.25 |
| Film thickness (μm) | 3 | 3 | 3 | 3 | 3 | 2.7 |
| Remark | | | | | Only the photoconductive layer condition is the same as drum No. C405. | |

TABLE 14C

| Drum No. | Initial charging ability | Initial sensitivity | Image flow | Residual potential | Ghost | Photosensitivity irregularity in generator direction | Image defect | Sensitivity deterioration | Increase of image defects |
|---|---|---|---|---|---|---|---|---|---|
| C601 | ◎ | ○ | ○ | ◎ | ◎ | ○ | ◎ | ○ | ◎ |
| C602 | ○ | ○ | ◎ | ◎ | ◎ | ◎ | ○ | ◎ | ○ |
| C603 | ○ | ○ | ○ | ◎ | ◎ | ◎ | ○ | ◎ | ○ |
| C604 | ◎ | ○ | ○ | ◎ | ○ | ○ | ○ | ○ | ○ |
| C605 | ○ | ○ | ◎ | ◎ | ◎ | ◎ | ○ | ◎ | ◎ |
| C606 | ◎ | ○ | ○ | ◎ | ○ | ◎ | ○ | ◎ | ○ |

TABLE 15C

| Drum No. | C701 | C702 | C703 | C704 | C705 |
|---|---|---|---|---|---|
| a (μm) | 25 | 50 | 50 | 12 | 12 |
| b (μm) | 0.8 | 2.5 | 0.8 | 1.5 | 0.3 |

TABLE 17C

| Drum No. | C801 | C802 | C803 | C804 | C805 |
|---|---|---|---|---|---|
| c (μm) | 50 | 100 | 100 | 30 | 30 |
| d (μm) | 2 | 5 | 5 | 5 | 0.7 |

TABLE 16C

| Drum No. | Initial charging ability | Initial sensitivity | Image flow | Interference fringe | Residual potential | Ghost | Photosensitivity irregularity in generator direction | Image defect | Sensitivity deterioration | Increase of image defects | Resolving power of image |
|---|---|---|---|---|---|---|---|---|---|---|---|
| C701 | ◎ | ○ | ◎ | ○ | ◎ | ◎ | ◎ | ○ | ◎ | ○ | ○ |
| C702 | ◎ | ○ | ◎ | ○ | ◎ | ◎ | ◎ | ○ | ◎ | ○ | ○ |
| C703 | ◎ | ○ | ◎ | Δ | ◎ | ◎ | ◎ | ○ | ◎ | ○ | Δ |
| C704 | ◎ | ○ | ◎ | ○ | ◎ | ◎ | ◎ | ○ | ◎ | ○ | ○ |
| C705 | ◎ | ○ | ◎ | Δ~○ | ◎ | ◎ | ◎ | ○ | ◎ | ○ | ○ |

TABLE 18C

| Drum No. | Initial charging ability | Initial sensitivity | Image flow | Interference fringe | Residual potential | Ghost | Photosensitivity irregularity in generator direction | Image defect | Sensitivity deterioration | Increase of image defects | Resolving power of image |
|---|---|---|---|---|---|---|---|---|---|---|---|
| C801 | ◎ | ○ | ◎ | ○ | ◎ | ◎ | ◎ | ○ | ◎ | ○ | Δ ~ ○ |
| C802 | ◎ | ○ | ◎ | ○ | ◎ | ◎ | ◎ | ○ | ◎ | ○ | Δ ~ ○ |
| C803 | ◎ | ○ | ◎ | Δ | ◎ | ◎ | ◎ | ○ | ◎ | ○ | Δ |
| C804 | ◎ | ○ | ◎ | ○ | ◎ | ◎ | ◎ | ○ | ◎ | ○ | ○ |
| C805 | ◎ | ○ | ◎ | ○ | ◎ | ◎ | ◎ | ○ | ◎ | ○ | ○ |

TABLE 1D

| Name of layer | Gases employed and flow rates (SCCM) | | Substrate temperature (°C.) | RF power (W) | Inner pressure (torr) | Film thickness (μm) |
|---|---|---|---|---|---|---|
| Longer wavelength absorbing layer | $SiH_4$ | 150 | 250 | 150 | 0.27 | 0.5 |
| | $B_2H_6$ (based on $SiH_4$) | 1000 ppm | | | | |
| | NO | 10 | | | | |
| | $GeH_4$ | 50 | | | | |
| | $H_2$ | 350 | | | | |
| Charge injection preventive layer | $SiH_4$ | 150 | 250 | 150 | 0.25 | 3 |
| | $B_2H_6$ (based On $SiH_4$) | 1000 ppm | | | | |
| | NO | 10 | | | | |
| | $H_2$ | 350 | | | | |
| Photo-conductive layer | $SiH_4$ | 350 | 250 | 300 | 0.4 | 20 |
| | $H_2$ | 350 | | | | |
| Surface layer | $SiH_4$ | 350 → 10 | 250 | 300 → 200 | 0.4 → 0.45 | 1.5 |
| | $CH_4$ | 0 → 500 | | | | |
| | $H_2$ | 350 → 500 | | | | |

TABLE 3D

| Name of layer | Gases employed and flow rates (SCCM) | | Substrate temperature (°C.) | RF power (W) | Inner pressure (torr) | Film thickness (μm) |
|---|---|---|---|---|---|---|
| Longer wavelength absorbing layer | $SiH_4$ | 150 | 250 | 150 | 0.27 | 0.5 |
| | $B_2H_6$ (based on $SiH_4$) | 1000 ppm | | | | |
| | NO | 10 | | | | |
| | $GeH_4$ | 50 | | | | |
| | $H_2$ | 350 | | | | |
| Charge injection preventive layer | $SiH_4$ | 150 | 250 | 150 | 0.25 | 3 |
| | $B_2H_6$ (based on $SiH_4$) | 1000 ppm | | | | |
| | NO | 10 | | | | |
| | $H_2$ | 350 | | | | |
| Photo-conductive layer | $SiH_4$ | 350 | 250 | 300 | 0.4 | 20 |
| | $H_2$ | 350 | | | | |
| Surface layer | $SiH_4$ | 350 → 10 | 150 | 300 → 100 | 0.4 → 0.7 | 1.5 |
| | $CH_4$ | 0 → 500 | | | | |
| | $H_2$ | 350 → 1000 | | | | |

TABLE 2D

| | |
|---|---|
| Initial charging ability | ◎ |
| Initial sensitivity | ○ |
| Image flow | ◎ |
| Interference fringe | ○ |
| Residual potential | ◎ |
| Ghost | ◎ |
| Photosensitivity irregularity in generator direction | ◎ |
| Image defect | ○ |
| Sensitivity deterioration | ◎ |
| Increase of image defect | ○ |
| Maximum value of hydrogen content (atomic %) | 52 |

TABLE 4D

| | |
|---|---|
| Initial charging ability | x |
| Initial sensitivity | ○ |
| Image flow | ○ |
| Interference fringe | ○ |
| Residual potential | x |
| Ghost | Δ |
| Photosensitivity irregularity in generator direction | Δ |
| Image defect | x |
| Sensitivity deterioration | ○ |

TABLE 4D-continued

| | |
|---|---|
| Increase of image defect | x |
| Maximum value of hydrogen content (atomic %) | 87 |

TABLE 6D-continued

| | |
|---|---|
| direction | |
| Image defect | ○ |
| Sensitivity deterioration | ◎ |
| Increase of image defect | ◎ |
| Maximum value of hydrogen content (atomic %) | 46 |

TABLE 5D

| Name of layer | Gases employed and flow rates (SCCM) | | Substrate temperature (°C.) | RF power (W) | Inner pressure (torr) | Film thickness (μm) |
|---|---|---|---|---|---|---|
| Longer wavelength absorbing layer | $SiH_4$ | 150 | 250 | 150 | 0.27 | 0.5 |
| | $B_2H_6$ (based on $SiH_4$) | 1000 ppm | | | | |
| | NO | 10 | | | | |
| | $GeH_4$ | 50 → 0 | | | | |
| | $H_2$ | 350 | | | | |
| Charge injection preventive layer | $SiH_4$ | 150 | 250 | 150 | 0.25 | 3 |
| | $B_2H_6$ (based on $SiH_4$) | 1000 ppm | | | | |
| | NO | 10 → 0 | | | | |
| | $H_2$ | 350 | | | | |
| Photo-conductive layer | $SiH_4$ | 350 | 250 | 300 | 0.4 | 20 |
| | $H_2$ | 350 | | | | |
| Surface layer | $SiH_4$ | 350 → 10 | 250 | 300 → 200 | 0.4 → 0.41 | 1.5 |
| | $CH_4$ | 0 → 400 | | | | |
| | $H_2$ | 350 → 400 | | | | |

TABLE 7D

| Drum No. | D301 | D302 | D303 | D304 |
|---|---|---|---|---|
| Flow rate (SCCM) | $SiH_4$ 200 → 10<br>$CH_4$ 0 → 500<br>$H_2$ 0 → 400 | $SiH_4$ 200 → 10<br>$CH_4$ 0 → 500<br>$H_2$ 0 → 500 | $SiH_4$ 10<br>$CH_4$ 500<br>$H_2$ 500 | $SiH_4$ 300 → 10<br>$CH_4$ 0 → 600<br>$H_2$ 0 → 700 | $SiH_4$ 150 → 10<br>$CH_4$ 0 → 400<br>$H_2$ 0 → 700 |
| Substrate temperature (°C.) | 200 | 250 | | 250 | 250 |
| RF power (W) | 300 → 150 | 300 → 200 | 200 | 300 → 200 | 300 → 200 |
| Inner pressure (torr) | 0.35 → 0.42 | 0.35 → 0.45 | 0.45 | 0.4 → 0.5 | 0.32 → 0.46 |
| Film thickness (μm) | 1.5 | 1 | 0.5 | 1.5 | 1 |

| Drum No. | D304 | D305 | D306 | | Comparative example 2D |
|---|---|---|---|---|---|
| Flow rate (SCCM) | $SiH_4$ 10<br>$C_2H_4$ 400<br>$H_2$ 700 | $SiF_4$ 200 → 10<br>$C_2H_4$ 0 → 500<br>$H_2$ 0 → 700 | $SiH_4$ 200 → 10<br>$CH_4$ 0 → 500<br>$H_2$ 0 → 500 | $SiH_4$ 10<br>$CH_4$ 500<br>$H_2$ 500 | $SiH_4$ 200 → 10<br>$CH_4$ 0 → 500<br>$H_2$ 0 → 800 |
| Substrate temperature (°C.) | 250 | 250 | 250 | | 150 |
| RF power (W) | 200 | 300 → 200 | 300 → 200 | 200 | 300 → 200 |
| Inner pressure (torr) | 0.46 | 0.35 → 0.45 | 0.35 → 0.46 | 0.46 | 0.35 → 0.65 |
| Film thickness (μm) | 0.5 | 1.5 | 1 | 0.5 | 1.5 |

TABLE 6D

| | |
|---|---|
| Initial charging ability | ◎ |
| Initial sensitivity | ○ |
| Image flow | ◎ |
| Interference fringe | ◎ |
| Residual potential | ◎ |
| Ghost | ◎ |
| Photosensitivity irregularity in generator | ◎ |

TABLE 8D

| Drum No. | D301 | D302 | D303 | D304 | D305 | D306 | Comparative example 2D |
|---|---|---|---|---|---|---|---|
| Initial charging ability | ◎ | ◎ | ○ | ○ | ○ | ◎ | x |
| Initial sensitivity | ○ | ○ | ○ | ○ | ○ | ○ | ○ |
| Image flow | ○ | ◎ | ◎ | ◎ | ○ | ◎ | ○ |

TABLE 8D-continued

| Drum No. | D301 | D302 | D303 | D304 | D305 | D306 | Comparative example 2D |
|---|---|---|---|---|---|---|---|
| Interference fringe | ○ | ○ | ○ | ○ | ○ | ○ | ○ |
| Residual potential | ◎ | ◎ | ◎ | ○ | ○ | ○ | x |
| Ghost | ○ | ◎ | ◎ | ◎ | ○ | ◎ | Δ |
| Photosensitivity irregularity in generator direction | ○ | ◎ | ◎ | ◎ | ◎ | ○ | Δ |
| Image defect | ○ | ○ | ○ | ○ | ○ | ○ | x |
| Sensitivity deterioration | ○ | ◎ | ◎ | ◎ | ○ | ◎ | ○ |
| Increase of image defect | ○ | ○ | ○ | ○ | ○ | ○ | x |
| Sample No. | D301-1 | D302-1 | D303-1 | D304-1 | D305-1 | D306-1 | Comparative example 2-1D |
| Maximum value of hydrogen content (atomic %) | 51 | 60 | 62 | 63 | 70 | 55 | 85 |

TABLE 9D

| Drum No. | D401 | D402 | D403 | D404 | D405 | D406 |
|---|---|---|---|---|---|---|
| Flow rate (SCCM) | $SiH_4$ 350<br>$H_2$ 350 | $SiH_4$ 200<br>$H_2$ 600 | $SiH_4$ 350<br>$H_2$ 350<br>$B_2H_6$ 0.3 ppm (based on $SiH_4$) | $SiH_4$ 350<br>Ar 350 | $SiH_4$ 350<br>He 350<br>$B_2H_6$ 0.3 ppm (based on $SiH_4$) | $SiH_4$ 200<br>$SiF_4$ 100<br>$H_2$ 300 |
| Substrate temperature (°C.) | 250 | 250 | 250 | 250 | 250 | 250 |
| RF power (W) | 200 | 400 | 300 | 250 | 300 | 400 |
| Inner pressure (torr) | 0.4 | 0.42 | 0.4 | 0.4 | 0.4 | 0.38 |
| Film thickness (μm) | 20 | 20 | 20 | 20 | 20 | 20 |

TABLE 10D

| Drum No. | D401 | D402 | D403 | D404 | D405 | D406 |
|---|---|---|---|---|---|---|
| Initial charging ability | ○ | ◎ | ○ | ◎ | ○ | ◎ |
| Initial sensitivity | ◎ | ○ | ○ | ○ | ○ | ○ |
| Image flow | ◎ | ◎ | ◎ | ◎ | ◎ | ◎ |

TABLE 10D-continued

| Drum No. | D401 | D402 | D403 | D404 | D405 | D406 |
|---|---|---|---|---|---|---|
| Interference fringe | ○ | ○ | ○ | ○ | ○ | ○ |
| Residual Potential | ◎ | ◎ | ◎ | ◎ | ◎ | ◎ |
| Ghost | ◎ | ◎ | ◎ | ◎ | ◎ | ◎ |
| Photosensitivity irregularity in generator direction | ◎ | ◎ | ◎ | ◎ | ◎ | ◎ |
| Image defect | ○ | ○ | ○ | ○ | ○ | ○ |
| Sensitivity deterioration | ◎ | ◎ | ◎ | ◎ | ◎ | ◎ |
| Increase of image defect | ○ | ○ | ○ | ○ | ○ | ○ |

TABLE 11D

| Drum No. | D501 | D502 | D503 | D504 | D505* | D506 |
|---|---|---|---|---|---|---|
| Flow rate (SCCM) | $SiH_4$ 150<br>$B_2H_6$ 500 ppm (based on $SiH_4$)<br>NO 10<br>$H_2$ 350 | $SiH_4$ 150<br>$B_2H_6$ 100 ppm (based on $SiH_4$)<br>NO 5<br>$H_2$ 350 | $SiH_4$ 150<br>$PH_3$ 100 ppm (based on $SiH_4$)<br>NO 5<br>$H_2$ 350 | $SiH_4$ 150<br>$B_2H_6$ 500 ppm (based on $SiH_4$)<br>NO 10<br>Ar 350 | $SiH_4$ 150<br>$B_2H_6$ 1000 ppm (based on $SiH_4$)<br>NO 10<br>He 350 | $SiH_4$ 100<br>$SiF_4$ 50<br>$B_2H_6$ 500 ppm (based on $SiH_4$)<br>NO 10<br>$H_2$ 350 |
| Substrate temperature (°C.) | 250 | 250 | 250 | 250 | 250 | 250 |
| RF power (W) | 150 | 150 | 150 | 150 | 150 | 150 |
| Inner pressure (torr) | 0.25 | 0.25 | 0.25 | 0.25 | 0.25 | 0.25 |
| Film thickness (μm) | 3 | 3 | 3 | 3 | 3 | 2.7 |

*Only the preparation condition of photoconductive layer is the same as drum No. D405

TABLE 12D

| Drum No. | D501 | D502 | D503 | D504 | D505 | D506 |
|---|---|---|---|---|---|---|
| Initial charging ability | ◎ | ○ | ○ | ◎ | ○ | ◎ |
| Initial sensitivity | ○ | ○ | ○ | ○ | ○ | ○ |
| Image flow | ○ | ◎ | ○ | ○ | ◎ | ○ |
| Interference fringe | ○ | ○ | ○ | ○ | ○ | ○ |
| Residual potential | ◎ | ◎ | ○ | ◎ | ◎ | ○ |
| Ghost | ◎ | ◎ | ○ | ○ | ◎ | ○ |
| Photosensitivity irregularity in generator direction | ◎ | ○ | ◎ | ○ | ◎ | ◎ |
| Image defect | ○ | ○ | ○ | ○ | ○ | ○ |
| Sensitivity deterioration | ◎ | ○ | ◎ | ○ | ◎ | ◎ |
| Increase of image defect | ○ | ○ | ○ | ○ | ○ | ○ |
| Remark | | | (−) charging | | | |

TABLE 13D

| Drum No. | D601 | D602 | D603 | D604 | D605* | D606 |
|---|---|---|---|---|---|---|
| Flow rate (SCCM) | $SiH_4$ 150<br>$B_2H_6$ 500 ppm (based on $SiH_4$)<br>NO 10 → 0<br>$H_2$ 350 | $SiH_4$ 150<br>$B_2H_6$ 100 ppm (based on $SiH_4$)<br>NO 5 → 0<br>$H_2$ 350 | $SiH_4$ 150<br>$PH_3$ 100 ppm (based on $SiH_4$)<br>NO 5 → 0<br>$H_2$ 350 | $SiH_4$ 150<br>$B_2H_6$ 500 ppm (based on $SiH_4$)<br>NO 10 → 0<br>Ar 350 | $SiH_4$ 150<br>$B_2H_6$ 1000 ppm (based on $SiH_4$)<br>NO 10 → 0<br>He 350 | $SiH_4$ 100<br>$SiF_4$ 50<br>$B_2H_6$ 500 ppm (based on $SiH_4$)<br>NO 10 → 0<br>$H_2$ 350 |
| Substrate temperature (°C.) | 250 | 250 | 250 | 250 | 250 | 250 |
| RF power (W) | 150 | 150 | 150 | 150 | 150 | 150 |
| Inner pressure (torr) | 0.25 | 0.25 | 0.25 | 0.25 | 0.25 | 0.25 |
| Film thickness (μm) | 3 | 3 | 3 | 3 | 3 | 2.7 |

*Only the preparation condition of photoconductive layer is the same as drum No. D405

TABLE 14D

| Drum No. | D601 | D602 | D603 | D604 | D605 | D606 |
|---|---|---|---|---|---|---|
| Initial charging ability | ◎ | ○ | ○ | ◎ | ○ | ◎ |
| Initial sensitivity | ○ | ○ | ○ | ○ | ○ | ○ |
| Image flow | ○ | ◎ | ○ | ○ | ◎ | ○ |
| Interference fringe | ◎ | ○ | ○ | ◎ | ◎ | ◎ |
| Residual potential | ◎ | ◎ | ◎ | ◎ | ◎ | ◎ |
| Ghost | ◎ | ◎ | ◎ | ○ | ◎ | ○ |
| Photosensitivity irregularity in generator direction | ○ | ○ | ◎ | ○ | ◎ | ◎ |
| Image defect | ◎ | ○ | ◎ | ○ | ◎ | ◎ |
| Sensitivity deterioration | ○ | ○ | ○ | ○ | ○ | ○ |
| Increase of image defect | ◎ | ○ | ○ | ○ | ◎ | ○ |

TABLE 15D

| Drum No. | D701 | D702 | D703 | D704 |
|---|---|---|---|---|
| Flow rate (SCCM) | $SiH_4$ 150<br>$B_2H_6$ 1000 ppm (based on $SiH_4$)<br>NO 10<br>$GeH_4$ 30<br>$H_2$ 350 | $SiH_4$ 150<br>$B_2H_6$ 500 ppm (based on $SiH_4$)<br>NO 5<br>$GeH_4$ 50<br>$H_2$ 350 | $SiH_4$ 150<br>$PH_3$ 100 ppm (based on $SiH_4$)<br>NO 5<br>$GeH_4$ 70<br>$H_2$ 350 | $SiH_4$ 150<br>$B_2H_6$ 500 ppm (based on $SiH_4$)<br>NO 10<br>$GeH_4$ 10<br>Ar 350 |
| Substrate temperature (°C.) | 250 | 250 | 250 | 250 |
| RF power (W) | 150 | 200 | 150 | 150 |
| Inner pressure (torr) | 0.27 | 0.27 | 0.27 | 0.27 |
| Film thickness (μm) | 0.5 | 0.5 | 0.5 | 0.5 |
| Remark | | | | |

| Drum No. | D705-1 | D705-2 | D706 |
|---|---|---|---|
| Flow rate (SCCM) | $SiH_4$ 150<br>$B_2H_6$ 1000 ppm (based on $SiH_4$)<br>NO 10<br>$GeH_4$ 50<br>He 350 | | $SiH_4$ 100<br>$SiF_4$ 50<br>$B_2H_6$ 1000 ppm (based on $SiH_4$)<br>NO 10<br>$GeH_4$ 50<br>$H_2$ 350 |
| Substrate temperature (°C.) | 250 | | 250 |
| RF power (W) | 150 | | 150 |
| Inner pressure (torr) | 0.27 | | 0.27 |
| Film thickness (μm) | 0.5 | | 0.4 |
| Remark | Photoconductive layer preparation condition is | Photoconductive layer preparation condition | |

TABLE 15D-continued

| | | |
|---|---|---|
| | the same as drum No. D405 and charge injection layer preparation condition is the same as drum No. D505. | is the same as drum No. D405, and charge injection layer preparation condition is the same as drum No. D605. |

TABLE 17D

| Drum No. | D801 | D802 | D803 | D804 |
|---|---|---|---|---|
| Flow rate (SCCM) | $SiH_4$ 150<br>$B_2H_6$ 1000 ppm (based on $SiH_4$)<br>NO 10<br>$GeH_4$ 30 → 0<br>$H_2$ 350 | $SiH_4$ 150<br>$B_2H_6$ 500 ppm (based on $SiH_4$)<br>NO 5<br>$GeH_4$ 50 → 0<br>$H_2$ 350 | $SiH_4$ 150<br>$PH_3$ 100 ppm (based on $SiH_4$)<br>NO 5<br>$GeH_4$ 70 → 0<br>$H_2$ 350 | $SiH_4$ 150<br>$B_2H_6$ 500 ppm (based on $SiH_4$)<br>NO 10<br>$GeH_4$ 10 → 0<br>Ar 350 |
| Substrate temperature (°C.) | 250 | 250 | 250 | 250 |
| RF power (W) | 150 | 200 | 150 | 150 |
| Inner pressure (torr) | 0.27 | 0.27 | 0.27 | 0.27 |
| Film thickness (μm) | 0.5 | 0.5 | 0.5 | 0.5 |
| Remark | | | | |

| Drum No. | D805-1 | D805-2 | D806 |
|---|---|---|---|
| Flow rate (SCCM) | $SiH_4$ 150<br>$B_2H_6$ 1000 ppm (based on $SiH_4$)<br>NO 10<br>$GeH_4$ 50 → 0<br>He 350 | | $SiH_4$ 100<br>$SiF_4$ 50<br>$B_2H_6$ 1000 ppm (based on $SiH_4$)<br>NO 10<br>$GeH_4$ 50 → 0<br>$H_2$ 350 |
| Substrate temperature (°C.) | 250 | | 250 |
| RF power (W) | 150 | | 150 |
| Inner pressure (torr) | 0.27 | | 0.27 |
| Film thickness (μm) | 0.5 | | 0.4 |
| Remark | The photoconductive layer preparation conditions are the same as drum No. D405, and the charge injection preventive layer preparation conditions as drum No. D505 | The photoconductive layer preparation conditions are the same as drum No. D405, and the charge injection preventive layer preparation conditions as drum No. D605. | |

TABLE 16D

| Drum No. | D701 | D702 | D703 | D704 | D705 -1 | D705 -2 | D706 |
|---|---|---|---|---|---|---|---|
| Initial charging ability | ◎ | ◎ | ◎ | ○ | ○ | ○ | ◎ |
| Initial sensitivity | ○ | ○ | ○ | ◎ | ○ | ○ | ○ |
| Image flow | ○ | ◎ | ○ | ○ | ◎ | ◎ | ○ |
| Interference fringe | ○ | ◎ | ○ | ○ | ○ | ◎ | ◎ |
| Residual potential | ◎ | ◎ | ◎ | ◎ | ◎ | ◎ | ◎ |
| Ghost | ◎ | ◎ | ◎ | ○ | ◎ | ◎ | ○ |
| Photosensitivity irregularity in generator direction | ◎ | ○ | ◎ | ○ | ◎ | ◎ | ○ |
| Image defect | ○ | ○ | Δ | ○ | ○ | ○ | ○ |
| Sensitivity deterioration | ○ | ◎ | ◎ | ○ | ◎ | ◎ | ○ |
| Increase of image defect | ○ | ○ | ○ | ○ | ○ | ◎ | ○ |

TABLE 18D

| Drum No. | D801 | D802 | D803 | D804 | D805 -1 | D805 -2 | D806 |
|---|---|---|---|---|---|---|---|
| Initial charging ability | ◎ | ◎ | ◎ | ○ | ○ | ○ | ◎ |
| Initial sensitivity | ○ | ○ | ○ | ◎ | ○ | ○ | ○ |
| Image flow | ○ | ◎ | ○ | ○ | ◎ | ◎ | ○ |
| Interference fringe | ○ | ◎ | ◎ | ○ | ◎ | ◎ | ◎ |
| Residual potential | ◎ | ◎ | ◎ | ◎ | ◎ | ◎ | ◎ |
| Ghost | ◎ | ◎ | ◎ | ○ | ◎ | ◎ | ○ |
| Photosensitivity irregularity | ◎ | ○ | ◎ | ○ | ◎ | ◎ | ○ |

TABLE 18D-continued

| Drum No. | D801 | D802 | D803 | D804 | D805 -1 | D805 -2 | D806 |
|---|---|---|---|---|---|---|---|
| in generator direction | | | | | | | |
| Image defect | ○ | ○ | ○ | ○ | ○ | ○ | ○ |
| Sensitivity deterioration | ⊙ | ○ | ⊙ | ○ | ⊙ | ⊙ | ○ |
| Increase of image defect | ○ | ○ | ○ | ○ | ⊙ | ⊙ | ○ |

TABLE 19D

| Drum No. | D901 | D902 | D903 | D904 | D905 |
|---|---|---|---|---|---|
| a (μm) | 25 | 50 | 50 | 12 | 12 |
| b (μm) | 0.8 | 2.5 | 0.8 | 1.5 | 0.3 |

TABLE 20D

| Drum No. | D901 | D902 | D903 | D904 | D905 |
|---|---|---|---|---|---|
| Initial charging ability | ⊙ | ⊙ | ⊙ | ⊙ | ⊙ |
| Initial sensitivity | ○ | ○ | ○ | ○ | ○ |
| Image flow | ⊙ | ⊙ | ⊙ | ⊙ | ⊙ |
| Interference fringe | ○ | ○ | ○ | ○ | ○ |
| Residual potential | ⊙ | ⊙ | ⊙ | ⊙ | ⊙ |
| Ghost | ⊙ | ⊙ | ⊙ | ⊙ | ⊙ |
| Photosensitivity irregularity in generator direction | ⊙ | ⊙ | ⊙ | ⊙ | ⊙ |
| Image defect | ○ | ○ | ○ | ○ | ○ |
| Sensitivity deterioration | ⊙ | ⊙ | ⊙ | ⊙ | ⊙ |
| Increase of image defect | ○ | ○ | ○ | ○ | ○ |
| Resolving power of image | ○ | ○ | Δ | ○ | ○ |

TABLE 21D

| Drum No. | D1001 | D1002 | D1003 | D1004 | D1005 |
|---|---|---|---|---|---|
| c (μm) | 50 | 100 | 100 | 30 | 30 |
| d (μm) | 2 | 5 | 1.5 | 2.5 | 0.7 |

TABLE 22D

| Drum No. | D1001 | D1002 | D1003 | D1004 | D1005 |
|---|---|---|---|---|---|
| Initial charging ability | ⊙ | ⊙ | ⊙ | ⊙ | ⊙ |
| Initial sensitivity | ○ | ○ | ○ | ○ | ○ |
| Image flow | ⊙ | ⊙ | ⊙ | ⊙ | ⊙ |
| Interference fringe | ⊙ | ⊙ | ○ | ⊙ | ○ |
| Residual potential | ⊙ | ⊙ | ⊙ | ⊙ | ⊙ |
| Ghost | ⊙ | ⊙ | ⊙ | ⊙ | ⊙ |
| Photosensitivity irregularity in generator direction | ⊙ | ⊙ | ⊙ | ⊙ | ⊙ |
| Image defect | ○ | ○ | ○ | ○ | ○ |
| Sensitivity deterioration | ⊙ | ⊙ | ⊙ | ⊙ | ⊙ |
| Increase of image defect | ○ | ○ | ○ | ○ | ○ |
| Resolving power of image | Δ~ | Δ~ | Δ | ○ | ○ |

TABLE 1E

| Name of layer | Gases employed and flow rates (SCCM) | | Substrate temperature (°C.) | RF power (W) | Inner pressure (Torr) | Film thickness (μm) |
|---|---|---|---|---|---|---|
| Longer wavelength absorbing layer | $SiH_4$ | 150 | 350 | 1500 | 0.3 | 0.1 |
| | $B_2H_6$ (Based on $SiH_4$) | 1000 ppm | | | | |
| | NO | 10 | | | | |
| | $GeH_4$ | 50 | | | | |
| | $H_2$ | 500 | | | | |
| Charge injection preventive layer | $SiH_4$ | 150 | 350 | 1500 | 0.5 | 1 |
| | $B_2H_6$ (Based on $SiH_4$) | 1000 ppm | | | | |
| | NO | 10 | | | | |
| | $H_2$ | 500 | | | | |
| Photoconductive layer | $SiH_4$ | 350 | 250 | 300 | 0.4 | 20 |
| | $H_2$ | 350 | | | | |
| Surface layer | $SiH_4$ | 350 → 10 | 250 | 300 → 200 | 0.4 → 0.45 | 1.5 |
| | $CH_4$ | 0 → 500 | | | | |
| | $H_2$ | 350 → 500 | | | | |

TABLE 2E

| Initial charging ability | Initial sensitivity | Image flow | Interference fringe | Residual potential | Ghost | Photosensitivity irregularity in generator direction | Image defect |
|---|---|---|---|---|---|---|---|
| ⊙ | ○ | ⊙ | ○ | ⊙ | ⊙ | ⊙ | ○ |

| Sensitivity deterioration | Increase of image defect | Maximum value of hydrogen content (atomic %) | Presence of crystallinity: Charge injection preventive layer | Presence of crystallinity: Longer wavelength absorbing layer |
|---|---|---|---|---|
| ⊙ | ⊙ | 52 | Observed | Observed |

TABLE 3E

| Name of layer | Gases employed and flow rates (SCCM) | | Substrate temperature (°C.) | RF power (W) | Inner pressure (Torr) | Film thickness (μm) |
|---|---|---|---|---|---|---|
| Longer wavelength absorbing layer | $SiH_4$ | 150 | 350 | 1500 | 0.3 | 0.1 |
| | $B_2H_6$ (Based on $SiH_4$) | 1000 ppm | | | | |
| | NO | 10 | | | | |
| | $GeH_4$ | 50 | | | | |
| | $H_2$ | 500 | | | | |
| Charge injection preventive layer | $SiH_4$ | 150 | 350 | 1500 | 0.5 | 1 |
| | $B_2H_6$ (Based on $SiH_4$) | 1000 ppm | | | | |
| | NO | 10 | | | | |
| | $H_2$ | 500 | | | | |
| Photoconductive layer | $SiH_4$ | 350 | 250 | 300 | 0.4 | 20 |
| | $H_2$ | 350 | | | | |
| Surface layer | $SiH_4$ | 350 → 10 | 150 | 300 → 100 | 0.4 → 0.7 | 1.5 |
| | $CH_4$ | 0 → 500 | | | | |
| | $H_2$ | 350 → 500 | | | | |

TABLE 4E

| Initial charging ability | Initial sensitivity | Image flow | Interference fringe | Residual potential | Ghost | Photosensitivity irregularity in generator direction | Image defect |
|---|---|---|---|---|---|---|---|
| X | ○ | ○ | ○ | X | Δ | Δ | X |

| Sensitivity deterioration | Increase of image defect | Maximum value of hydrogen content (atomic %) | Presence of crystallinity: Charge injection preventive layer | Presence of crystallinity: Longer wavelength absorbing layer |
|---|---|---|---|---|
| ○ | X | 87 | Observed | Observed |

TABLE 5E

| Name of layer | Gases employed and flow rates (SCCM) | | Substrate temperature (°C.) | RF power (W) | Inner pressure (Torr) | Film thickness (μm) |
|---|---|---|---|---|---|---|
| Longer wavelength absorbing layer | $SiH_4$ | 150 | 350 | 1500 | 0.3 | 0.1 |
| | $B_2H_6$ (Based on $SiH_4$) | 1000 ppm | | | | |
| | NO | 10 | | | | |
| | $GeH_4$ | 50 → 0 | | | | |
| | $H_2$ | 500 | | | | |
| Charge injection preventive layer | $SiH_4$ | 150 | 350 | 1500 | 0.5 | 1 |
| | $B_2H_6$ (Based on $SiH_4$) | 1000 ppm | | | | |
| | NO | 10 → 0 | | | | |
| | $H_2$ | 500 | | | | |
| Photoconductive layer | $SiH_4$ | 350 | 250 | 300 | 0.4 | 20 |
| | $H_2$ | 350 | | | | |
| Surface layer | $SiH_4$ | 350 → 10 | 250 | 200 | 0.4 → 0.41 | 1.5 |
| | $CH_4$ | 0 → 400 | | | | |
| | $H_2$ | 350 → 400 | | | | |

TABLE 6E

| Initial charging ability | Initial sensitivity | Image flow | Interference fringe | Residual potential | Ghost | Photosensitivity irregularity in generator direction | Image defect |
|---|---|---|---|---|---|---|---|
| ◎ | ○ | ◎ | ◎ | ◎ | ◎ | ◎ | ◎ |

| Sensitivity deterioration | Increase of image defect | Maximum value of hydrogen content (atomic %) | Presence of crystallinity: Charge injection preventive layer | Presence of crystallinity: Longer wavelength absorbing layer |
|---|---|---|---|---|
| ◎ | ◎ | 46 | Observed | Observed |

TABLE 7E

| Drum No. | E301 | E302 | E303 | E304 |
|---|---|---|---|---|
| Flow rate (SCCM) | $SiH_4$ 200 → 10<br>$CH_4$ 0 → 500<br>$H_2$ 0 → 400 | $SiH_4$ 200 → 10<br>$CH_4$ 0 → 500<br>$H_2$ 0 → 500 | $SiH_4$ 10<br>$CH_4$ 500<br>$H_2$ 500 | $SiH_4$ 300 → 10<br>$CH_4$ 0 → 600<br>$H_2$ 0 → 700 | $SiH_4$ 150 → 10<br>$CH_4$ 0 → 400<br>$H_2$ 0 → 700 |
| Substrate temperature (°C.) | 200 | 250 | | 250 | 250 |
| RF power (W) | 300 → 150 | 300 → 200 | 200 | 300 → 200 | 300 → 200 |

TABLE 7E-continued

| | | | | | |
|---|---|---|---|---|---|
| Inner pressure (Torr) | 0.35 → 0.42 | 0.35 → 0.45 | 0.45 | 0.4 → 0.5 | 0.32 → 0.46 |
| Film thickness (μm) | 1.5 | 1 | 0.5 | 1.5 | 1 |

| Drum No. | E304 | E305 | E306 | | Comparative example 2 |
|---|---|---|---|---|---|
| Flow rate (SCCM) | $SiH_4$ 10<br>$CH_4$ 400<br>$H_2$ 700 | $SiH_4$ 200 → 10<br>$C_2H_4$ 0 → 500<br>$H_2$ 0 → 700 | $SiH_4$ 200 → 10<br>$CH_4$ 0 → 500<br>$H_2$ 0 → 500 | $SiH_4$ 10<br>$CH_4$ 500<br>$H_2$ 500 | $SiH_4$ 200 → 10<br>$CH_4$ 0 → 500<br>$H_2$ 0 → 800 |
| Substrate temperature (°C.) | 250 | 250 | 250 | | 150 |
| RF power (W) | 200 | 300 → 200 | 300 → 200 | 200 | 300 → 200 |
| Inner pressure (Torr) | 0.46 | 0.35 → 0.45 | 0.35 → 0.46 | 0.46 | 0.35 → 0.65 |
| Film thickness (μm) | 0.5 | 1.5 | 1 | 0.5 | 1.5 |

TABLE 8E

| Drum No. | Initial charging ability | Initial sensitivity | Image flow | Interference fringe | Residual potential | Ghost | Photosensitivity irregularity in generator direction | Image defect |
|---|---|---|---|---|---|---|---|---|
| E301 | ◎ | ○ | ○ | ○ | ◎ | ○ | ◎ | ○ |
| E302 | ◎ | ○ | ◎ | ○ | ◎ | ◎ | ◎ | ○ |
| E303 | ○ | ○ | ◎ | ○ | ◎ | ◎ | ◎ | ○ |
| E304 | ○ | ○ | ◎ | ○ | ○ | ◎ | ○ | ○ |
| E305 | ○ | ○ | ○ | ○ | ○ | ○ | ◎ | ○ |
| E306 | ◎ | ○ | ◎ | ○ | ◎ | ◎ | ○ | ○ |
| Comparative example 2E | x | ○ | ○ | ○ | x | Δ | Δ | x |

| Drum No. | Sensitivity deterioration | Increase of image defect | Sample No. | Maximum value of hydrogen content (atomic %) |
|---|---|---|---|---|
| E301 | ○ | ◎ | E301-1 | 49 |
| E302 | ◎ | ◎ | E302-1 | 58 |
| E303 | ◎ | ◎ | E303-1 | 62 |
| E304 | ◎ | ◎ | E304-1 | 63 |
| E305 | ◎ | ○ | E305-1 | 68 |
| E306 | ○ | ○ | E306-1 | 55 |
| Comparative example 2E | ○ | x | Comparative ex. 2-1E | 85 |

TABLE 9E

| Drum No. | E401 | E402 | E403 | E404 | E405 | E406 |
|---|---|---|---|---|---|---|
| Flow rate (SCCM) | $SiH_4$ 350<br>$H_2$ 350 | $SiH_4$ 200<br>$H_2$ 600 | $SiH_4$ 350<br>$H_2$ 350<br>$B_2H_6$ 0.3 ppm (Based on $SiH_4$) | $SiH_4$ 350<br>Ar 350 | $SiH_4$ 350<br>He 350<br>$B_2H_6$ 0.3 ppm (Based on $SiH_4$) | $SiH_4$ 200<br>$SiF_4$ 100<br>$H_2$ 300 |
| Substrate temperature (°C.) | 250 | 250 | 250 | 250 | 250 | 250 |
| RF power (W) | 200 | 400 | 300 | 250 | 300 | 400 |
| Inner pressure (Torr) | 0.4 | 0.42 | 0.4 | 0.4 | 0.4 | 0.38 |
| Film thickness (μm) | 20 | 20 | 20 | 20 | 20 | 20 |

TABLE 10E

| Drum No. | Initial charging ability | Initial sensitivity | Image flow | Interference fringe | Residual potential | Ghost | Photosensitivity irregularity in generator direction | Image defect | Sensitivity deterioration | Increase of image defect |
|---|---|---|---|---|---|---|---|---|---|---|
| E401 | ◎ | ○ | ◎ | ○ | ◎ | ◎ | ◎ | ◎ | ◎ | ◎ |
| E402 | ◎ | ○ | ◎ | ○ | ◎ | ◎ | ◎ | ○ | ◎ | ◎ |

TABLE 10E-continued

| Drum No. | Initial charging ability | Initial sensitivity | Image flow | Interference fringe | Residual potential | Ghost | Photosensitivity irregularity in generator direction | Image defect | Sensitivity deterioration | Increase of image defect |
|---|---|---|---|---|---|---|---|---|---|---|
| E403 | ○ | ○ | ◎ | ○ | ◎ | ◎ | ◎ | ○ | ◎ | ◎ |
| E404 | ◎ | ○ | ◎ | ○ | ◎ | ◎ | ◎ | ○ | ◎ | ○ |
| E405 | ○ | ○ | ◎ | ○ | ◎ | ◎ | ◎ | ○ | ◎ | ◎ |
| E406 | ◎ | ○ | ◎ | ○ | ◎ | ◎ | ◎ | ○ | ◎ | ○ |

TABLE 11E

| Drum No. | E501 | E502 | E503 | E504 | E505* | E506 |
|---|---|---|---|---|---|---|
| Flow rate (SCCM) | $SiH_4$ 150<br>$B_2H_6$ 500 ppm<br>(Based on $SiH_4$)<br>NO 10<br>$H_2$ 500 | $SiH_4$ 150<br>$B_2H_6$ 100 ppm<br>(Based on $SiH_4$)<br>NO 5<br>$H_2$ 700 | $SiH_4$ 150<br>$PH_3$ 100 ppm<br>(Based on $SiH_4$)<br>NO 5<br>$H_2$ 700 | $SiH_4$ 150<br>$B_2H_6$ 500 ppm<br>(Based on $SiH_4$)<br>NO 10<br>Ar 500 | $SiH_4$ 150<br>$B_2H_6$ 1000 ppm<br>(Based on $SiH_4$)<br>NO 10<br>He 500 | $SiH_4$ 100<br>$SiF_4$ 50<br>$B_2H_6$ 500 ppm<br>(Based on $SiH_4$)<br>NO 10<br>$H_2$ 500 |
| Substrate temperature (°C.) | 350 | 350 | 350 | 350 | 350 | 350 |
| RF power (W) | 1200 | 1200 | 1200 | 1500 | 1500 | 1500 |
| Inner pressure (Torr) | 0.5 | 0.5 | 0.5 | 0.5 | 0.5 | 0.5 |
| Film thickness (μm) | 1 | 1 | 1 | 1 | 1 | 0.8 |

*Only the preparation conditions for photoconductive layer are the same as drum No. E405.

TABLE 12E

| Drum No. | Initial charging ability | Initial sensitivity | Image flow | Interference fringe | Residual potential | Ghost | Photosensitivity irregularity in generator direction | Image defect |
|---|---|---|---|---|---|---|---|---|
| E501 | ◎ | ○ | ○ | ○ | ◎ | ◎ | ◎ | ◎ |
| E502 | ○ | ○ | ◎ | ○ | ◎ | ◎ | ○ | ○ |
| E503 | ○ | ○ | ◎ | ○ | ◎ | ○ | ○ | ○ |
| E504 | ◎ | ○ | ○ | ○ | ◎ | ○ | ◎ | ○ |
| E505 | ○ | ○ | ◎ | ○ | ◎ | ◎ | ◎ | ○ |
| E506 | ◎ | ○ | ○ | ○ | ◎ | ◎ | ◎ | ○ |

| Drum No. | Sensitivity deterioration | Increase of image defect | Remark | Sample No. | Presence of crystallinity |
|---|---|---|---|---|---|
| E501 | ◎ | ◎ | | E501-1 | Observed |
| E502 | ○ | ◎ | | E502-1 | " |
| E503 | ◎ | ◎ | (−) charged | E503-1 | " |
| E504 | ○ | ○ | | E504-1 | " |
| E505 | ◎ | ◎ | | E505-1 | " |
| E506 | ◎ | ○ | | E506-1 | " |

TABLE 13E

| Drum No. | E601 | E602 | E603 | E604 | E605* | E606 |
|---|---|---|---|---|---|---|
| Flow rate (SCCM) | $SiH_4$ 150<br>$B_2H_6$ 500 ppm<br>(Based on $SiH_4$)<br>NO 10 → 0<br>$H_2$ 500 | $SiH_4$ 150<br>$B_2H_6$ 100 ppm<br>(Based on $SiH_4$)<br>NO 5 → 0<br>$H_2$ 700 | $SiH_4$ 150<br>$PH_3$ 100 ppm<br>(Based on $SiH_4$)<br>NO 5 → 0<br>$H_2$ 700 | $SiH_4$ 150<br>$B_2H_6$ 500 ppm<br>(Based on $SiH_4$)<br>NO 10 → 0<br>Ar 500 | $SiH_4$ 150<br>$B_2H_6$ 1000 ppm<br>(Based on $SiH_4$)<br>NO 10 → 0<br>He 500 | $SiH_4$ 100<br>$SiF_4$ 50<br>$B_2H_6$ 500 ppm<br>(Based on $SiH_4$)<br>NO 10 → 0<br>$H_2$ 500 |
| Substrate temperature (°C.) | 350 | 350 | 350 | 350 | 350 | 350 |
| RF power (W) | 1200 | 1200 | 1200 | 1500 | 1500 | 1500 |
| Inner pressure (Torr) | 0.5 | 0.5 | 0.5 | 0.5 | 0.5 | 0.5 |
| Film thickness (μm) | 1 | 1 | 1 | 1 | 1 | 0.8 |

*Only the preparation conditions for photoconductive layer are the same as drum No. E405.

TABLE 14E

| Drum No. | Initial charging ability | Initial sensitivity | Image flow | Interference fringe | Residual potential | Ghost | Photosensitivity irregularity in generator direction | Image defect |
|---|---|---|---|---|---|---|---|---|
| E601 | ◎ | ○ | ○ | ◎ | ◎ | ◎ | ◎ | ◎ |
| E602 | ○ | ○ | ◎ | ○ | ◎ | ◎ | ○ | ◎ |
| E603 | ○ | ○ | ◎ | ○ | ◎ | ◎ | ○ | ○ |
| E604 | ◎ | ○ | ○ | ◎ | ◎ | ◎ | ◎ | ○ |
| E605 | ○ | ○ | ◎ | ◎ | ◎ | ◎ | ◎ | ◎ |
| E606 | ◎ | ○ | ○ | ◎ | ◎ | ○ | ◎ | ○ |

| Drum No. | Sensitivity deterioration | Increase of image defect | Remark | Sample No. | Presence of crystallinity |
|---|---|---|---|---|---|
| E601 | ◎ | ◎ | | E601-1 | Observed |
| E602 | ○ | ◎ | | E602-1 | " |
| E603 | ◎ | ○ | (−) Charged | E603-1 | " |
| E604 | ○ | ◎ | | E604-1 | " |
| E605 | ◎ | ◎ | | E605-1 | " |
| E606 | ◎ | ○ | | E606-1 | " |

TABLE 15E

| Drum No. | E701 | E702 | E703 | E704 | E705-1 | E705-2 | E706 |
|---|---|---|---|---|---|---|---|
| Flow rate (SCCM) | $SiH_4$ 150<br>$B_2H_6$ 1000 ppm<br>(Based on $SiH_4$)<br>NO 10<br>$GeH_4$ 30<br>$H_2$ 500 | $SiH_4$ 150<br>$B_2H_6$ 500 ppm<br>(Based on $SiH_4$)<br>NO 5<br>$GeH_4$ 50<br>$H_2$ 700 | $SiH_4$ 150<br>$PH_3$ 100 ppm<br>(Based on $SiH_4$)<br>NO 5<br>$GeH_4$ 70<br>$H_2$ 700 | $SiH_4$ 150<br>$B_2H_6$ 500 ppm<br>(Based on $SiH_4$)<br>NO 10<br>$GeH_4$ 10<br>Ar 500 | $SiH_4$ 150<br>$B_2H_6$ 1000 ppm<br>(Based on $SiH_4$)<br>NO 10<br>$GeH_4$ 50<br>$H_2$ 500 | | $SiH_4$ 100<br>$SiF_4$ 50<br>$B_2H_6$ 1000 ppm<br>(Based on $SiH_4$)<br>NO 10<br>$GeH_4$ 50<br>$H_2$ 500 |
| Substrate temperature (°C.) | 350 | 350 | 350 | 350 | 350 | | 350 |
| RF power (W) | 1200 | 1200 | 1200 | 1500 | 1500 | | 1500 |
| Inner pressure (Torr) | 0.3 | 0.3 | 0.3 | 0.3 | 0.3 | | 0.3 |
| Film thickness (μm) | 0.1 | 0.1 | 0.1 | 0.1 | 0.1 | | 0.1 |
| Remark | | | | | *1 | *2 | |

*1 The photoconductive layer preparation conditions are the same as drum No. E405, and the charge injection preventive layer preparation conditions as drum No. E505.

*2 The photoconductive layer preparation conditions are the same as drum No. E405, and the charge injection preventive layer preparation conditions as drum No. E605.

TABLE 16E

| Drum No. | Initial charging ability | Initial sensitivity | Image flow | Interference fringe | Residual potential | Ghost | Photosensitivity irregularity in generator direction | Image defect |
|---|---|---|---|---|---|---|---|---|
| E701 | ◎ | ○ | ○ | ○ | ◎ | ◎ | ○ | ○ |
| E702 | ◎ | ○ | ◎ | ◎ | ◎ | ◎ | ○ | ○ |
| E703 | ◎ | ○ | ◎ | ○ | ◎ | ◎ | ◎ | ○ |
| E704 | ○ | ○ | ○ | ○ | ◎ | ○ | ○ | ○ |
| E705-1 | ○ | ○ | ◎ | ○ | ◎ | ◎ | ◎ | ○ |
| E705-2 | ○ | ○ | ◎ | ◎ | ◎ | ◎ | ◎ | ◎ |
| E706 | ◎ | ○ | ○ | ○ | ◎ | ○ | ◎ | ○ |

| Drum No. | Sensitivity deterioration | Increase of image defect | Sample No. | Presence of crystallinity |
|---|---|---|---|---|
| E701 | ○ | ◎ | E701-1 | Observed |
| E702 | ○ | ○ | E702-1 | " |
| E703 | ○ | ◎ | E703-1 | " |
| E704 | ◎ | ◎ | E704-1 | " |
| E705-1 | ◎ | ◎ | E705-3 | " |
| E705-2 | ◎ | ◎ | E705-4 | " |
| E706 | ◎ | ○ | E706-1 | " |

TABLE 17E

| Drum No. | E801 | E802 | E803 | E804 | E805-1 | E805-2 | E806 |
|---|---|---|---|---|---|---|---|
| Flow rate (SCCM) | $SiH_4$ 150<br>$B_2H_6$ 1000 ppm<br>(Based on $SiH_4$) | $SiH_4$ 150<br>$B_2H_6$ 500 ppm<br>(Based on $SiH_4$) | $SiH_4$ 150<br>$PH_3$ 100 ppm<br>(Based on $SiH_4$) | $SiH_4$ 150<br>$B_2H_6$ 500 ppm<br>(Based on $SiH_4$) | $SiH_4$ 150<br>$B_2H_6$ 1000 ppm<br>(Based on $SiH_4$) | $SiH_4$ 100<br>$SiF_4$ 50<br>$B_2H_6$ 1000 ppm | |

TABLE 17E-continued

| Drum No. | E801 | E802 | E803 | E804 | E805-1 | E805-2 | E806 |
|---|---|---|---|---|---|---|---|
| | NO 10<br>$GeH_4$ 30 → 0<br>$H_2$ 500 | NO 5<br>$GeH_4$ 50 → 0<br>$H_2$ 700 | NO 5<br>$GeH_4$ 70 → 0<br>$H_2$ 700 | NO 10<br>$GeH_4$ 10 → 0<br>Ar 500 | NO 10<br>$GeH_4$ 50 → 0<br>$H_e$ 500 | | (Based on $SiH_4$)<br>NO 10<br>$GeH_4$ 50 → 0<br>$H_2$ 500 |
| Substrate temperature (°C.) | 350 | 350 | 350 | 350 | 350 | | 350 |
| RF power (W) | 1200 | 1200 | 1200 | 1500 | 1500 | | 1500 |
| Inner pressure (Torr) | 0.3 | 0.3 | 0.3 | 0.3 | 0.3 | | 0.3 |
| Film thickness (μm) | 0.1 | 0.1 | 0.1 | 0.1 | 0.1 | | 0.1 |
| Remark | | | | | *1 | *2 | |

*1: The photoconductive layer preparation conditions are the same as drum No. E405, and the charge injection preventive layer preparation conditions as drum No. E505.
*2: The photoconductive layer preparation conditions are the same as drum No. E405, and the charge injection preventive layer preparation conditions as drum No. E605.

TABLE 18E

| Drum No. | Initial charging ability | Initial sensitivity | Image flow | Interference fringe | Residual potential | Ghost | Photosensitivity irregularity in generator direction | Image defect |
|---|---|---|---|---|---|---|---|---|
| E801 | ◎ | ○ | ○ | ◎ | ◎ | ◎ | ○ | ◎ |
| E802 | ◎ | ○ | ◎ | ◎ | ◎ | ◎ | ○ | ○ |
| E803 | ◎ | ○ | ◎ | ◎ | ◎ | ◎ | ◎ | ○ |
| E804 | ○ | ○ | ○ | ○ | ◎ | ○ | ○ | ○ |
| E805-1 | ○ | ○ | ◎ | ◎ | ◎ | ◎ | ◎ | ◎ |
| E805-2 | ○ | ○ | ◎ | ◎ | ◎ | ◎ | ◎ | ◎ |
| E806 | ◎ | ○ | ○ | ◎ | ◎ | ○ | ◎ | ◎ |

| Drum No. | Sensitivity deterioration | Increase of image defect | Sample No. | Presence of crystallinity |
|---|---|---|---|---|
| E801 | ○ | ◎ | E801-1 | Observed |
| E802 | ○ | ○ | E802-1 | " |
| E803 | ◎ | ◎ | E803-1 | " |
| E804 | ○ | ◎ | E804-1 | " |
| E805-1 | ◎ | ◎ | E805-3 | " |
| E805-2 | ◎ | ◎ | E805-4 | " |
| E806 | ◎ | ◎ | E806-1 | " |

TABLE 19E

| Drum No. | E901 | E902 | E903 | E904 | E905-1 | E905-2 | E906 |
|---|---|---|---|---|---|---|---|
| Flow rate (SCCM) | $SiH_4$ 150<br>$B_2H_6$ 1000 ppm<br>(Based on $SiH_4$)<br>NO 10<br>$GeH_4$ 30<br>$H_2$ 350 | $SiH_4$ 150<br>$B_2H_6$ 500 ppm<br>(Based on $SiH_4$)<br>NO 5<br>$GeH_4$ 50<br>$H_2$ 350 | $SiH_4$ 150<br>$PH_3$ 100 ppm<br>(Based on $SiH_4$)<br>NO 5<br>$GeH_4$ 70<br>$H_2$ 350 | $SiH_4$ 150<br>$B_2H_6$ 500 ppm<br>(Based on $SiH_4$)<br>NO 10<br>$GeH_4$ 10<br>Ar 350 | $SiH_4$ 150<br>$B_2H_6$ 1000 ppm<br>(Based on $SiH_4$)<br>NO 10<br>$GeH_4$ 50<br>$H_e$ 350 | | $SiH_4$ 100<br>$SiF_4$ 50<br>$B_2H_6$ 1000 ppm<br>(Based on $SiH_4$)<br>NO 10<br>$GeH_4$ 50<br>$H_2$ 350 |
| Substrate temperature (°C.) | 250 | 250 | 250 | 250 | 250 | | 250 |
| RF power (W) | 150 | 200 | 150 | 150 | 150 | | 150 |
| Inner pressure (Torr) | 0.27 | 0.27 | 0.27 | 0.27 | 0.27 | | 0.27 |
| Film thickness (μm) | 0.5 | 0.5 | 0.5 | 0.5 | 0.5 | | 0.4 |
| Remark | | | | | *1 | *2 | |

*1: The photoconductive layer preparation conditions are the same as drum No. E405, and the charge injection preventive layer preparation conditions as drum No. E505.
*2: The photoconductive layer preparation conditions are the same as drum No. E405, and the charge injection preventive layer preparation conditions as drum No. E605.

TABLE 20E

| Drum No. | Initial charging ability | Initial sensitivity | Image flow | Interference fringe | Residual potential | Ghost | Photosensitivity irregularity in generator direction | Image defect |
|---|---|---|---|---|---|---|---|---|
| E901 | ◎ | ○ | ○ | ○ | ◎ | ◎ | ◎ | ○ |
| E902 | ◎ | ○ | ◎ | ◎ | ◎ | ◎ | ○ | ○ |
| E903 | ◎ | ○ | ◎ | ○ | ◎ | ◎ | ◎ | ○ |

TABLE 20E-continued

| | | | | | | | |
|---|---|---|---|---|---|---|---|
| E904 | ○ | ○ | ○ | ○ | ◎ | ○ | ○ | ○ |
| E905-1 | ○ | ○ | ◎ | ○ | ◎ | ◎ | ◎ | ○ |
| E905-2 | ○ | ○ | ◎ | ◎ | ◎ | ◎ | ◎ | ◎ |
| E906 | ◎ | ○ | ○ | ○ | ◎ | ○ | ○ | ○ |

| Drum No. | Sensitivity deterioration | Increase of image defect | Sample No. | Presence of crystallinity |
|---|---|---|---|---|
| E901 | ○ | ◎ | E901-1 | None |
| E902 | ◎ | ◎ | E902-1 | None |
| E903 | ◎ | ○ | E903-1 | None |
| E904 | ○ | ◎ | E904-1 | None |
| E905-1 | ◎ | ◎ | E905-3 | None |
| E905-2 | ◎ | ◎ | E905-4 | None |
| E906 | ○ | ○ | E906-1 | None |

TABLE 21E

| Drum No. | E1001 | E1002 | E1003 | E1004 | E1005-1 | E1005-2 | E1006 |
|---|---|---|---|---|---|---|---|
| Flow rate (SCCM) | $SiH_4$ 150<br>$B_2H_6$ 1000 ppm (Based on $SiH_4$)<br>NO 10<br>$GeH_4$ 30 → 0<br>$H_2$ 350 | $SiH_4$ 150<br>$B_2H_6$ 500 ppm (Based on $SiH_4$)<br>NO 5<br>$GeH_4$ 50 → 0<br>$H_2$ 350 | $SiH_4$ 150<br>$PH_3$ 100 ppm (Based on $SiH_4$)<br>NO 5<br>$GeH_4$ 70 → 0<br>$H_2$ 350 | $SiH_4$ 150<br>$B_2H_6$ 500 ppm (Based on $SiH_4$)<br>NO 10<br>$GeH_4$ 10 → 0<br>Ar 350 | $SiH_4$ 150<br>$B_2H_6$ 1000 ppm (Based on $SiH_4$)<br>NO 10<br>$GeH_4$ 50 → 0<br>$H_2$ 350 | | $SiH_4$ 100<br>$SiF_4$ 50<br>$B_2H_6$ 1000 ppm (Based on $SiH_4$)<br>NO 10<br>$GeH_4$ 50 → 0<br>$H_2$ 350 |
| Substrate temperature (°C.) | 250 | 250 | 250 | 250 | 250 | | 250 |
| RF power (W) | 150 | 200 | 150 | 150 | 150 | | 150 |
| Inner pressure (Torr) | 0.27 | 0.27 | 0.27 | 0.27 | 0.27 | | 0.27 |
| Film thickness (μm) | 0.5 | 0.5 | 0.5 | 0.5 | 0.5 | | 0.4 |
| Remark | | | | | *1 | *2 | |

*1: The photoconductive layer preparation conditions are the same as drum No. E405, and the charge injection preventive layer preparation conditions as drum No. E505.
*2: The photoconductive layer preparation conditions are the same as drum No. E405, and the charge injection preventive layer preparation conditions as drum No. E605.

TABLE 22E

| Drum No. | Initial charging ability | Initial sensitivity | Image flow | Interference fringe | Residual potential | Ghost | Photosensitivity irregularity in generator direction | Image defect |
|---|---|---|---|---|---|---|---|---|
| E1001 | ◎ | ○ | ○ | ◎ | ◎ | ◎ | ◎ | ◎ |
| E1002 | ◎ | ○ | ◎ | ◎ | ◎ | ◎ | ○ | ○ |
| E1003 | ◎ | ○ | ◎ | ◎ | ◎ | ◎ | ◎ | ○ |
| E1004 | ○ | ○ | ○ | ○ | ◎ | ○ | ○ | ○ |
| E1005-1 | ○ | ○ | ◎ | ◎ | ◎ | ◎ | ◎ | ◎ |
| E1005-2 | ○ | ○ | ◎ | ◎ | ◎ | ◎ | ◎ | ◎ |
| E1006 | ◎ | ○ | ○ | ◎ | ◎ | ○ | ○ | ○ |

| Drum No. | Sensitivity deterioration | Increase of image defect | Sample No. | Presence of crystallinity |
|---|---|---|---|---|
| E1001 | ◎ | ◎ | E1001-1 | None |
| E1002 | ○ | ◎ | E1002-1 | None |
| E1003 | ◎ | ○ | E1003-1 | None |
| E1004 | ○ | ◎ | E1004-1 | None |
| E1005-1 | ◎ | ◎ | E1005-3 | None |
| E1005-2 | ◎ | ◎ | E1005-4 | None |
| E1006 | ○ | ◎ | E1006-1 | None |

TABLE 23E

| Drum No. | E1101 | E1102 | E1103 |
|---|---|---|---|
| Flow rate (SCCM) | $SiH_4$ 50<br>$H_2$ 600<br>$NH_3$ 500 | $SiH_4$ 50<br>$H_2$ 600<br>NO 500 | $SiH_4$ 50<br>$H_2$ 600<br>$N_2$ 500 |
| Substrate temperature (°C.) | 350 | 350 | 350 |

TABLE 23E-continued

| Drum No. | E1101 | E1102 | E1103 |
|---|---|---|---|
| RF power (W) | 1000 | 1000 | 1000 |
| Inner pressure (Torr) | 0.6 | 0.6 | 0.5 |
| Film thickness (μm) | 0.1 | 0.1 | 0.1 |

TABLE 24E

| | Initial | Photosensitivity irregularity |
|---|---|---|

TABLE 24E-continued

| Drum No. | charging ability | Initial sensitivity | Image flow | Interference fringe | Residual potential | Ghost | in generator direction | Image defect |
|---|---|---|---|---|---|---|---|---|
| E1101 | ◎ | ○ | ◎ | ○ | ◎ | ◎ | ◎ | ◎ |
| E1102 | ◎ | ○ | ○ | ○ | ◎ | ◎ | ◎ | ◎ |
| E1103 | ◎ | ○ | ◎ | ○ | ◎ | ◎ | ◎ | ◎ |

| Drum No. | Sensitivity deterioration | Increase of image defect | Sample No. | Presence of crystallinity |
|---|---|---|---|---|
| E1101 | ◎ | ◎ | E1101-1 | Observed |
| E1102 | ◎ | ◎ | E1102-1 | " |
| E1103 | ◎ | ◎ | E1103-1 | " |

TABLE 25E

| Drum No. | E1201 | E1202 | E1203 |
|---|---|---|---|
| Flow rate (SCCM) | $SiH_4$ 50<br>$NH_3$ 500 | $SiH_4$ 50<br>NO 500 | $SiH_4$ 50<br>$N_2$ 500 |
| Substrate temperature (°C.) | 250 | 250 | 250 |
| RF power (W) | 150 | 200 | 200 |
| Inner pressure (Torr) | 0.3 | 0.3 | 0.3 |
| Film thickness (μm) | 0.1 | 0.1 | 0.1 |

TABLE 27E

| Drum No. | E1301 | E1302 | E1303 | E1304 | E1305 |
|---|---|---|---|---|---|
| a (μm) | 25 | 50 | 50 | 12 | 12 |
| b (μm) | 0.8 | 2.5 | 0.8 | 1.5 | 0.3 |

TABLE 28E

| Drum No. | Initial charging ability | Initial sensitivity | Image flow | Interference fringe | Residual potential | Ghost | Photosensitivity irregularity in generator direction | Image defect |
|---|---|---|---|---|---|---|---|---|
| E1301 | ◎ | ○ | ◎ | ○ | ◎ | ◎ | ◎ | ◎ |
| E1302 | ◎ | ○ | ◎ | ◎ | ◎ | ◎ | ◎ | ○ |
| E1303 | ◎ | ○ | ◎ | ○ | ◎ | ◎ | ◎ | ○ |
| E1304 | ◎ | ○ | ◎ | ◎ | ◎ | ◎ | ◎ | ○ |
| E1305 | ◎ | ○ | ◎ | ○ | ◎ | ◎ | ◎ | ○ |

| Drum No. | Sensitivity deterioration | Increase of image defect | Resolving Power of image |
|---|---|---|---|
| E1301 | ◎ | ◎ | ○ |
| E1302 | ◎ | ◎ | ○ |
| E1303 | ◎ | ◎ | △ |
| E1304 | ◎ | ○ | ○ |
| E1305 | ◎ | ○ | ○ |

TABLE 29E

| Drum No. | E1401 | E1402 | E1403 | E1404 | E1405 |
|---|---|---|---|---|---|
| c (μm) | 50 | 100 | 100 | 30 | 30 |
| d (μm) | 2 | 5 | 1.5 | 2.5 | 0.7 |

TABLE 26E

| Drum No. | Initial charging ability | Initial sensitivity | Image flow | Interference fringe | Residual potential | Ghost | Photosensitivity irregularity in generator direction | Image defect |
|---|---|---|---|---|---|---|---|---|
| E1201 | ◎ | ○ | ◎ | ○ | ◎ | ◎ | ◎ | ◎ |
| E1202 | ◎ | ○ | ◎ | ○ | ◎ | ◎ | ◎ | ◎ |
| E1203 | ◎ | ○ | ○ | ○ | ◎ | ◎ | ◎ | ◎ |

| Drum No. | Sensitivity deterioration | Increase of image defect | Sample No. | Presence of crystallinity |
|---|---|---|---|---|
| E1201 | ◎ | ◎ | E1201-1 | Observed |
| E1202 | ◎ | ◎ | E1202-1 | " |
| E1203 | ◎ | ◎ | E1203-1 | " |

TABLE 30E

| Drum No. | Initial charging ability | Initial sensitivity | Image flow | Interference fringe | Residual potential | Ghost | Photosensitivity irregularity in generator direction | Image defect |
|---|---|---|---|---|---|---|---|---|
| E1401 | ◎ | ○ | ◎ | ◎ | ◎ | ◎ | ◎ | ◎ |
| E1402 | ◎ | ○ | ◎ | ◎ | ◎ | ◎ | ◎ | ○ |
| E1403 | ◎ | ○ | ◎ | ○ | ◎ | ◎ | ◎ | ○ |
| E1404 | ◎ | ○ | ◎ | ◎ | ◎ | ◎ | ◎ | ○ |
| E1405 | ◎ | ○ | ◎ | ○ | ◎ | ◎ | ◎ | ○ |

| | Sensitivity | Increase of | Resolving Power |
|---|---|---|---|

TABLE 30E-continued

| Drum No. | deterioration | image defect | of image |
|---|---|---|---|
| E1401 | ◎ | ◎ | Δ ~ ○ |
| E1402 | ◎ | ◎ | Δ ~ ○ |
| E1403 | ◎ | ◎ | Δ |
| E1404 | ◎ | ○ | ○ |
| E1405 | ◎ | ○ | ○ |

TABLE 1F

| Name of layer | Gases employed and flow rates (SCCM) | | Substrate temperature (°C.) | RF power (W) | Inner pressure (torr) | Film thickness (μm) |
|---|---|---|---|---|---|---|
| Adhesion layer | $SiH_4$ | 150 | 250 | 150 | 0.25 | 0.1 |
| | $B_2H_6$ (based on $SiH_4$) | 1000 ppm | | | | |
| | NO | 10 | | | | |
| | $N_2$ | 350 | | | | |
| Longer wavelength absorbing layer | $SiH_4$ | 150 | 250 | 150 | 0.27 | 0.5 |
| | $B_2H_6$ (based on $SiH_4$) | 1000 ppm | | | | |
| | NO | 10 | | | | |
| | $GeH_4$ | 50 | | | | |
| | $H_2$ | 500 | | | | |
| Charge injection preventive layer | $SiH_4$ | 150 | 250 | 150 | 0.25 | 3 |
| | $B_2H_6$ (based on $SiH_4$) | 1000 ppm | | | | |
| | NO | 10 | | | | |
| | $H_2$ | 350 | | | | |
| Photo-conductive layer | $SiH_4$ | 350 | 250 | 300 | 0.4 | 20 |
| | $H_2$ | 350 | | | | |
| Surface layer | $SiH_4$ | 350 → 10 | 250 | 300 → 200 | 0.4 → 0.45 | 1.5 |
| | $CH_4$ | 0 → 500 | | | | |
| | $H_2$ | 350 → 500 | | | | |

TABLE 2F

| | |
|---|---|
| Initial charging ability | ◎ |
| Initial sensitivity | ○ |
| Image flow | ◎ |
| Interference fringe | ○ |
| Residual potential | ◎ |

TABLE 2F-continued

| | |
|---|---|
| Maximum value of hydrogen content (atomic %) | 52 |

◎ - Very good
○ - Good
Δ - Practically acceptable
x - slightly poor in practical use

TABLE 3F

| Name of layer | Gases employed and flow rates (SCCM) | | Substrate temperature (°C.) | RF power (W) | Inner pressure (torr) | Film thickness (μm) |
|---|---|---|---|---|---|---|
| Adhesion layer | $SiH_4$ | 150 | 250 | 150 | 0.25 | 0.1 |
| | $B_2H_6$ (based on $SiH_4$) | 1000 ppm | | | | |
| | NO | 10 | | | | |
| | $H_2$ | 350 | | | | |
| Longer wavelength absorbing layer | $SiH_4$ | 150 | 250 | 150 | 0.27 | 0.5 |
| | $B_2H_6$ (based on $SiH_4$) | 1000 ppm | | | | |
| | NO | 10 | | | | |
| | $GeH_4$ | 50 | | | | |
| | $H_2$ | 350 | | | | |
| Charge injection preventive layer | $SiH_4$ | 150 | 250 | 150 | 0.25 | 3 |
| | $B_2H_6$ (based on $SiH_4$) | 1000 ppm | | | | |
| | NO | 10 | | | | |
| | $H_2$ | 350 | | | | |
| Photo-conductive layer | $SiH_4$ | 350 | 250 | 300 | 0.4 | 20 |
| | $H_2$ | 350 | | | | |
| Surface layer | $SiH_4$ | 350 → 10 | 150 | 300 → 100 | 0.4 → 0.7 | 1.5 |
| | $CH_4$ | 0 → 500 | | | | |
| | $H_2$ | 350 → 1000 | | | | |

| | |
|---|---|
| Ghost | ◎ |
| Photosensitivity irregularity in generator direction | ◎ |
| Image defect | ◎ |
| Sensitivity deterioration | ◎ |
| Increase of image defect | ○ |

TABLE 4F

| | |
|---|---|
| Initial charging ability | X |
| Initial sensitivity | ○ |
| Image flow | ○ |
| Interference fringe | ○ |

TABLE 4F-continued

| | |
|---|---|
| Residual potential | X |
| Ghost | Δ |
| Photosensitivity irregularity in generator direction | Δ |
| Image defect | X |
| Sensitivity deterioration | ○ |
| Increase of image defect | X |
| Maximum value of hydrogen content (atomic %) | 87 |

TABLE 6F-continued

| | |
|---|---|
| Initial sensitivity | ○ |
| Image flow | ◎ |
| Interference fringe | ◎ |
| Residual potential | ◎ |
| Ghost | ◎ |
| Photosensitivity irregularity in generator direction | ◎ |
| Image defect | ◎ |
| Sensitivity deterioration | ◎ |
| Increase of image defect | ◎ |

TABLE 5F

| Name of layer | Gases employed and flow rates (SCCM) | | Substrate temperature (°C.) | RF power (W) | Inner pressure (torr) | Film thickness (μm) |
|---|---|---|---|---|---|---|
| Adhesion layer | $SiH_4$ | 150 | 250 | 150 | 0.25 | 0.1 |
| | $B_2H_6$ (based on $SiH_4$) | 1000 ppm | | | | |
| | NO | 10 | | | | |
| | $H_2$ | 350 | | | | |
| Longer wavelength absorbing layer | $SiH_4$ | 150 | 250 | 150 | 0.27 | 0.5 |
| | $B_2H_6$ (based on $SiH_4$) | 1000 ppm | | | | |
| | NO | 10 | | | | |
| | $GeH_4$ | 50 → 0 | | | | |
| | $H_2$ | 350 | | | | |
| Charge injection preventive layer | $SiH_4$ | 150 | 250 | 150 | 0.25 | 3 |
| | $B_2H_6$ (based on $SiH_4$) | 1000 ppm | | | | |
| | NO | 10 → 0 | | | | |
| | $H_2$ | 350 | | | | |
| Photo-conductive layer | $SiH_4$ | 350 | 250 | 300 | 0.4 | 20 |
| | $H_2$ | 350 | | | | |
| Surface layer | $SiH_4$ | 350 → 10 | 250 | 300 → 200 | 0.4 → 0.41 | 1.5 |
| | $CH_4$ | 0 → 400 | | | | |
| | $H_2$ | 350 → 400 | | | | |

TABLE 6F

| | |
|---|---|
| Initial charging ability | ◎ |
| Maximum value of hydrogen content (atomic %) | 46 |

TABLE 7F

| Drum No. | F301 | F302 | F303 | F304 |
|---|---|---|---|---|
| Flow rate (SCCM) | $SiH_4$ 200 → 10<br>$CH_4$ 0 → 500<br>$H_2$ 0 → 400 | $SiH_4$ 200 → 10<br>$CH_4$ 0 → 500<br>$H_2$ 0 → 500 | $SiH_4$ 10<br>$CH_4$ 500<br>$H_2$ 500 | $SiH_4$ 300 → 10<br>$CH_4$ 0 → 600<br>$H_2$ 0 → 700 | $SiH_4$ 150 → 10<br>$CH_4$ 0 → 400<br>$H_2$ 0 → 700 | $SiH_4$ 10<br>$CH_4$ 400<br>$H_2$ 700 |
| Substrate temperature (°C.) | 200 | 250 | 250 | 250 |
| RF power (W) | 300 → 150 | 300 → 200 | 200 | 300 → 200 | 300 → 200 | 200 |
| Inner pressure (torr) | 0.35 → 0.42 | 0.35 → 0.45 | 0.45 | 0.4 → 0.5 | 0.32 → 0.46 | 0.46 |
| Film thickness (μm) | 1.5 | 1 | 0.5 | 1.5 | 1 | 0.5 |

| Drum No. | F305 | F306 | | Comparative example 2F |
|---|---|---|---|---|
| Flow rate (SCCM) | $SiH_4$ 200 → 10<br>$C_2H_4$ 0 → 500<br>$H_2$ 0 → 700 | $SiH_4$ 200 → 10<br>$C_2H_4$ 0 → 500<br>$H_2$ 0 → 500 | $SiH_4$ 10<br>$CH_4$ 500<br>$H_2$ 500 | $SiH_4$ 200 → 10<br>$CH_4$ 0 → 500<br>$H_2$ 0 → 800 |
| Substrate temperature (°C.) | 250 | 250 | | 150 |
| RF power (W) | 300 → 200 | 300 → 200 | 200 | 300 → 200 |
| Inner pressure (torr) | 0.35 → 0.46 | 0.35 → 0.46 | 0.46 | 0.35 → 0.65 |
| Film | 1.5 | 1 | 0.5 | 1.5 |

TABLE 7F-continued

| | thickness (μm) |
|---|---|

TABLE 8F

| Drum No. | F301 | F302 | F303 | F304 | F305 | F306 | Comparative example 2F |
|---|---|---|---|---|---|---|---|
| Initial charging ability | ◎ | ◎ | ○ | ○ | ○ | ◎ | X |
| Initial sensitivity | ○ | ○ | ○ | ○ | ○ | ○ | ○ |
| Image flow | ○ | ◎ | ◎ | ◎ | ○ | ◎ | ○ |
| Interference fringe | ○ | ○ | ○ | ○ | ○ | ○ | ○ |
| Residual potential | ◎ | ◎ | ◎ | ○ | ○ | ◎ | X |
| Ghost | ○ | ◎ | ◎ | ◎ | ○ | ◎ | Δ |
| Photosensitivity irregularity in generator direction | ◎ | ◎ | ○ | ◎ | ○ | ◎ | Δ |
| Image defect | ◎ | ◎ | ○ | ◎ | ○ | ◎ | X |
| Sensitivity deterioration | ◎ | ◎ | ◎ | ○ | ○ | ◎ | ○ |
| Increase of image defect | ○ | ○ | ○ | ○ | ○ | ○ | X |
| Sample No. | F301 −1 | F302 −1 | F303 −1 | F304 −1 | F305 −1 | F306 −1 | Cpmparative example 2-1F |
| Maximum value of hydrogen content (atomic %) | 48 | 58 | 63 | 64 | 69 | 56 | 85 |

TABLE 9F

| Drum No. | F401 | F402 | F403 | F404 | F405 | F406 |
|---|---|---|---|---|---|---|
| Flow rate (SCCM) | $SiH_4$ 350<br>$H_2$ 350 | $SiH_4$ 200<br>$H_2$ 600 | $SiH_4$ 350<br>$H_2$ 350<br>$B_2H_6$ 0.3 ppm (based on $SiH_4$) | $SiH_4$ 350<br>Ar 350 | $SiH_4$ 350<br>He 350<br>$B_2H_6$ 0.3 ppm (based on $SiH_4$) | $SiH_4$ 200<br>$SiF_4$ 100<br>$H_2$ 300 |
| Substrate temperature (°C.) | 250 | 250 | 250 | 250 | 250 | 250 |
| RF power (W) | 200 | 400 | 300 | 250 | 300 | 400 |
| Inner pressure (torr) | 0.4 | 0.42 | 0.4 | 0.4 | 0.4 | 0.38 |
| Film thickness (μm) | 20 | 20 | 20 | 20 | 20 | 20 |

TABLE 10F

| Drum No. | F401 | F402 | F403 | F404 | F405 | F406 |
|---|---|---|---|---|---|---|
| Initial charging ability | ○ | ◎ | ○ | ◎ | ○ | ◎ |
| Initial sensitivity | ◎ | ○ | ○ | ○ | ○ | ○ |
| Image flow | ◎ | ◎ | ◎ | ◎ | ◎ | ◎ |
| Interference fringe | ○ | ○ | ○ | ○ | ○ | ○ |
| Residual potential | ◎ | ◎ | ◎ | ◎ | ◎ | ◎ |
| Ghost | ◎ | ◎ | ◎ | ◎ | ◎ | ◎ |
| Photosensitivity irregularity in generator direction | ◎ | ◎ | ◎ | ◎ | ◎ | ◎ |
| Image defect | ◎ | ◎ | ○ | ◎ | ◎ | ◎ |
| Sensitivity deterioration | ◎ | ◎ | ◎ | ◎ | ◎ | ◎ |
| Increase of image defect | ○ | ○ | ○ | ○ | ○ | ○ |

TABLE 11F

| Drum No. | F501 | F502 | F503 | F504 | F505* | F506 |
|---|---|---|---|---|---|---|
| Flow rate (SCCM) | $SiH_4$ 150<br>$B_2H_6$ 500 ppm (based on $SiH_4$)<br>NO 10<br>$H_2$ 350 | $SiH_4$ 150<br>$B_2H_6$ 100 ppm (based on $SiH_4$)<br>NO 5<br>$H_2$ 350 | $SiH_4$ 150<br>$PH_3$ 100 ppm (based on $SiH_4$)<br>NO 5<br>$H_2$ 350 | $SiH_4$ 150<br>$B_2H_6$ 500 ppm (based on $SiH_4$)<br>NO 10<br>Ar 350 | $SiH_4$ 150<br>$B_2H_6$ 1000 ppm (based on $SiH_4$)<br>NO 10<br>He 350 | $SiH_4$ 100<br>$SiF_4$ 50<br>$B_2H_6$ 500 ppm (based on $SiH_4$)<br>NO 10<br>$H_2$ 350 |
| Substrate temperature (°C.) | 250 | 250 | 250 | 250 | 350 | 250 |
| RF power (W) | 150 | 150 | 150 | 150 | 150 | 150 |
| Inner pressure (torr) | 0.25 | 0.25 | 0.25 | 0.25 | 0.25 | 0.25 |
| Film thickness (μm) | 3 | 3 | 3 | 3 | 3 | 2.7 |

*Only the preparation conditions for photoconductive layer are the same as drum No. F405

TABLE 12F

| Drum No. | F501 | F502 | F503 | F504 | F505 | F506 |
|---|---|---|---|---|---|---|
| Initial charging ability | ◎ | ○ | ○ | ◎ | ○ | ◎ |
| Initial sensitivity | ○ | ○ | ○ | ○ | ○ | ○ |
| Image flow | ○ | ◎ | ○ | ○ | ◎ | ○ |
| Interference fringe | ○ | ○ | ○ | ○ | ○ | ○ |
| Residual potential | ◎ | ◎ | ○ | ◎ | ◎ | ○ |
| Ghost | ◎ | ◎ | ○ | ○ | ◎ | ○ |
| Photosensitivity irregularity in generator direction | ◎ | ○ | ◎ | ◎ | ◎ | ○ |
| Image defect | ◎ | ◎ | ◎ | ◎ | ◎ | ◎ |
| Sensitivity deterioration | ◎ | ○ | ◎ | ◎ | ◎ | ○ |
| Increase of image defect | ○ | ○ | ○ | ○ | ○ | ○ |
| Remark | | | (−) charg-ing | | | |

TABLE 14F

| Drum No. | F601 | F602 | F603 | F604 | F605 | F606 |
|---|---|---|---|---|---|---|
| Initial charging ability | ○ | ○ | ○ | ◎ | ○ | ◎ |
| Initial sensitivity | ○ | ○ | ○ | ○ | ○ | ○ |
| Image flow | ○ | ○ | ○ | ○ | ◎ | ○ |
| Interference fringe | ◎ | ◎ | ◎ | ◎ | ◎ | ◎ |
| Residual potential | ◎ | ◎ | ◎ | ○ | | ○ |
| Ghost | ◎ | ○ | ◎ | ○ | ◎ | ○ |
| Photosensitivity irregularity in generator direction | ◎ | ○ | ◎ | ◎ | ◎ | ○ |
| Image defect | ◎ | ◎ | ○ | ◎ | ◎ | ◎ |
| Sensitivity deterioration | ◎ | ○ | ○ | ○ | ○ | ○ |
| Increase of image defect | ◎ | ○ | ○ | ○ | ◎ | ○ |

TABLE 13F

| Drum No. | F601 | F602 | F603 | F604 | F605* | F606 |
|---|---|---|---|---|---|---|
| Flow rate (SCCM) | $SiH_4$ 150<br>$B_2H_6$ 500 ppm (based on $SiH_4$)<br>NO 10 → 0<br>$H_2$ 350 | $SiH_4$ 150<br>$B_2H_6$ 100 ppm (based on $SiH_4$)<br>NO 5 → 0<br>$H_2$ 350 | $SiH_4$ 150<br>$PH_3$ 100 ppm (based on $SiH_4$)<br>NO 5 → 0<br>$H_2$ 350 | $SiH_4$ 150<br>$B_2H_6$ 500 ppm (based on $SiH_4$)<br>NO 10 → 0<br>Ar 350 | $SiH_4$ 150<br>$B_2H_6$ 1000 ppm (based on $SiH_4$)<br>NO 10 → 0<br>He 350 | $SiH_4$ 100<br>$SiF_4$ 50<br>$B_2H_6$ 500 ppm (based on $SiH_4$)<br>NO 10 → 0<br>$H_2$ 350 |
| Substrate temperature (°C.) | 250 | 250 | 250 | 250 | 250 | 250 |
| RF power (W) | 150 | 150 | 150 | 150 | 150 | 150 |
| Inner pressure (torr) | 0.25 | 0.25 | 0.25 | 0.25 | 0.25 | 0.25 |
| Film thickness (μm) | 3 | 3 | 3 | 3 | 3 | 2.7 |

*Only the preparation condition of photoconductive layer is the same as drum No. F405

TABLE 15F

| Drum No. | F701 | F702 | F703 | F704 | F705-1 | F705-2 | F706 |
|---|---|---|---|---|---|---|---|
| Flow rate (SCCM) | $SiH_4$ 150<br>$B_2H_6$ 1000 ppm (based on $SiH_4$)<br>NO 10<br>$GeH_4$ 30<br>$H_2$ 350 | $SiH_4$ 150<br>$B_2H_6$ 500 ppm (based on $SiH_4$)<br>NO 5<br>$GeH_4$ 50<br>$H_2$ 350 | $SiH_4$ 150<br>$PH_3$ 100 ppm (based on $SiH_4$)<br>NO 5<br>$GeH_4$ 70<br>$H_2$ 350 | $SiH_4$ 150<br>$B_2H_6$ 500 ppm (based on $SiH_4$)<br>NO 10<br>$GeH_4$ 10<br>Ar 350 | $SiH_4$ 150<br>$B_2H_6$ 1000 ppm (based on $SiH_4$)<br>NO 10<br>$GeH_4$ 50<br>He 350 | $SiH_4$ 100<br>$SiF_4$ 50<br>$B_2H_6$ 1000 ppm (based on $SiH_4$)<br>NO 10<br>$GeH_4$ 50<br>$H_2$ 350 |
| Substrate temperature (°C.) | 250 | 250 | 250 | 250 | 250 | 250 |
| RF power (W) | 150 | 200 | 150 | 150 | 150 | 150 |
| Inner pressure (torr) | 0.27 | 0.27 | 0.27 | 0.27 | 0.27 | 0.27 |
| Film thickness (μm) | 0.5 | 0.5 | 0.5 | 0.5 | 0.5 | 0.5 |
| Remark | | | | | The photoconductive layer preparation conditions are the same as drum No. F405, and the charge injection preventive layer preparation conditions as drum No. F505. | The photoconductive layer preparation conditions are the same as drum No. F405, and the charge injection preventive layer preparation conditions as drum No. F605. |

TABLE 16F

| Drum No. | F701 | F702 | F703 | F704 | F705 −1 | F705 −2 | F706 |
|---|---|---|---|---|---|---|---|
| Initial charging ability | ◎ | ◎ | ◎ | ○ | ○ | ○ | ◎ |
| Initial sensitivity | | | | | | | ○ |
| Image flow | ○ | ○ | ○ | ○ | ○ | ○ | ○ |
| Interference fringe | ○ | ◎ | ○ | ○ | ◎ | ◎ | ○ |
| Residual potential | ○ | ◎ | ○ | ○ | ○ | ◎ | ◎ |
| Ghost | ◎ | ◎ | ◎ | ◎ | ◎ | ◎ | ◎ |
| Photosensitivity irregularity | ○ | ◎ | ○ | ○ | ◎ | ◎ | ○ |
| in generator direction | ◎ | ◎ | ◎ | ○ | ◎ | ◎ | ○ |
| Image defect | ◎ | ◎ | ○ | ◎ | ◎ | ◎ | ◎ |
| Sensitivity deterioration | ○ | ◎ | ◎ | ○ | ◎ | ◎ | |
| Increase of image defect | ○ | ○ | ○ | ○ | ○ | ○ | ○ |

TABLE 18F

| Drum No. | F801 | F802 | F803 | F804 | F805 −1 | F805 −2 | F806 |
|---|---|---|---|---|---|---|---|
| Initial charging ability | ◎ | ◎ | ◎ | ○ | ○ | ○ | ◎ |
| Initial sensitivity | ○ | ○ | ○ | ◎ | ○ | ○ | ○ |
| Image flow | ○ | ◎ | ○ | ○ | ◎ | ◎ | ○ |
| Interference fringe | ◎ | ◎ | ◎ | ○ | ◎ | ◎ | ◎ |
| Residual potential | ◎ | ◎ | ◎ | ◎ | ◎ | ◎ | ◎ |
| Ghost | ◎ | ◎ | ◎ | ○ | ◎ | ◎ | ○ |
| Photosensitivity irregularity | ◎ | ○ | ◎ | ○ | ◎ | ◎ | ○ |
| in generator direction | ◎ | ◎ | ○ | ◎ | ◎ | ◎ | ◎ |
| Image defect | ◎ | ○ | ◎ | ○ | ◎ | ◎ | ○ |
| Sensitivity deterioration | | | | | | | |
| Increase of image defect | ○ | ○ | ○ | ◎ | ○ | ○ | ○ |

TABLE 17F

| Drum No. | F801 | F802 | F803 | F804 | F805-1 | F805-2 | F806 |
|---|---|---|---|---|---|---|---|
| Flow rate (SCCM) | $SiH_4$ 150<br>$B_2H_6$ 1000 ppm (based on $SiH_4$)<br>NO 10<br>$GeH_4$ 30 → 0<br>$H_2$ 350 | $SiH_4$ 150<br>$B_2H_6$ 500 ppm (based on $SiH_4$)<br>NO 5<br>$GeH_4$ 50 → 0<br>$H_2$ 350 | $SiH_4$ 150<br>$PH_3$ 100 ppm (based on $SiH_4$)<br>NO 5<br>$GeH_4$ 70 → 0<br>$H_2$ 350 | $SiH_4$ 150<br>$B_2H_6$ 500 ppm (based on $SiH_4$)<br>NO 10<br>$GeH_4$ 10 → 0<br>$H_2$ 350 | $SiH_4$<br>$B_2H_6$<br>NO<br>$GeH_4$<br>He | 150<br>1000 ppm (based on $SiH_4$)<br>10<br>50 → 0<br>350 | $SiH_4$ 100<br>$SiF_4$ 50<br>$B_2H_6$ 1000 ppm (based on $SiH_4$)<br>NO 10<br>$GeH_4$ 50 → 0<br>$H_2$ 350 |
| Substrate temperature (°C.) | 250 | 250 | 250 | 250 | | 250 | 250 |
| RF power (W) | 150 | 200 | 150 | 150 | | 150 | 150 |
| Inner pressure (torr) | 0.27 | 0.27 | 0.27 | 0.27 | | 0.27 | 0.27 |
| Film thickness (μm) | 0.5 | 0.5 | 0.5 | 0.5 | | 0.5 | 0.4 |
| Remark | | | | | The photoconductive layer preparation conditions are the same as drum No. F405, and the charge injection preventive layer preparation conditions as drum No. F505. | The photoconductive layer preparation conditions are the same as drum No. F405, and the charge injection preventive layer preparation conditions as drum No. F605. | |

TABLE 19F

| Drum No. | F901 | F902 | F903 | F904 |
|---|---|---|---|---|
| Flow rate (SCCM) | $SiH_4$ 150<br>$B_2H_6$ 1000 ppm (based on $SiH_4$)<br>NO 10<br>$H_2$ 350 | $SiH_4$ 150<br>$B_2H_6$ 500 ppm (based on $SiH_4$)<br>NO 30<br>$H_2$ 350 | $SiH_4$ 150<br>$PH_3$ 100 ppm (based on $SiH_4$)<br>NO 10<br>$H_2$ 350 | $SiH_4$ 150<br>$B_2H_6$ 100 ppm (based on $SiH_4$)<br>NO 5<br>Ar 350 |
| Substrate temperature (°C.) | 250 | 250 | 250 | 250 |
| RF power (W) | 150 | 150 | 150 | 150 |
| Inner pressure (torr) | 0.25 | 0.25 | 0.25 | 0.25 |
| Film thickness (μm) | 0.1 | 0.1 | 0.1 | 0.1 |

TABLE 19F-continued

| Remark | | | | | |
|---|---|---|---|---|---|
| Drum No. | F905-1 | F905-2 | F905-3 | F905-4 | F906 |
| Flow rate (SCCM) | | $SiH_4$ 150<br>$B_2H_6$ 500 ppm<br>(based on $SiH_4$)<br>NO 10<br>He 350 | | | $SiH_4$ 100<br>$SiF_4$ 50<br>$B_2H_6$ 1000 ppm<br>(based on $SiH_4$)<br>NO 10<br>$H_2$ 350 |
| Substrate temperature (°C.) | | 250 | | | 250 |
| RF power (W) | | 150 | | | 150 |
| Inner pressure (torr) | | 0.25 | | | 0.25 |
| Film thickness (μm) | | 0.1 | | | 0.1 |
| Remark | The longer wavelength absorbing layer preparation conditions are the same as drum No. F705-1 | The longer wavelength absorbing layer preparation conditions are the same as drum No. F705-2 | The longer wavelength absorbing layer preparation conditions are the same as drum No. F805-1 | The longer wavelength absorbing layer preparation conditions are the same as drum No. F805-2 | |

TABLE 20F

| Drum No. | F901 | F902 | F903 | F904 | −1 | −2 | −3 | −4 | F906 |
|---|---|---|---|---|---|---|---|---|---|
| Initial charging ability | ○ | ○ | ○ | ○ | ◎ | | | | |
| Initial sensitivity | ○ | ○ | ○ | ○ | ○ | | | | |
| Image flow | ◎ | ◎ | ◎ | ◎ | ○ | | | | |
| Interference fringe | ○ | ◎ | ◎ | ◎ | ○ | | | | |
| Residual potential | ◎ | ◎ | ◎ | ◎ | ◎ | | | | |
| Ghost | ◎ | ◎ | ◎ | ◎ | ◎ | | | | |
| Photosensitivity irregularity in generator direction | ◎ | ◎ | ◎ | ◎ | ◎ | | | | |
| Image defect | ◎ | ◎ | ◎ | ◎ | ◎ | | | | |
| Sensitivity deterioration | ◎ | ◎ | ◎ | ◎ | ◎ | | | | |
| Increase of image defect | ○ | ○ | ○ | ○ | ○ | | | | |

TABLE 21F

| Drum No. | F1001 | F1002 | F1003 | F1004 | F1005 |
|---|---|---|---|---|---|
| a (μm) | 25 | 50 | 50 | 12 | 12 |
| b (μm) | 0.8 | 2.5 | 0.8 | 1.5 | 0.3 |

TABLE 22F

| Sample No. | F1001 | F1002 | F1003 | F1004 | F1005 |
|---|---|---|---|---|---|
| Initial charging ability | ◎ | ◎ | ◎ | ◎ | ◎ |
| Initial sensitivity | ○ | ○ | ○ | ○ | ○ |
| Image flow | ◎ | ◎ | ◎ | ◎ | ◎ |
| Interference fringe | ○ | ◎ | ○ | ◎ | ○ |
| Residual potential | ◎ | ◎ | ◎ | ◎ | ◎ |
| Ghost | ◎ | ◎ | ◎ | ◎ | ◎ |
| Photosensitivity irregularity in generator direction | ◎ | ◎ | ◎ | ◎ | ◎ |
| Image defect | ◎ | ◎ | ◎ | ◎ | ◎ |
| Sensitivity | ○ | ○ | ○ | ○ | ○ |

TABLE 22F-continued

| Sample No. | F1001 | F1002 | F1003 | F1004 | F1005 |
|---|---|---|---|---|---|
| deterioration | | | | | |
| Increase of image defect | ○ | ○ | Δ | ○ | ○ |
| Resolving power of image | | | | | |

TABLE 23F

| Drum No. | F1101 | F1102 | F1103 | F1104 | F1105 |
|---|---|---|---|---|---|
| c (μm) | 50 | 100 | 100 | 30 | 30 |
| d (μm) | 2 | 5 | 1.5 | 2.5 | 0.7 |

TABLE 24F

| Sample No. | F1101 | F1102 | F1103 | F1104 | F1105 |
|---|---|---|---|---|---|
| Initial charging ability | | | | | |
| Initial sensitivity | | | | | |
| Image flow | | | | | |

TABLE 24F-continued

| Sample No. | F1101 | F1102 | F1103 | F1104 | F1105 |
|---|---|---|---|---|---|
| Interference fringe | ◎ | ◎ | ◎ | ◎ | ◎ |
| Residual potential | ○ | ○ | ○ | ○ | ○ |
| Ghost | ◎ | ◎ | ◎ | ◎ | ◎ |
| Photosensitivity irregularity | ◎ | ◎ | ○ | ◎ | ○ |
| in generator direction | ◎ | ◎ | ◎ | ◎ | ◎ |
| Image defect | ◎ | ◎ | ◎ | ◎ | ◎ |
| Sensitivity deterioration | ◎ | ◎ | ◎ | ◎ | ◎ |
| Increase of image defect | ◎ | ◎ | ◎ | ◎ | ◎ |
| Resolving power of image | ○ | ○ | ○ | ○ | ○ |
| | Δ~○ | Δ~○ | Δ | ○ | ○ |

We claim:

1. A light-receiving member for electrophotography comprising asubstrate and a light-receiving layer provided on the substrate comprising a photoconductive layer exhibiting photoconductivity comprising an amorphous material containing at least one of hydrogen atoms and halogen atoms as the constituent in a matrix of silicon atoms and a surface layer comprising an amorphous material containing silicon atoms, carbon atoms and hydrogen atoms as the constituents, said surface layer being changed in the distribution concentration in the layer thickness direction of the constituent elements such that an optical band gap of said surface layer and an optical band gap of said photoconductive layer are matched at an interface between the surface layer and the photoconductive layer and the maximum distribution concentration of the hydrogen atoms within said surface layer being 41 to 70 atomic percent.

2. The light-receiving member according to claim 1, wherien the distribution regions of the constituents in said surface layer exist internally on the substrate side of said surface layer.

3. The light-receiving member according to claim 1, wherein the distribution regions of the constituents in said surface layer cover the entire region of said surface layer.

4. The light-receiving member according to claim 2 or 3, wherein said surface layer contains carbon atoms in the distribution region of the constituent elements in a distribution state more enriched toward the surface side.

5. The light-receiving member according to any one of claims 1 to 3, wherein said surface layer contains hydrogen atoms in the distribution region of the constituent element in a distribution state more enriched toward the surface side.

6. The light-receiving member according to any one of claims 1 to 3, wherein said photoconductive layer contains at least one of oxygen atoms and nitrogen atoms.

7. The light-receiving member according to claim 1, further comprising a charge injection preventive layer containing a substance for controlling conductivity in a matrix of silicon atoms as constituent layer of said light-receiving layer.

8. The light-receiving member according to claim 7 wherein the charge injection preventive layer is amorphous.

9. The light-receiving member according to claim 7, wherein the charge injection preventive layer is polycrystalline.

10. The light-receiving member according to claim 7, wherein the distribution regions of the constituents in said surface layer exist internally on the substrate side of said surface layer.

11. The light-receiving member according to claim 7, wherein the distribution regions of the constituents in said surface layer cover the entire region of said surface layer.

12. The light-receiving member according to claim 10 or 11, wherein said surface layer contains carbon atoms in the distribution region of the constituent elements in a distribution state more enriched toward the surface side.

13. The light-receiving member according to any one of claims 7, 10 and 11, wherein said surface layer contains hydrogen atoms in the distribution region of the constituent elements in a distribution state more enriched toward the surface side.

14. The light-receiving member according to any one of claims 7, and 10 and 11 wherein said photoconductive layer contains at least one of oxygen atoms and nitrogen atoms.

15. The light-receiving member according to any one of claims 7 to 9, wherein the charge injection preventive layer contains at least one of oxygen atoms, carbon atoms and nitrogen atoms.

16. The light-receiving member according to claim 15, wherein the charge injection preventive layer contains the substance for controlling conductivity in a distributed state more enriched on the substrate side.

17. The light-receiving member according to claim 15, wherein the charge injection preventive layer contains at least one of oxygen atoms, carbon atoms and nitrogen atoms in a distributed state more enriched on the substrate side.

18. The light-receiving member according to claim 15, wherein the oxygen atoms, the carbon atoms and/or the nitrogen atoms contained in the charge injection preventive.layer exist internally on the substrate side.

19. The light-receiving member according to claim 1, further comprising a longer wavelength light absorbing layer having sensitivity to longer wavelength light containing silicon atoms and germanium atoms as constituent layer of said light-receiving layer.

20. The light-receiving member according to claim 19, wherein the longer wavelength light absorbing layer amorphous.

21. The light-receiving member according to claim 19, wherein the longer wavelength light absorbing layer is polycrystalline.

22. The light-receiving member according to claim 19, wherein the distribution regions of the constituents in said surface layer exist internally on the substrate side of said surface layer.

23. The light-receiving member according to claim 19, wherein the distribution regions of the constituents in said surface layer cover the entire region of said surface layer.

24. The light-receiving member according to claim 22 or 23, wherein said surface layer contains carbon atoms in the distribution region of the constituent elements in a distributions state more enriched toward the surface side.

25. The light-receiving member according to any one of claims 19, 22 and 23 wherein said surface layer contains hydrogen atoms in the distribution region of the constituent elements in a distribution state more enriched toward the surface side.

26. The light-receiving member according to any one of claims 19, and 22 and 23, wherein said photoconductive layer contains at least one of oxygen atoms and nitrogen atoms.

27. The light-receiving member according to any one of claims 19 to 21, wherein the longer wavelength light absorbing layer contains at least one of substances for controlling conductivity, oxygen atoms, carbon atoms and nitrogen atoms.

28. The light-receiving member according to claim 27, wherein the substance for controlling conductivity is an atom belonging to the group III of the periodic table.

29. The light-receiving member according to claim 27, wherein the substance for controlling conductivity is an atom belonging to the group V of the periodic table.

30. The light-receiving member according to claim 2, further comprising a longer wavelength light absorbing layer having sensitivity to longer wavelength light containing silicon atoms and germanium atoms.

31. The light-receiving member according to claim 30, wherein the charge injection preventive layer is amorphous.

32. The light-receiving member according to claim 30, wherein the charge injection preventive layer is polycrystalline.

33. The light-receiving member according to claim 31 or 32, wherein the longer wavelength light absorbing layer is amorphous.

34. The light-receiving member according to claim 31 or 32, wherein the longer wavelength light absorbing layer is polycrystalline.

35. The light-receiving member according to claim 30, wherein the distribution regions of the constituents in said surface layer exist internally on the substrate side of said surface layer.

36. The light-receiving member according to claim 30, wherein the distribution regions of the constituents in said surface layer cover the entire region of said surface layer.

37. The light-receiving member according to claim 35 or 36, wherein said surface layer contains carbon atoms in the distributaion region of the constituent elements in a distribution state more enriched toward the surface side.

38. The light-receiving member according to any one of claims 30, 35 and 36, wherein said surface layer contains hydrogen atoms in the distribution region of the constituent element in a distribution state more enriched toward the surface side.

39. The light-receiving member according to any one of claims 30, 35 and 36, wherein said photoconductive layer contains at least one of oxygen atoms and nitrogen atoms.

40. The light-receiving member according to claim 30, wherein the charge injection preventive layer contains at least one of oxygen atoms, carbon atoms and nitrogen atoms.

41. The light-receiving member according to claim 30, wherein the charge injection preventive layer contains the substance for controlling conductivity in a distributed state more enriched on the substrate side.

42. The light-receiving member according to claim 40, wherein the charge injection preventive layer contains at least one of oxygen atoms, carbon atoms and nitrogen atoms in a distributed state more enriched on the substrate side.

43. The light-receiving member according to claim 40, wherein the oxygen atoms, the carbon atoms and/or the nitrogen atoms contained in the charge injection preventive layer exist internally on the substrate side.

44. The light-receiving member according to claim 30, wherein the longer wavelength light absorbing layer contains at least one of substances for controlling conductivity, oxygen atoms, carbon atoms and nitrogen atoms.

45. The light-receiving memeber according to claim 30 or 44, wherein the substance for controlling conductivity is an atom belonging to the group III of the periodic table.

46. The light-receiving member according to claim 30 or 44, wherein the substance for controlling conductivity is an atom belonging to the group V of the periodic table.

47. The light-receiving member according to any of claims 1,7 to 9, 19 to 21 and 30 to 32, further comprising an adhesion layer comprising an amorphous material or a polycrystalline material containing silicon atoms and at least one of nitrogen atoms, oxygen atoms and carbon atoms as constituent layer of said light-receiving layer.

* * * * *

UNITED STATES PATENT AND TRADEMARK OFFICE

CERTIFICATE OF CORRECTION

PATENT NO. : 4,786,574

DATED : November 22, 1988

INVENTOR(S) : SHIGERU SHIRAI, ET AL.

It is certified that error appears in the above-identified patent and that said Letters Patent is hereby corrected as shown below:

COLUMN 1

Line 29, "A-Si]has" should read --A-Si] has--.
Line 51, "so called" should read --so-called--.

COLUMN 2

Line 65, "capale" should read --capable--.

COLUMN 3

Line 1, "still" should be deleted.
Line 57, "crosssectional" should read --cross-sectional--.

COLUMN 4

Line 9, "constitutent" should read --constituent--.

COLUMN 6

Line 67, "$D/R \leqq 0.035$," should read --$D/R \geqq 0.035$,--.

COLUMN 7

Line 4, "$D/R \leqq 0.055$," should read --$D/R \geqq 0.055$,--.
Line 41, "(nd);" should read --(Nd);--.

UNITED STATES PATENT AND TRADEMARK OFFICE

CERTIFICATE OF CORRECTION

PATENT NO. : 4,786,574

DATED : November 22, 1988

INVENTOR(S) : SHIGERU SHIRAI, ET AL.

It is certified that error appears in the above-identified patent and that said Letters Patent is hereby corrected as shown below:

COLUMN 10

Line 9, "group II" should read --group III--.
Line 36, "group II" should read --group III--.
Line 53, "$AsF_3$ $AsF_5$," should read --$AsF_3$, $AsF_5$,--.

COLUMN 11

Line 29, "tee" should read --the--.
Line 54, "preent" should read --present--.

COLUMN 13

Line 5, "FIGS." should read --FIGS.,--.
Line 63, "number" should read --member--.

COLUMN 14

Line 16, "depositin" should read --depositing--.
Line 45, "aoms" should read --atoms--.

COLUMN 15

Line 14, "sputter" should read --sputtering--.
Line 34, "so called" should read --so-called--.

COLUMN 16

Line 7, "in" should read --of--.
Line 28, "in chamber" should read --chamber--.
Line 55, "should" should read --should be--.

UNITED STATES PATENT AND TRADEMARK OFFICE

CERTIFICATE OF CORRECTION

PATENT NO. : 4,786,574

DATED : November 22, 1988

INVENTOR(S) : SHIGERU SHIRAI, ET AL.

It is certified that error appears in the above-identified patent and that said Letters Patent is hereby corrected as shown below:

COLUMN 17

Line 12, "refletion" should read --reflection--.
Line 39, "as the" should read --of the--.
Line 41, "deteriorat-on" should read --deterioration--.

COLUMN 18

Line 29, "effcctively" should read --effectively--.

COLUMN 19

Line 45, "efficienty," should read --efficiency,--.
Line 67, "layer 404" should read --layer 406--.

COLUMN 20

Line 26, "so called" should read --so-called--.

COLUMN 21

Line 36, "Egopt" should read --Eg opt--.
Lines 52-53, "in which" should read --of--.

COLUMN 22

Line 30, "$C_{45}$from" should read --$C_{45}$ from--.

UNITED STATES PATENT AND TRADEMARK OFFICE

CERTIFICATE OF CORRECTION

PATENT NO. : 4,786,574

DATED : November 22, 1988

INVENTOR(S) : SHIGERU SHIRAI, ET AL.

It is certified that error appears in the above-identified patent and that said Letters Patent is hereby corrected as shown below:

COLUMN 25

Line 47, "monoxide" should read --monooxide--.
Line 54, "containing," should read --containing--.

COLUMN 26

Line 12, "polycrystaline" should read --polycrystalline--.
Line 68, "accomplished" should read --accomplishing--.

COLUMN 27

Line 45, "lightreceiving" should read --light-receiving--.

COLUMN 28

Line 14, "in" should read --is in--.
Line 62, "$C_2$" should read --$C_{47}$--.
Line 63, "$t_1$" should read --$t_8$--.

COLUMN 29

Line 39, "desirably" should read --desirable--.

COLUMN 30

Line 68, "of" should read --or--.

UNITED STATES PATENT AND TRADEMARK OFFICE

CERTIFICATE OF CORRECTION

PATENT NO. : 4,786,574

DATED : November 22, 1988

INVENTOR(S) : SHIGERU SHIRAI, ET AL.

It is certified that error appears in the above-identified patent and that said Letters Patent is hereby corrected as shown below:

COLUMN 32

Line 55, "halcgen" should read --halogen--.
Lines 65-66, "ofoxygen" should read --of oxygen--.

COLUMN 33

Line 37, "$(NH_2NH_2)$ As" should read --$(NH_2NH_2)$. As--.
Line 46, "cartons" should read --carbon atoms--.

COLUMN 34

Line 7, "$B_5H_9B_5H_{10}$," should read --$B_5H_9$, $B_5H_{10}$,--.
Line 34, "preferably" should read --preferably be--.
Line 36, "preferably" should read --preferably be--.
Line 55, "in" should read --of--.

COLUMN 35

Line 23, "posessed" should read --possessed--.
Line 26, "posessed" should read --possessed--.
Line 31, "effectively the" should read --the--.
Line 53, "lightreceiving" should read --light-receiving--.

COLUMN 36

Line 3, "317" should read --3317--.
Line 5, "evacuated" should read --evacuate--.
Line 9, "3312," should read --3321--.
Line 25, "$B_2H_6$/He" should read --$B_2H_6/H_2$--.
Line 45, "$B_2H_6$/He" should read --$B_2H_6/H_2$--.

UNITED STATES PATENT AND TRADEMARK OFFICE

CERTIFICATE OF CORRECTION

PATENT NO. : 4,786,574

DATED : November 22, 1988

INVENTOR(S) : SHIGERU SHIRAI, ET AL.

It is certified that error appears in the above-identified patent and that said Letters Patent is hereby corrected as shown below:

COLUMN 37

Figure 34:
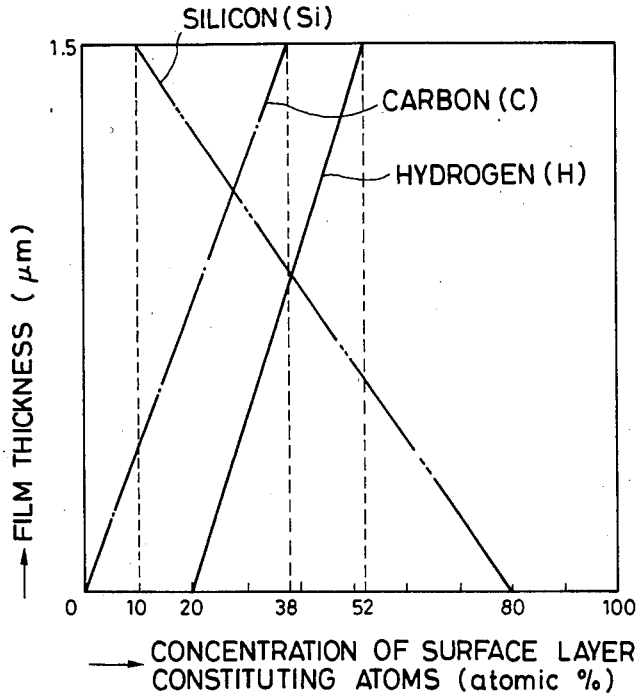
FIG. 34 and 37–42 are illustrations showing the distribution states of the respective atoms.

Line 59, "Table 34." should read --FIG. 34--.

COLUMN 38

Line 45, "12." should read --12A.--.

COLUMNS 38-39

Lines 68-1, "prepatation" should read --preparation--.

COLUMN 39

Line 2, "cinditions" should read --conditions--.
Line 11, "so called" should read --so-called--.

COLUMN 41

Line 31, "EXAMPLE 7" should read --EXAMPLE 7B--.

COLUMN 42

Line 9, "so called" should read --so-called--.
Between lines 61 and 62, --EXAMPLE 2C-- should be inserted.

COLUMN 43

Line 55, "EXAMPLE 6" should read --EXAMPLE 6C--.

UNITED STATES PATENT AND TRADEMARK OFFICE

CERTIFICATE OF CORRECTION

PATENT NO. : 4,786,574

DATED : November 22, 1988

INVENTOR(S) : SHIGERU SHIRAI, ET AL.

It is certified that error appears in the above-identified patent and that said Letters Patent is hereby corrected as shown below:

COLUMN 44

Line 10, "EXAMPLE 8" should read --EXAMPLE 8C--.
Line 13, "so called" should read --so-called--.

COLUMN 45

Line 64, "EXAMPLE 5" should read --EXAMPLE 5D--.

COLUMN 46

Line 12, "EXAMPLE 7" should read --EXAMPLE 7D--.
Line 20, "EXAMPLE 8" should read --EXAMPLE 8D--.
Line 33, "29D" should read --29--.
Line 43, "EXAMPLE 10" should read --EXAMPLE 10D--.
Line 45, "so called" should read --so-called--.

COLUMN 47

Line 38, "COMPARATIVE EXAMPLE 1" should read --COMPARATIVE EXAMPLE 1E--.

COLUMN 49

Line 27, "EXAMPLE 8" should read --EXAMPLE 8E--.
Line 55, "EXAMPLE 10" should read --EXAMPLE 10E--.

UNITED STATES PATENT AND TRADEMARK OFFICE

CERTIFICATE OF CORRECTION

PATENT NO. : 4,786,574

DATED : November 22, 1988

INVENTOR(S) : SHIGERU SHIRAI, ET AL.

It is certified that error appears in the above-identified patent and that said Letters Patent is hereby corrected as shown below:

COLUMN 50

Line 1, "EXAMPLE 11" should read --EXAMPLE 11E--.
Line 21, "Example E" should read --Example 1E--.
Line 28, "ar" should read --are--.
Line 45, "EXAMPLE 14" should read --EXAMPLE 14E--.
Line 47, "so called" should read --so-called--.

COLUMN 51

Line 29, "Table 4." should read --Table 4F.--.

COLUMN 52

Line 17, "EXAMPLE 4" should read --EXAMPLE 4F--.

COLUMN 54

Line 4, "so called" should read --so-called--.

COLUMN 57

TABLE 12A, "Intial" should read --Initial--.
TABLE 14A, "Intial" should read --Initial--.

UNITED STATES PATENT AND TRADEMARK OFFICE

CERTIFICATE OF CORRECTION

PATENT NO. : 4,786,574

DATED : November 22, 1988

INVENTOR(S) : SHIGERU SHIRAI, ET AL.

It is certified that error appears in the above-identified patent and that said Letters Patent is hereby corrected as shown below:

COLUMN 59

TABLE 2B,

"ability ◎ sensitivity ○ flow ◎ potential ◎ Ghost ◎"

should read

--ability ◎ sensitivity ○ flow ◎ potential ◎ Ghost ◎ --.

COLUMN 61

TABLE 5B, "NO →0 should -- →0
$H_2$ 10→0 read NO 10→0
500 " $H_2$ 500 --.

COLUMNS 61-62

TABLE 6B,

"ability ◎ sensitivity ○ flow ◎ potential ◎ Ghost ◎ tion ◎ defect ○ tion ◎ defects ◎"

should read

--ability ◎ sensitivity ○ flow ◎ potential ◎ Ghost ◎ tion ◎ defect ◎ tion ◎ defects ◎ --.

UNITED STATES PATENT AND TRADEMARK OFFICE

CERTIFICATE OF CORRECTION

PATENT NO. : 4,786,574

DATED : November 22, 1988

INVENTOR(S) : SHIGERU SHIRAI, ET AL.

It is certified that error appears in the above-identified patent and that said Letters Patent is hereby corrected as shown below:

COLUMN 62

TABLE 8B, "oration should read --oration

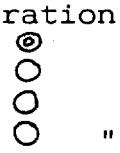

"

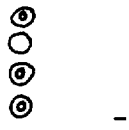

--.

COLUMNS 63-64

TABLE 8B-continued, "B305 B306 B305-1 B306-1"

should read

--B305 B306

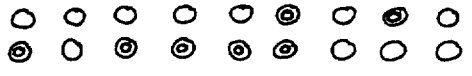

B305-1 B306-1--.

COLUMN 63

TABLE 12B, "B503 " should read --B503 --.

COLUMN 66

TABLE 12B-continued,

"Increase of image defects should read --Increase of image defects

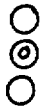

"

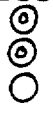

--.

UNITED STATES PATENT AND TRADEMARK OFFICE

CERTIFICATE OF CORRECTION

PATENT NO. : 4,786,574

DATED : November 22, 1988

INVENTOR(S) : SHIGERU SHIRAI, ET AL.

It is certified that error appears in the above-identified patent and that said Letters Patent is hereby corrected as shown below:

COLUMN 67

TABLE 18B, "Residual potential ○ ○ ○ " should read --Residual potential ◎ ◎ ◎ --.

COLUMN 67

TABLE 22B, "Image flow ◎ ◎ ◎ ○ ◎ " should read --Image flow ◎ ◎ ◎ ◎ ◎ --.

COLUMN 67

TABLE 2C,

"ability sensitivity flow potential Ghost generator direction
◎ ○ ◎ ◎ ◎ ◎ "

should read

--ability sensitivity flow potential Ghost generator direction
◎ ○ ◎ ◎ ◎ ◎ --.

UNITED STATES PATENT AND TRADEMARK OFFICE

CERTIFICATE OF CORRECTION

PATENT NO. : 4,786,574

DATED : November 22, 1988

INVENTOR(S) : SHIGERU SHIRAI, ET AL.

It is certified that error appears in the above-identified patent and that said Letters Patent is hereby corrected as shown below:

COLUMN 69

TABLE 5C, "NO →0 should -- →0
$H_2$ 10→0 read NO 10→0
350 " $H_2$ 350 --.

COLUMN 69

TABLE 6C,

"ability sensitivity flow potential Ghost generator direction
◎ ○ ◎ ◎ ◎
"

should read

"ability sensitivity flow potential Ghost generator direction
◎ ○ ◎ ◎ ◎ ◎
--.

COLUMN 69 - 70

TABLE 6C, "defect tion defects
◎ ○ ◎ ◎
"

should read

--defect tion defects
○ ◎ ◎
--.

UNITED STATES PATENT AND TRADEMARK OFFICE

CERTIFICATE OF CORRECTION

PATENT NO. : 4,786,574

DATED : November 22, 1988

INVENTOR(S) : SHIGERU SHIRAI, ET AL.

It is certified that error appears in the above-identified patent and that said Letters Patent is hereby corrected as shown below:

COLUMN 71

TABLE 8C, "Residual potential" should read --Residual potential--.

| | |
|---|---|
| ○ | ◎ |
| ○ | ◎ |
| ○ | ◎ |
| ○ | ○ |
| ○ | ○ |
| ◎ | ◎ |
| X | X |

COLUMN 73

TABLE 12C, "Residual potential" should read --Residual potential--.

| | |
|---|---|
| ◎ | ◎ |
| ◎ | ◎ |
| ○ | ○ |
| ○ | ◎ |
| ◎ | ◎ |
| ○ | ○ |

COLUMN 75

TABLE 1D, "(based On" should read --(based on--.

UNITED STATES PATENT AND TRADEMARK OFFICE

CERTIFICATE OF CORRECTION

PATENT NO. : 4,786,574

DATED : November 22, 1988

INVENTOR(S) : SHIGERU SHIRAI, ET AL.

It is certified that error appears in the above-identified patent and that said Letters Patent is hereby corrected as shown below:

COLUMN 79

TABLE 8D-continued, "D306 ○ ○ " should read --D306 ○ ◎ --.

COLUMN 81

TABLE 14D, "Photosensitivity ○ ○ ◎ " should read --Photosensitivity ◎ ○ ◎ --.

COLUMN 82

TABLE 14D, "Image defect ◎ ○ ◎ ○ ◎ ◎
Sensitivity ○ ○ ○ ○ ○ ○
deterioration "

should read

--Image defect ◎ ○ ○ ○ ○ ○
Sensitivity ◎ ○ ◎ ○ ◎ ◎
deterioration --.

UNITED STATES PATENT AND TRADEMARK OFFICE

CERTIFICATE OF CORRECTION

PATENT NO. : 4,786,574

DATED : November 22, 1988

INVENTOR(S) : SHIGERU SHIRAI, ET AL.

It is certified that error appears in the above-identified patent and that said Letters Patent is hereby corrected as shown below:

COLUMN 85

TABLE 20D, "Interference fringe ○ ○ ○ ○ ○ "

should read

--Interference fringe ○ ⊙ ○ ⊙ ○ --.

COLUMN 86

TABLE 22D, "Resolving Δ- Δ- " should read
--Resolving Δ-○ Δ-○ --.

COLUMN 100

TABLE 30E, The symbols under "Image defect" are not legible and should read -- ◎ ○ ○ ○ ○ --.

UNITED STATES PATENT AND TRADEMARK OFFICE

CERTIFICATE OF CORRECTION

PATENT NO. : 4,786,574

DATED : November 22, 1988

INVENTOR(S) : SHIGERU SHIRAI, ET AL.

It is certified that error appears in the above-identified patent and that said Letters Patent is hereby corrected as shown below:

COLUMN 108

TABLE 14F, The symbols in this table are not legible and should read as shown below.

Table 14F

| Drum No. | F601 | F602 | F603 | F604 | F605 | F606 |
|---|---|---|---|---|---|---|
| Initial charging ability | ○ | ○ | ○ | ◎ | ○ | ◎ |
| Initial sensitivity | ○ | ○ | ○ | ○ | ○ | ○ |
| Image flow | ○ | ◎ | ○ | ○ | ◎ | ○ |
| Interference fringe | ◎ | ○ | ○ | ◎ | ◎ | ◎ |
| Residual potential | ◎ | ◎ | ◎ | ◎ | ◎ | ◎ |
| Ghost | ◎ | ◎ | ◎ | ○ | ◎ | ○ |
| Photosensitivity irregularity in generator direction | ◎ | ○ | ◎ | ◎ | ◎ | ○ |
| Image defect | ◎ | ◎ | ○ | ◎ | ◎ | ◎ |
| Sensitivity deterioration | ◎ | ○ | ◎ | ◎ | ◎ | ○ |
| Increase of image defect | ◎ | ○ | ○ | ○ | ◎ | ○ |

UNITED STATES PATENT AND TRADEMARK OFFICE

CERTIFICATE OF CORRECTION

PATENT NO. : 4,786,574

DATED : November 22, 1988

INVENTOR(S) : SHIGERU SHIRAI, ET AL.

It is certified that error appears in the above-identified patent and that said Letters Patent is hereby corrected as shown below:

COLUMN 109

TABLE 16F, "Initial charging ability ◎ ◎ ◎ ○ ○ ○ ◎ should read

Initial sensitivity ○ ○ ○ ○ ○ ○ ○"

--Initial charging ability ◎ ◎ ◎ ○ ○ ○ ◎

Initial sensitivity ○ ○ ○ ○ ○ ○ ○--

UNITED STATES PATENT AND TRADEMARK OFFICE

CERTIFICATE OF CORRECTION

PATENT NO. : 4,786,574

DATED : November 22, 1988

INVENTOR(S) : SHIGERU SHIRAI, ET AL.

It is certified that error appears in the above-identified patent and that said Letters Patent is hereby corrected as shown below:

COLUMN 109

TABLE 16F, "

| | | | | | | | |
|---|---|---|---|---|---|---|---|
| Image flow | ○ | ◎ | ○ | ○ | ◎ | ◎ | ○ |
| Interference fringe | ○ | ◎ | ○ | ○ | ○ | ◎ | ◎ |
| Residual potential | ◎ | ◎ | ◎ | ◎ | ◎ | ◎ | ◎ |
| Ghost | ◎ | ◎ | ◎ | ◎ | ◎ | ◎ | ◎ |
| Photosensitivity irregularity | ○ | ◎ | ○ | ○ | ◎ | ◎ | ○ |
| in generator direction | ◎ | ◎ | ◎ | ○ | ◎ | ◎ | ○ |
| Image defect | ◎ | ◎ | ○ | ◎ | ◎ | ◎ | ◎ |
| Sensitivity deterioration | ○ | ◎ | ◎ | ○ | ◎ | ◎ | |

"

should read

--

| | | | | | | | |
|---|---|---|---|---|---|---|---|
| Image flow | ○ | ◎ | ○ | ○ | ◎ | ◎ | ○ |
| Interference fringe | ○ | ◎ | ○ | ○ | ○ | ◎ | ◎ |
| Residual potential | ◎ | ◎ | ◎ | ◎ | ◎ | ◎ | ◎ |
| Ghost | ◎ | ◎ | ◎ | ○ | ◎ | ◎ | ○ |
| Photosensitivity irregularity | ◎ | ○ | ◎ | ○ | ◎ | ◎ | ○ |
| in generator direction | | | | | | | |
| Image defect | ◎ | ◎ | ○ | ◎ | ◎ | ◎ | ◎ |
| Sensitivity deterioration | ○ | ◎ | ◎ | ○ | ◎ | ◎ | ○ |

--.

UNITED STATES PATENT AND TRADEMARK OFFICE

CERTIFICATE OF CORRECTION

PATENT NO. : 4,786,574

DATED : November 22, 1988

INVENTOR(S) : SHIGERU SHIRAI, ET AL.

It is certified that error appears in the above-identified patent and that said Letters Patent is hereby corrected as shown below:

COLUMN 111

TABLE 20F, "F901 F902 F903 F904 -1 -2 -3 -4 F906

| F901 | F902 | F903 | F904 | -1 | -2 | -3 | -4 | F906 |
|---|---|---|---|---|---|---|---|---|
| ○ | ○ | ○ | ○ | ◎ | | | | |
| ○ | ○ | ○ | ○ | ○ | | | | |
| ◎ | ◎ | ◎ | ◎ | ○ | | | | |
| ○ | ◎ | ◎ | ◎ | ○ | | | | |
| ◎ | ◎ | ◎ | ◎ | ◎ | | | | |
| ◎ | ◎ | ◎ | ◎ | ◎ | | | | |
| ◎ | ◎ | ◎ | ◎ | ◎ | | | | |
| ◎ | ◎ | ◎ | ◎ | ◎ | | | | |
| ◎ | ◎ | ◎ | ◎ | ◎ | | | | |
| ○ | ○ | ○ | ○ | ○ | | | | |

"

should read

| --F901 | F902 | F903 | F904 | F905-1 | F905-2 | F905-3 | F905-4 | F906 |
|---|---|---|---|---|---|---|---|---|
| ◎ | ◎ | ◎ | ◎ | ○ | ○ | ○ | ○ | ◎ |
| ○ | ○ | ○ | ○ | ○ | ○ | ○ | ○ | ○ |
| ○ | ◎ | ○ | ○ | ◎ | ◎ | ◎ | ◎ | ○ |
| ○ | ○ | ○ | ○ | ○ | ◎ | ◎ | ◎ | ○ |
| ◎ | ◎ | ◎ | ◎ | ◎ | ◎ | ◎ | ◎ | ◎ |
| ◎ | ◎ | ◎ | ◎ | ◎ | ◎ | ◎ | ◎ | ◎ |
| ◎ | ◎ | ○ | ○ | ◎ | ◎ | ◎ | ◎ | ◎ |
| ◎ | ◎ | ◎ | ◎ | ◎ | ◎ | ◎ | ◎ | ◎ |
| ◎ | ◎ | ○ | ○ | ◎ | ◎ | ◎ | ◎ | ○ |
| ○ | ○ | ○ | ○ | ○ | ○ | ○ | ○ | |

--.

UNITED STATES PATENT AND TRADEMARK OFFICE

CERTIFICATE OF CORRECTION

PATENT NO. : 4,786,574

DATED : November 22, 1988

INVENTOR(S) : SHIGERU SHIRAI, ET AL.

It is certified that error appears in the above-identified patent and that said Letters Patent is hereby corrected as shown below:

COLUMN 112

TABLE 24F, "Initial charging
ability
Initial
sensitivity
Image flow"

should read

--Initial charging ◎ ◎ ◎ ◎ ◎
ability
Initial ○ ○ ○ ○ ○
sensitivity
Image flow ◎ ◎ ◎ ◎ ◎ --.

CERTIFICATE OF CORRECTION

PATENT NO. : 4,786,574
DATED : November 22, 1988
INVENTOR(S) : SHIGERU SHIRAI, ET AL.

It is certified that error appears in the above-identified patent and that said Letters Patent is hereby corrected as shown below:

COLUMN 113

TABLE 24F-continued,

| | | | | | |
|---|---|---|---|---|---|
| "Interference fringe | ◎ | ◎ | ◎ | ◎ | ◎ |
| | ○ | ○ | ○ | ○ | ○ |
| Residual potential | ◎ | ◎ | ◎ | ◎ | ◎ |
| Ghost Photosensitivity | ◎ | ◎ | ○ | ◎ | ○ |
| Irregularity in generator | ◎ | ◎ | ◎ | ◎ | ◎ |
| | ◎ | ◎ | ◎ | ◎ | ◎ |
| Image defect | ◎ | ◎ | ◎ | ◎ | ◎ |
| Sensitivity deterioration | ◎ | ○ | ◎ | ◎ | ○ |
| | ◎ | ◎ | ◎ | ◎ | ◎ " |

should read

| | | | | | |
|---|---|---|---|---|---|
| --Interference fringe | ◎ | ◎ | ○ | ◎ | ○ |
| Residual potential | ◎ | ◎ | ◎ | ◎ | ◎ |
| Ghost | ◎ | ◎ | ◎ | ◎ | ◎ |
| Photosensitivity irregularity in generator | ◎ | ◎ | ◎ | ◎ | ◎ |
| Image defect | ◎ | ○ | ◎ | ◎ | ○ |
| Sensitivity deterioration | ◎ | ◎ | ◎ | ◎ | ◎ --. |

UNITED STATES PATENT AND TRADEMARK OFFICE

CERTIFICATE OF CORRECTION

PATENT NO. : 4,786,574

DATED : November 22, 1988

INVENTOR(S) : SHIGERU SHIRAI, ET AL.

It is certified that error appears in the above-identified patent and that said Letters Patent is hereby corrected as shown below:

COLUMN 113

Line 21, "asubstrate" should read --a substrate--.
Line 39, "wherien" should read --wherein--.
Line 54, "element" should read --elements--.
Line 66, "claim 7" should read --claim 7,--.

COLUMN 114

Line 22, "claims 7, and 10 and 11" should read --claims 7, 10 and 11--.
Line 50, "amorphous." should read --is amorphous.--.
Line 65, "distributions" should read --distribution--.

COLUMN 115

Line 5, "claims 19, and 22 and 23," should read --claims 19, 22 and 23,--.
Line 48, "distributaion" should read --distribution--.

UNITED STATES PATENT AND TRADEMARK OFFICE

CERTIFICATE OF CORRECTION

PATENT NO. : 4,786,574

DATED : November 22, 1988

INVENTOR(S) : SHIGERU SHIRAI, ET AL.

It is certified that error appears in the above-identified patent and that said Letters Patent is hereby corrected as shown below:

COLUMN 116

Line 6, "element" should read --elements--.
Line 34, "memeber" should read --member--.

Signed and Sealed this

Fifteenth Day of May, 1990

*Attest:*

HARRY F. MANBECK, JR.

*Attesting Officer*

*Commissioner of Patents and Trademarks*